US012329193B2

(12) United States Patent
Campitelli et al.

(10) Patent No.: US 12,329,193 B2
(45) Date of Patent: Jun. 17, 2025

(54) TUBULAR ELEMENT, COMPRISING POROUS MEDIUM AND A WRAPPER, FOR USE WITH AN AEROSOL GENERATING ARTICLE

(71) Applicant: Philip Morris Products S.A., Neuchatel (CH)

(72) Inventors: Gennaro Campitelli, Neuchatel (CH); Gianpaolo D'Ambra, Castel Maggiore (IT); Onur Dayioglu, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 863 days.

(21) Appl. No.: 17/413,794

(22) PCT Filed: Dec. 16, 2019

(86) PCT No.: PCT/EP2019/085446
§ 371 (c)(1),
(2) Date: Jun. 14, 2021

(87) PCT Pub. No.: WO2020/127116
PCT Pub. Date: Jun. 25, 2020

(65) Prior Publication Data

US 2022/0007710 A1 Jan. 13, 2022

(30) Foreign Application Priority Data

Dec. 17, 2018 (EP) ..... 18212933

(51) Int. Cl.
*A24D 1/20* (2020.01)
*A24D 1/00* (2020.01)
(Continued)

(52) U.S. Cl.
CPC ..... *A24D 1/20* (2020.01); *A24D 1/002* (2013.01); *A24D 1/02* (2013.01); *A24F 40/465* (2020.01)

(58) Field of Classification Search
CPC .. A24D 1/20; A24D 1/002; A24D 1/02; A24F 40/465
See application file for complete search history.

(56) References Cited

U.S. PATENT DOCUMENTS 4,991,596 A * 2/1991 Lawrence ..... A24D 1/22 131/194
5,505,214 A * 4/1996 Collins ..... A24D 1/20 131/194

(Continued)

FOREIGN PATENT DOCUMENTS

CN 102883630 A 1/2013
CN 107427088 A 12/2017

(Continued)

OTHER PUBLICATIONS

Combined Chinese Office Action and Search Report issued on Mar. 2, 2023 in Chinese Patent Application No. 201980079017.1, 9 pages.

(Continued)

*Primary Examiner* — Thanh Tam T Le
(74) *Attorney, Agent, or Firm* — Oblon, McClelland, Maier & Neustadt, L.L.P.

(57) ABSTRACT

A tubular element for an aerosol-generating article is provided, the tubular element including: a wrapper that forms a first longitudinal passageway; a porous medium loaded with gel; and a susceptor disposed longitudinally within the tubular element, the gel including an active agent, wherein the wrapper including paper, and the susceptor being in contact with the porous medium loaded with the gel.

15 Claims, 18 Drawing Sheets

(51) Int. Cl.
*A24D 1/02* (2006.01)
*A24F 40/465* (2020.01)

(56) References Cited

U.S. PATENT DOCUMENTS

| | | | | |
|---|---|---|---|---|
| 5,613,505 | A | 3/1997 | Campbell et al. | |
| 10,499,690 | B2 * | 12/2019 | Thorens | A24D 1/20 |
| 10,660,368 | B2 * | 5/2020 | Thorens | H05B 1/0227 |
| 10,918,135 | B2 * | 2/2021 | Thorens | A24D 1/20 |
| 11,278,051 | B2 * | 3/2022 | Zhao | A24D 1/002 |
| 11,457,660 | B2 * | 10/2022 | Watanabe | A24D 1/20 |
| 11,969,007 | B2 * | 4/2024 | Thorens | H05B 1/0227 |
| 2007/0186945 | A1 | 8/2007 | Olegario et al. | |
| 2012/0222690 | A1 | 9/2012 | Branton et al. | |
| 2014/0123992 | A1 * | 5/2014 | Thomas | A24D 1/22 131/349 |
| 2016/0135506 | A1 | 5/2016 | Sanchez et al. | |
| 2018/0007972 | A1 | 1/2018 | Thorens | |
| 2018/0007973 | A1 | 1/2018 | Thorens | |
| 2018/0007974 | A1 | 1/2018 | Thorens | |
| 2018/0015237 | A1 | 1/2018 | Thorens | |
| 2018/0029782 | A1 | 2/2018 | Zuber et al. | |
| 2018/0098573 | A1 | 4/2018 | Yu et al. | |
| 2018/0338520 | A1 | 11/2018 | Sutton et al. | |
| 2019/0029315 | A1 | 1/2019 | Malgat | |
| 2019/0046741 | A1 | 2/2019 | Lord et al. | |
| 2019/0216133 | A1 | 7/2019 | Fursa et al. | |
| 2019/0230990 | A1 | 8/2019 | Hepworth | |
| 2020/0060351 | A1 | 2/2020 | Thorens | |
| 2020/0245679 | A1 | 8/2020 | Watanabe | |

FOREIGN PATENT DOCUMENTS

| | | | |
|---|---|---|---|
| CN | 107920596 | A | 4/2018 |
| GB | 2490740 | A | 11/2012 |
| JP | 8-511175 | A | 11/1996 |
| JP | 3212228 | U | 9/2017 |
| JP | 2018-504927 | A | 2/2018 |
| WO | WO 2017/042297 | A1 | 3/2017 |
| WO | WO 2017/144861 | A1 | 8/2017 |
| WO | WO 2018/041924 | A1 | 3/2018 |
| WO | WO 2018/050720 | A1 | 3/2018 |
| WO | WO 2018/206616 | A1 | 11/2018 |

OTHER PUBLICATIONS

Japanese Office Action issued Dec. 21, 2023 in Japanese Patent Application No. 2021-532457, 5 pages.
Combined Chinese Office Action and Search Report issued Feb. 9, 2024, in Chinese patent Application No. 201980079017.1 (with English Translation), 20 pages.
International Search Report and Written Opinion issued Jun. 19, 2020 in PCT/EP2019/085446 filed Dec. 16, 2019.
European Search Report issued Oct. 1, 2019 in European Patent Application No. 18212933.8 filed Dec. 17, 2018.
International Preliminary Report on Patentability issued Apr. 29, 2021 in PCT/EP2019/085446 filed Dec. 16, 2019.
European Office Action issued Sep. 16, 2024 in European Patent Application No. 19 828 256.8, 4 pages.
Chinese Office Action issued Jun. 14, 2024 in Chinese Patent Application No. 201980079017.1, 7 pages.

* cited by examiner

TUBULAR ELEMENT, COMPRISING POROUS MEDIUM AND A WRAPPER, FOR USE WITH AN AEROSOL GENERATING ARTICLE

The present disclosure relates to a tubular element for use with an aerosol generating article, where the tubular element comprises a porous medium loaded with gel. Preferably the tubular element comprises a wrapper.

Articles comprising nicotine for use with aerosol generating devices are known. Often the articles comprise a liquid, such as an e-liquid, that is heated by a coiled electrically resistive filament to release an aerosol. Manufacturing, transport and storage of such aerosol generating articles comprising liquid may be problematic and could lead to leakage of the liquid and the contents of the liquid.

It would be desirable to provide a tubular element for use in an aerosol generating article and device where the tubular element exhibits little to no leakage.

It would also be desirable to provide a tubular element, that includes a flow control system that efficiently delivers aerosol generated from the tubular element, when heated by the aerosol generating device.

According to the present invention there is provided a tubular element, the tubular element comprising a first longitudinal passageway, and the tubular element further comprising a porous medium loaded with gel; the gel comprising an active agent. In specific embodiments the tubular element further comprises a wrapper.

In specific embodiments the tubular element comprises a wrapper, wherein the wrapper comprises paper.

The present invention provides a tubular element, the tubular element comprising a wrapper that forms a first longitudinal passageway and further comprising a porous medium loaded with gel; the gel comprising an active agent; the tubular element further comprises a susceptor positioned longitudinally within the tubular element.

According to the present invention there is also provided a tubular element, the tubular element comprising a wrapper that forms a first longitudinal passageway and further comprising a porous medium loaded with gel; the gel comprising an active agent.

In some embodiments the wrapper that forms the first longitudinal passageway comprises paper.

In specific embodiments the porous medium loaded with gel completely fills the tubular element within the wrapper. Alternatively, in other specific embodiments the porous medium only partially fills the tubular element.

In specific embodiments the tubular element further comprises a second tubular element, the second tubular element having a longitudinal side, and proximal and distal ends, the second tubular element positioned longitudinally within the first longitudinal passageway formed by the wrapper.

In specific embodiments the longitudinal side of the second tubular element comprises paper, or cardboard, or cellulose acetate.

In specific embodiments the second tubular element comprises porous medium loaded with gel. However, in alternative specific embodiments the second tubular element comprises gel.

In some specific embodiments, where there is a first and second tubular elements as described and a wrapper, the porous medium loaded with gel is positioned between the second tubular element and the wrapper that forms the first longitudinal channel.

In some alternative embodiments, where there is a first and second tubular elements, gel is positioned between the second tubular element and the wrapper that forms the at least one longitudinal channel.

In combination with other features in specific embodiments the tubular element comprises a longitudinal element positioned longitudinally within the first longitudinal channel.

In combination with other features in specific embodiments the wrapper is stiff. Alternatively, or additionally, in specific embodiments the longitudinal side of the second tubular element is stiff.

In combination with other features in specific embodiments the wrapper is water-resistant.

In combination with other features in specific embodiments the tubular element further comprises a susceptor.

In specific embodiments the porous medium loaded with gel, is crimped. The porous medium may be crimped before being loaded with gel, or after.

In specific embodiments the porous medium loaded with gel, is shredded. The porous medium may be shredded before being loaded with gel or after.

According to the present invention there is provided a method of manufacturing a tubular element as claimed in any preceding claim, the method comprises the steps of:

- dispensing a porous medium loaded with gel onto a web of wrapping material, and dispensing a second tubular element onto the porous medium loaded with gel on the web of wrapping material;
- wrapping the web of wrapping material around the porous medium loaded with gel and second tubular element to form a composite structure of porous medium loaded with gel and the second tubular element.

In specific embodiments the method of manufacturing a tubular element further comprises the step of: cutting the wrapped composite structure of porous medium loaded with gel and the second tubular element, into lengths.

According to the present invention there is provided a tubular element where the tubular element comprises a first longitudinal passageway and further comprises a thread loaded with gel, wherein the gel comprises an active agent.

In specific embodiments there is a single thread loaded with gel. However, in alternative embodiments there are a plurality of threads loaded with gel. Each thread loaded with gel may have the same gel or different gels.

In specific embodiments, in combination with other features, the tubular element comprises threads loaded with gel, preferably loaded with the same gel. Alternatively, in other specific embodiments the tubular element comprises different gels. In specific embodiments the tubular element comprises threads loaded with gel, wherein two different threads loaded with gel, are loaded with different gel. In specific embodiments the tubular element comprises more than one gel.

In combination with other features the tubular element comprises a wrapper.

In combination with other features, in specific embodiments the tubular element comprises a susceptor adjacent to at least one thread loaded with gel. The susceptor may be thin and elongated. Preferably the susceptor is positioned longitudinally within the tubular element. Preferably the susceptor is surrounded by thread loaded with gel. In alternative embodiments the susceptor is positioned between the inner surface of a wrapper and the thread loaded with gel. In specific embodiments the wrapper comprises the susceptor. Alternatively, or in addition, the susceptor may be in the form of a powder, for example, a metal powder. The powder may be in the gel, or the wrapper, or spaced between the gel and the wrapper, or combinations thereof.

In combination with other features, in specific embodiments the tubular element further comprises a second tubular element.

In accordance with the present invention there is provided a method of manufacturing a tubular element as claimed in any preceding claim, the method comprises the steps of:

dispensing a porous medium loaded with gel onto a web of wrapping material; and, wrapping the web of wrapping material around the porous medium loaded with gel to form a wrapped, rod shaped, structure of porous medium loaded with gel:

In specific embodiments the method of manufacture of the tubular element further comprises the step of: cutting the wrapped, rod shaped structure of porous medium loaded with gel, into lengths.

According to the present invention there is provided a method of manufacturing a tubular element, the tubular element comprising:

a first longitudinal passageway and the tubular element further comprises a thread loaded with gel; the gel comprises an active agent;

the method comprises the steps of:

placing a material for a tubular element around a mandrel to form a tubular element;

dispensing the thread loaded with the gel from a conduit within the mandrel, such that the thread loaded with gel is within the tubular element.

The tubular element may be cut into lengths. In specific embodiments the method of manufacturing a tubular element further comprises the step of: cutting the tubular element into lengths. The desired lengths may vary according to needs.

In specific embodiments the method of manufacturing of a tubular element further comprise the step of extruding the material for a tubular element around the mandrel to form a tubular element.

In specific embodiments the method of manufacturing of a tubular element further comprise the step of wrapping the tubular element, with a wrapper.

According to the present invention there is provided a method of manufacturing a tubular element, the tubular element comprising:

a wrapper forming a first longitudinal channel and further comprises a thread loaded with gel; the gel comprises an active agent; and wherein, the method comprises the steps of:

dispensing the thread loaded with gel onto a web of wrapping material;

wrapping the web of wrapping material around the thread loaded with gel to form a wrapped composite structure of thread loaded with gel.

In specific embodiments the method of manufacture of a tubular element further comprises the step of: cutting the wrapped composite structure of thread loaded with gel, into lengths.

According to the present invention there is provided a method of manufacturing a tubular element, the tubular element comprising:

a wrapper;

a thread loaded with gel; the gel comprises an active agent; and a second tubular element;

the method comprises the steps of:

dispensing the thread loaded with gel onto a web of wrapping material, and dispensing a second tubular element onto the thread loaded with gel on the web of wrapping material;

wrapping the web of wrapping material around the thread loaded with gel, and the second tubular element to form a wrapped composite structure of thread loaded with gel and the second tubular element.

In specific embodiments the method of manufacturing a tubular element further comprises cutting the wrapped composite structure of thread loaded with gel and the second tubular element, into lengths.

According to the present invention there is provided a method of manufacturing a tubular element, the tubular element comprising:

a thread; and a wrapper; and further comprising gel, wherein the gel comprises an active agent;

the method comprising the steps of:

dispensing thread on a web of wrapping material;

dispensing gel onto the thread on the web of wrapping material such that the gel impregnates, or coats, the thread and the thread is loaded with gel;

wrapping the wrapping material around the thread loaded with gel to form a composite structure of thread loaded with gel.

In specific embodiments the method of manufacturing a tubular element further comprises the step of: dividing the composite structure of thread loaded with gel, into lengths.

According to the present invention there is provided a method of manufacturing a tubular element for use in an aerosol generating article, the tubular element comprising:

a wrapper;

a second tubular element extending along the length of the tubular element;

threads loaded with gel located between the second tubular element and extending along the hollow tubular element, wherein an additive is dispersed in the gel; and a wrapper wrapped around the gel-loaded threads and the hollow tubular element, the method comprising:

extruding material for a hollow tubular element through a forming die and around a mandrel that forms a hollow core in the hollow tubular element;

extruding gel-loaded threads from a conduit in the forming die and around the hollow-tubular element to form a composite core;

laying the composite core along a web of wrapping material;

wrapping the wrapping material around the composite core to form a wrapped composite structure.

In specific embodiments the method of manufacture a tubular element further comprises the step of: dividing the composite structure into lengths.

In specific embodiments the method of manufacturing the tubular element further comprising the step of dispensing a plurality of threads.

According to the present invention there is provided a tubular element, the tubular element comprising a wrapper that forms a first longitudinal passageway; the tubular element further comprising a gel; the gel comprising an active agent.

In specific embodiments the gel completely fills the tubular element within the wrapper.

Alternatively, in specific embodiments the gel may partially fill the tubular element. For example, in specific embodiments the gel is provided as a coating on an inner surface of the tubular element. The advantage of only partially filling the tubular element is that it leaves a fluid path, for example, for aerosol to flow into or out of the tubular element.

In combination with specific embodiments the tubular element comprises a second tubular element.

In combination with specific embodiments the tubular element comprises a second tubular element comprising a longitudinal side, and proximal and distal ends; and the second tubular element is positioned longitudinally within the first longitudinal passageway.

In combination with specific embodiments the tubular element comprises a plurality of second tubular elements.

In specific embodiments the tubular element comprises a plurality of second tubular elements arranged in parallel so as to extend along the longitudinal length of the tubular element. Optionally gel is provided within all, some, or none, of the plurality of second tubular elements. Again, depending on the specific embodiment, where there is gel in a second tubular element, the gel completely fills each of the plurality of second tubular elements, or the gel partially fills the second tubular elements.

In specific embodiments the tubular element comprises a porous medium loaded with gel.

In combination with other features, in specific embodiments, one or more of the second tubular elements comprises porous medium loaded with gel. Where there is porous medium loaded with gel, the porous medium loaded with gel completely fills each of the plurality of second tubular elements, or the porous medium loaded with gel partially fills the second tubular elements.

In specific embodiments the porous medium loaded with gel is located between the second tubular element and the wrapper.

In specific embodiments the longitudinal side of the second tubular element comprises paper, or cardboard, or cellulose acetate.

In specific embodiments the second tubular element comprises gel. Preferably the gel is at least partially enclosed by the longitudinal sides of the second tubular element.

In specific embodiments gel may be located between the second tubular element and the wrapper that forms the first longitudinal passageway.

In combination with specific embodiments the tubular element has an external diameter that is approximately equal to the external diameter of the aerosol generating article.

In specific embodiments the tubular element has an external diameter of between 5 millimetres and 12 millimetres, for example of between 5 millimetres and 10 millimetres or between 6 millimetres and 8 millimetres. Typically, the tubular element has an external diameter of 7.2 millimetres plus or minus 10 percent.

Typically, the tubular element has a length between 5 millimetres and 15 millimetres. Preferably, the tubular element has a length between 6 millimetres and 12 millimetres, preferably, the tubular element has a length between 7 millimetres and 10 millimetres, preferably the tubular element has a length of 8 millimetres.

In combination with specific embodiments, the gel is a mixture of materials capable of releasing volatile compounds into an aerosol passing through the tubular element, preferably when the gel is heating. The provision of a gel may be advantageous for storage and transport, or during use, as the risk of leakage from the tubular element, aerosol generating article or aerosol generating device, may be reduced.

Advantageously the gel is solid at room temperature. "Solid" in this context means that the gel has a stable size and shape and does not flow. Room temperature in this context means 25 degrees Celsius.

The gel may comprise an aerosol-former. Ideally the aerosol-former is substantially resistant to thermal degradation at the operating temperature of the tubular element. Suitable aerosol-formers are well known in the art and include, but are not limited to: polyhydric alcohols, such as triethylene glycol, 1, 3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1, 3-butanediol and, glycerine or polyethylene glycol.

Advantageously, the gel, for example, comprises a thermoreversible gel. This means that the gel will become fluid when heated to a melting temperature and will set into a gel again at a gelation temperature. The gelation temperature may be at or above room temperature and atmospheric pressure. Atmospheric pressure means a pressure of 1 atmosphere. The melting temperature may be higher than the gelation temperature. The melting temperature of the gel may be above 50 degrees Celsius, or 60 degrees Celsius or 70 degrees Celsius and may be above 80 degrees Celsius. The melting temperature in this context means the temperature at which the gel is no longer solid and begins to flow.

Alternatively, in specific embodiments, the gel is a non-melting gel that does not melt during use of the tubular element. In these embodiments, the gel may release the active agent at least partially at a temperature that is at or above the operation temperature of the tubular element in use, but below the melting temperature of the gel.

Preferably, the gel has a viscosity of 50,000 to 10 Pascal per second, preferably 10,000 to 1,000 Pascal per second to give the desired viscosity.

In combination with specific embodiments the gel comprises a gelling agent. In specific embodiments the gel comprises agar or agarose or sodium alginate or Gellan gum, or a mixture thereof.

In specific embodiments the gel comprises water, for example, the gel is a a hydrogel. Alternatively, in specific embodiments the gel is non-aqueous.

Preferably the gel comprises an active agent. In combination with specific embodiments the active agent comprises nicotine (for example, in a powdered form or in a liquid form) or a tobacco product or another target compound for, for example, release in an aerosol. In specific embodiments the nicotine is included in the gel with an aerosol-former. Locking the nicotine into a gel at room temperature is desirable to prevent leakage.

In specific embodiments the gel comprises a solid tobacco material that releases flavour compounds when heated. Depending on the specific embodiments the solid tobacco material is, for example, one or more of: powder, granules, pellets, shreds, spaghettis, strips or sheets containing one or more of: plant material, such as herb leaf, tobacco leaf, fragments of tobacco ribs, reconstituted tobacco, homogenised tobacco, extruded tobacco and expanded tobacco.

There are embodiments where, additionally or alternatively, for example, the gel comprises other flavours, for example menthol. Menthol can be added either in water or in the aerosol former prior to the formation of the gel.

Preferably the gel includes a gelling agent. The gelling agent may form a solid medium in which the aerosol-former may be dispersed.

The gel may include any suitable gelling agent. For example, the gelling agent may include one or more biopolymers, such as two or three biopolymers. Preferably, where the gel includes more than one biopolymer, the biopolymers are present in substantially equal weights. The biopolymers may be formed of polysaccharides. Biopolymers suitable as gelling agents include, for example, gellan gums (native, low acyl gellan gum, high acyl gellan gums with low acyl gellan gum being preferred), xanthan gum, alginates (alginic acid), agar, guar gum, and the like. Preferably, the gel comprises agar.

The gel may include any suitable amount of gelling agent. For example, the gel comprises the gelling agent in a range from about 0.5 percent by weight to about 7 percent by weight of the gel. Preferably, the gel comprises the gelling agent in a range from about 1 percent by weight to about 5 percent by weight, such as from about 1.5 percent by weight to about 2.5 percent by weight.

In some preferred embodiments, the gel comprises agar in a range from about 0.5 percent by weight to about 7 percent by weight, or in a range from about 1 percent by weight to about 5 percent by weight, or about 2 percent by weight.

In some preferred embodiments, the gel comprises xanthan gum in a range from about 2 percent by weight to about 5 percent by weight, or in a range from about 2 percent by weight to about 4 percent by weight, or about 3 percent by weight.

In some preferred embodiments, the gel comprises xanthan gum, gellan gum, and agar. The gel may include xanthan gum, low acyl gellan gum, and agar. The gel may include xanthan gum, gellan gum, and agar in substantially equal weights. The gel may include xanthan gum, low acyl gellan gum, and agar in substantially equal weights. The gel may include xanthan gum, low acyl gellan gum, and agar in a range from about 1 percent by weight to about 5 percent by weight (for the total weight of xanthan gum, low acyl gellan gum, and agar in the gel), or in a range from about 1 percent by weight to about 4 percent by weight, or about 2 percent by weight. The gel may include xanthan gum, low acyl gellan gum, and agar in a range from about 1 percent by weight to about 5 percent by weight, or about 2 percent by weight, where xanthan gum, gellan gum, and agar are substantially equal weights.

The gel may comprise a divalent cation. Preferably the divalent cation includes calcium ions, such as calcium lactate in solution. Divalent cations (such as calcium ions) may assist in the gel formation of compositions that include biopolymers (polysaccharides) such as, gellan gums (native, low acyl gellan gum, high acyl gellan gums), xanthan gum, alginates (alginic acid), agar, guar gum, and the like. The ion effect may assist in the gel formation. The divalent cation may be present in the gel composition in a range from about 0.1 to about 1 percent by weight, or about 0.5 percent wt. In some embodiments, the gel does not include a divalent cation.

The gel may comprise a carboxylic acid. The carboxylic acid may include a ketone group. Preferably, the carboxylic acid includes a ketone group that has less than 10 carbon atoms. Preferably, this carboxylic acid has five carbon atoms (such as levulinic acid). Levulinic acid may be added to the neutralize the pH of the gel. This may also assist in the gel formation that includes biopolymers (polysaccharides) such as, gellan gums (low acyl gellan gum, high acyl gellan gums), xanthan gum, especially alginates (alginic acid), agar, guar gum, and the like. Levulinic may also enhance a sensory profile of the gel formulation. In some embodiments, the gel does not include a carboxylic acid.

In embodiments where agar is used as the gelling agent, the gel, for example, comprises between 0.5 and 5 percent by weight, preferably between 0.8 and 1 percent by weight, agar. Preferably the gel further comprises between 0.1 and 2 percent by weight nicotine. Preferably, the gel further comprises between 30 percent and 90 percent by weight (or between 70 and 90 percent by weight) glycerine. In specific embodiments a remainder of the gel comprises water and flavourings.

Preferably the gelling agent is agar, which has the property of melting at temperatures above 85 degrees Celsius and turning back to gel at around 40 degrees Celsius. This property makes it suitable for hot environments. The gel will not melt at 50 degrees Celsius, which is useful if the system is left in a hot automobile in the sun, for example. A phase transition to liquid at around 85 degrees Celsius means that the gel only needs to be heated to a relatively low-temperature to induce aerosolization, allowing low energy consumption. It may be beneficial to use only agarose, which is one of the components of agar, instead of agar.

When Gellan gum is used as the gelling agent, typically the gel comprises between 0.5 and 5 percent by weight Gellan gum. Preferably the gel further comprises between 0.1 and 2 percent by weight nicotine. Preferably, the gel comprises between 30 percent and 99.4 percent by weight gylcerin. In specific embodiments a remainder of the gel comprises water and flavourings.

In one example, the gel comprises 2 percent by weight nicotine, 70 percent by weight glycerol, 27 percent by weight water and 1 percent by weight agar.

In another example, the gel comprises 65 percent by weight glycerol, 20 percent by weight water, 14.3 percent by weight tobacco and 0.7 percent by weight agar Additionally, or alternatively, in some specific embodiments, the tubular element comprises, a porous medium loaded with gel. Preferably the porous medium loaded with gel is located between the second tubular element and the wrapper that forms the first longitudinal passageway. Alternatively, in some specific embodiments the second tubular element comprises porous medium loaded with gel. These embodiments do not necessarily exclude the gel, or the porous medium loaded with gel being located, additionally or alternatively, elsewhere. In specific embodiments the tubular element comprises gel and porous medium loaded with gel.

In combination with specific embodiments the tubular element comprises a longitudinal element positioned longitudinally within the first longitudinal passageway. In specific embodiments the longitudinal element positioned longitudinally within the first longitudinal passageway is a porous medium loaded with gel. In other specific embodiments, the longitudinal element may be a longitudinal element of any material, able to, for example to take up space within the tubular element, or assist or aid passage of heat or material, or even to aid stiffness or rigidity of the structure.

In some embodiments the wrapper is stiff, or rigid, to aid structure of the tubular element. It is foreseen that the gel used in the present invention is semi-solid, able to retain a shape, especially in use. However, the present invention is not limited to solid gels. More fluid gels, gels with a higher viscosity than those of solid gels, can also be used with embodiments of the present invention. Having a wrapper that itself, is able to retain the tubular element structure is therefore beneficial, although not necessary. Likewise, the longitudinal side of second tubular element may be rigid, or stiff. Having the wrapper or longitudinal side of the second tubular element, or both, the wrapper and longitudinal side of the second tubular element stiff or indeed rigid, may aid structure of the tubular element, but may also aid manufacture. Preferably, the wrapper has a thickness of between about 50 and 150 micrometers.

In combination with other features, in specific embodiments the wrapper is water-resistant. In specific embodiments the longitudinal side of the second tubular element is water-resistant. This water-resistant property, of either the wrapper or longitudinal side of the second tubular element, may be achieved by using a water-resistant material, or by treating the material of the wrapper or longitudinal side of the second tubular element. It may be achieved by treating one side or both sides of the wrapper or longitudinal side of the second tubular element. Being water-resistant would assist in not losing structure, stiffness or rigidity. It may also assist in preventing leaks of gel or liquid, especially when gels of a fluid structure are used.

In combination with specific embodiments the tubular element comprises a susceptor. A susceptor may be any heat transferring material, for example it may be a metal thread, for example an aluminium thread, or a thread comprising aluminium or metal powder, such as for example aluminium powder. Typically, the susceptor is positioned longitudinally within the tubular element. The susceptor may be located within, or adjacent, or near, the gel; or in, or adjacent, or near the porous medium loaded with gel.

In combination with specific embodiments the tubular element further comprises a thread. This may be of any material, natural or synthetic, but preferably cotton. The thread may be a vehicle to carry an active ingredient, for example flavor. An example of a suitable flavor for use in the present invention may be menthol. The thread may run longitudinally within the tubular element. Preferably the thread may be located within, or adjacent, or near the gel; or within, or adjacent, or near, the porous medium loaded with gel.

In combination with specific embodiments the tubular element further comprises a sheet material. In combination with specific embodiments the porous medium loaded with gel comprises a sheet material. By providing the porous material loaded with gel as a sheet material may have advantages in manufacturing, for example the sheet material may be easy to gather together to give a suitable structure. The gel may be loaded into the sheet material before gathering together or loaded into the sheet material after gathering together.

According to the present invention there is provided a tubular element, the tubular element comprising a wrapper that forms a first longitudinal channel, the tubular element further comprising a porous medium loaded with gel, the porous medium loaded with gel further comprising an active agent.

In specific embodiments the porous medium loaded with gel completely fills the tubular element within the wrapper. Alternatively, in other specific embodiments the porous medium only partially fills the tubular element.

In specific embodiments the tubular element further comprises a second tubular element, the second tubular element having a longitudinal side, and proximal and distal ends, the second tubular element positioned longitudinally within the first longitudinal channel formed by the wrapper.

In specific embodiments the longitudinal side of the second tubular element comprises paper, or cardboard, or cellulose acetate.

In specific embodiments the second tubular element comprises porous medium loaded with gel.

In some specific embodiments, where there is a first and second tubular element as described, the porous medium loaded with gel is positioned between the second tubular element and the wrapper that forms the first longitudinal channel.

In some alternative embodiments, where there is a first and second tubular element, gel is positioned between the second tubular element and the wrapper that forms the first longitudinal channel.

According to the present invention there is provided a method of manufacturing a tubular element, the tubular element comprising:

at least one longitudinal passageway and further comprises gel; the gel comprises an active agent;

the method comprises the steps of:

- placing a material for a tubular element around a mandrel that forms a tubular element;
- extruding the gel from a conduit within the mandrel, such that the gel is within the tubular element.

The method of manufacture of a tubular element may further comprise the step of extruding the material for a tubular element around the mandrel to form a tubular element.

The method of manufacturing of a tubular element may further comprise the step of wrapping the tubular element, with a wrapper.

According to the present invention there is provided a method of manufacturing a tubular element, the tubular element comprising:

- a wrapper forming a first longitudinal channel and further comprises a porous medium loaded with gel; the porous medium loaded with gel, further comprises an active agent; and wherein, the method comprises the steps of;

- dispensing the porous medium loaded with gel onto a web of wrapping material;
- wrapping the wrapping material around the porous medium loaded with gel.

In specific embodiments the method of manufacturing the tubular element further comprises the step of: cutting the wrapped tubular element, into lengths.

According to the present invention there is provided a method of manufacturing a tubular element, the tubular element comprising:

- a wrapper forming a first longitudinal channel and further comprises a porous medium loaded with gel; the porous medium loaded with gel, further comprises an active agent; and
- a second tubular element;

the method comprises the steps of:

- dispensing the porous medium loaded with gel onto a web of wrapping material; and,
- dispensing a second tubular element onto the porous medium loaded with gel on the web of wrapping material;
- wrapping the wrapping material around the porous medium loaded with gel, and second tubular element.

In specific embodiments the method of manufacturing a tubular element further comprises the step of: cutting the wrapped tubular element, into lengths.

It is foreseen that the tubular element of the present invention is used in an aerosol generating article. It is also foreseen that the aerosol generating article may be used in a device, for example an aerosol generating device. The aerosol generating device may be used to hold and heat the aerosol generating article to release material. In particular, this may be to release material from the tubular element of the present invention.

According to the present invention there is provided an aerosol generating article for generating an aerosol, the aerosol generating article comprising:

a fluid guide to allow movement of fluid; the fluid guide having a proximal end and a distal end, the fluid guide having an inner longitudinal region and an outer longitudinal region separated by a barrier; where the inner longitudinal region comprises an inner longitudinal passageway between the distal end and the proximal end, and the outer region comprises a longitudinal passageway which communicates external fluid through at least one aperture to the distal end of the fluid guide, such that external fluid can travel along the outer longitudinal passageway, to the distal end of the fluid guide;

a tubular element, that comprises gel; the gel comprises an active agent; the tubular element having a proximal end and a distal end, and, is located on the distal side of the fluid guide.

In specific embodiments the barrier separating the inner longitudinal passageway and the outer longitudinal passageway may be an impermeable barrier, for example, impermeable to fluids.

According to the present invention there is provided an aerosol generating article, the aerosol generating article comprising:

a fluid guide to allow movement of fluid; the fluid guide having a proximal end and a distal end, the fluid guide having an inner longitudinal region and an outer longitudinal region separated by a barrier; where the inner longitudinal region comprises an inner longitudinal passageway between the distal end and the proximal end; and the outer region comprises an outer longitudinal passageway which communicates external fluid through at least one aperture to the distal end of the fluid guide, such that external fluid can travel along the outer longitudinal passageway to the distal end of the fluid guide;

a tubular element that comprises a porous medium loaded with gel, further comprising an active agent; the tubular element having a proximal end and a distal end and is located distally to the fluid guide.

Preferably, the distal end of the tubular element in some embodiments comprises at least one aperture. An aperture at the distal end of the tubular element may allow fluid, for example, air from external of the aerosol generating article to enter into the tubular element and travel though the tubular element creating an aerosol. The fluid travelling through the tubular element may pick up the active agent, or any other materials, in the gel and pass these out of the gel in the downstream (proximal) direction.

In specific embodiments the aerosol generating article may comprise a cavity positioned between the distal end of the fluid guide and the proximal end of the tubular element. Thus, the cavity may be at the upstream end of the inner longitudinal passageway and the downstream end of the tubular element. The cavity allows fluid, for example ambient air, to travel via the outer longitudinal passage way to the cavity and make contact with the gel in the tubular element. The fluid making contact with the tubular element may pass into and through the tubular element, before returning to the inner longitudinal passageway and to the proximal end of the fluid guide and proximal end of the aerosol generating article. When this fluid, for example ambient air, makes contact with the gel, the fluid may pick up the active agent or any other material in the gel, or tubular element, and pass this along the inner longitudinal passageway downstream to the proximal end of the aerosol generating article. To be in contact with the gel, the ambient air may pass through the tubular element or pass through the gel or pass a surface of the gel, or combinations thereof.

In specific embodiments the at least one aperture is located in an outer passageway of the fluid guide.

Having the at least one externally communicating aperture located in an outer passage way of the fluid guide allows distance between the tubular element and the at least one externally communicating aperture. This may help prevent leaking of the gel and its contents, but also give a desired aerosol draw.

In specific embodiments the at least one aperture is located in the cavity between the fluid guide and the tubular element.

Having the at least one aperture located in an outer passageway of the fluid guide allows the ambient fluid to easily reach the tubular element and easily mix in the cavity between the tubular element and the fluid guide.

In specific embodiments the at least one aperture is located in the side wall of the tubular element.

Having the at least one aperture located in the side wall of the tubular element allows ambient fluid to substantially travel in one direction when a negative pressure is applied to the proximal end of the aerosol generating article. Having the at least one aperture located in the side wall of the tubular element allows ambient fluid to easily mix with the contents of the tubular element.

In specific embodiments the aerosol generating article comprises a wrapper. The wrapper may be of any suitable material for example, the wrapper may comprise paper. Preferably the wrapper will have corresponding apertures to the apertures of the fluid guide. The corresponding apertures of the fluid guide and the wrapper may result from the apertures being formed after the wrapping of the article.

In specific embodiments, the outer longitudinal passageway of the aerosol generating article comprises one aperture or a plurality of apertures. The aperture may be any aperture, slit, hole, or passageway to allow fluid, for example ambient air, to pass through, and into the aerosol generating article. This allows fluid from external of the aerosol generating article to be drawn in. In use this may be external fluid, for example air that is drawn into the aerosol generating article through the apertures into the outer longitudinal passageways first, before being drawn to other parts of the aerosol generating article. In specific embodiments the apertures are evenly spaced around the circumference of the aerosol generating article, for example there are 10 or 12 apertures. Having the apertures evenly spaced helps give a smooth flow of fluid.

In combination with specific embodiments the aerosol generating article comprises an end plug located on the distal end of the tubular element and wherein the end plug has a High Resistance to Draw. The end plug may be impermeable to fluid, or, may be nearly impermeable to fluid. Preferably the end plug is located at the extreme distal end of the aerosol generating article. By the end plug having a high resistance to draw this advantageously will bias fluid to enter through the aperture of the outer longitudinal passageways when a negative pressure is applied at the proximal end of the aerosol generating article. In some embodiments the end plug is fluid impermeable.

In some embodiments the tubular element comprises an end plug. Advantageously this allows ease of manufacture.

The end plug of a tubular element would preferably be positioned at one end of the tubular element. Advantageously this allows ease of manufacture. In some embodiments the tubular element comprises an end plug wherein the end plug is fluid impermeable. When the tubular element comprises an end plug that is fluid impermeable this prevents gel and other fluids escaping from the tubular element through the end plug of the tubular element.

In specific embodiments the inner longitudinal passageway of the inner region of the fluid guide, comprises a restrictor. In some embodiments the restrictor is located at, or near to, the proximal end of the fluid guide. In some embodiments the restrictor is located at, or near to, the downstream end of the fluid guide. The restrictor, if present, may however be positioned in the middle region of the inner longitudinal passageway of the fluid guide, or the outer longitudinal passageway. The restrictor could also be positioned, near to, or at the distal end of the inner longitudinal passageway. The restrictor may be positioned at, or near to, the upstream end of the inner longitudinal passageway. More than one restrictor may be used in the inner longitudinal passageway, or in the outer longitudinal passageway, of the fluid guide.

Restrictors for use with some specific embodiments of the present invention comprise an abrupt narrowing; like an aperture in a surface such as a wall, or a gradual restriction.

Alternatively, in other specific embodiments the restrictors comprise a gradual or smooth restriction, for example sloping walls, or a funnel shape narrowing to the opening, or a gradual step restriction across the width of the passageway. There may be a gradual or abrupt widening on the downstream (proximal) side of the restrictor. Specific embodiments comprise the funnel shape on one or both sides of the restrictor. Thus, in the flow of fluid from upstream to downstream (distal to proximal), there may be a gradual flow restriction as the sides of the passage narrow to the opening of the restrictor, then a gradual widening of the passageway from the opening of the restrictor. Typically, the opening of a restrictor will have 60 or 45 or 30 percent restriction from the largest cross-sectional area of the passageway. In the present invention the restrictor thus may, in some embodiments for example, comprise a narrowing with an opening that is only 60 or 45 or 30 percent in cross-section area, to that of the cross-sectional area of the largest or widest portion of the inner longitudinal passageway. Typically, specific embodiments of the present invention reduce from, for example, 4 millimetres to 2.5 millimetres or 4 millimetres to 2.5 millimetres in cross-section diameter of cylindrical passageways. By varying the different width reduction ratios and width amounts; positioning of the restrictors; number of restrictors; and gradient of reduction and gradient of widening, a particular fluid flow characteristic can be achieved.

In combination with specific embodiments the aerosol generating article comprise a heating element like a susceptor, such that heat may be transferred to the gel in the tubular element. Like the susceptor of the tubular element this may be of any suitable material, preferably a metal like for example, aluminium, or comprising aluminium.

According to the present invention there is provided a method of manufacture of an aerosol generating article, the aerosol generating article comprising:

a fluid guide to allow transfer of fluid; the fluid guide having a proximal end and a distal end, the fluid guide having an inner longitudinal region and an outer longitudinal region separated by a barrier; where the inner longitudinal region comprises an inner longitudinal passageway between the distal end and the proximal end, and the outer region comprises an outer longitudinal passageway which communicates fluid through at least one aperture to the distal end of the fluid guide, such that fluid can travel along the outer longitudinal passageway of the outer fluid control region to the distal end of the fluid guide;

a tubular element, that comprises gel; the gel comprises an active agent; the tubular element having a proximal end and a distal end; and, the method comprising the steps of:

linearly arranging the tubular element, comprising gel and the fluid guide on a web of wrapping material; and wrapping the tubular element and fluid guide, and positioning the wrapper securely around the tubular element and fluid guide According to the present invention there is provided an aerosol generating device comprising a receptacle configure to receive the distal end of the aerosol generating article as described herewith.

The receptacle of the device may correspond in shape and size to allow a snug fit of the distal end, or a portion of the distal end, of the aerosol generating article into the receptacle, and hold the aerosol generating article in the receptacle during normal use.

Typically, the receptacle comprises a heating element. This would enable heating of the aerosol generating article; heating of the tubular element; or heating of the gel preferably comprising an active agent; or heating of the porous medium loaded with gel; or any combination of; directly or indirectly, to assist in generating or releasing an aerosol, or releasing material into an aerosol. The aerosol may then pass to the proximal end of the aerosol generating article. In specific embodiments the heating is directly, or indirectly via the heat element or susceptor, or a combination of both.

The heating means may be any heating means known. Typically, the heating means may be by radiation or conduction or convection, or a combination thereof.

In combination with specific embodiments the tubular element further comprises a thread. In specific embodiments the thread is of natural materials, or synthetic materials, or the thread is a combination of natural and synthetic materials. The thread may comprise semi-synthetic material. The thread may be made of fibres, or comprise fibres, or partially comprise fibres. The thread may be made, for example, of cotton, cellulose acetate or paper. A composite thread may be used. The thread may aid manufacture of the tubular element comprising an active agent. The thread may aid introducing an active agent to the tubular element comprising an active agent. The thread may help stabilise the structure of the tubular element comprising an active agent.

In combination with specific embodiments the tubular element comprises a porous medium loaded with gel. A porous medium may be used within the tubular element to create space within the tubular element. The porous medium is able to hold or retain gel. This has the advantage of aiding transfer and storage of gel and the manufacture of a tubular element comprising gel. The gel, in a porous medium loaded with gel, may also comprise an active agent; it may also hold or carry an active agent or other materials.

The porous medium may be any suitable porous material able to hold or retain the gel. Ideally the porous medium can allow the gel to move within it. In specific embodiments the porous medium loaded with gel comprises natural materials, synthetic, or semi-synthetic, or a combination thereof. In specific embodiments the porous medium loaded with gel, comprises sheet material, foam, or fibres, for example loose fibres; or a combination thereof. In specific embodiments the porous medium loaded with gel, comprises a woven, non-woven, or extruded material, or combinations thereof. Preferably the porous medium loaded with gel, comprises, for example, cotton, paper, viscose, PLA, or cellulose acetate, of combinations thereof. Preferably the porous medium loaded with gel comprises a sheet material, for example, cotton or cellulose acetate. Advantages of a porous medium loaded with gel is that the gel is retained within the porous medium, and this may aid manufacturing, storage or transport of the gel. It may assist in keeping the desired shape of the gel, especially during manufacture, transport, or use. The porous medium used in the present invention may be crimped or shredded. In specific embodiments the porous medium comprises crimped porous medium. In alternative embodiments the porous medium comprises shredded porous medium. The crimping or shredding process can be before or after loading with gel.

Shredding gives a high surface area to volume ratio to the medium thus able to absorb gel easily.

In specific embodiments the sheet material is a composite material. Preferably the sheet material is porous. The sheet material may aid manufacture of the tubular element comprising a gel. The sheet material may aid introducing an active agent to the tubular element comprising a gel. The sheet material may help stabilise the structure of the tubular element comprising a gel. The sheet material may assist transport or storage of the gel. Using a sheet material enables, or aids, adding structure to the porous medium for example by crimping of the sheet material. Crimping of the sheet material has the benefit of improving the structure to allow passageways through the structure. The passageways though the crimped sheet material assist in loading up gel, retaining gel and also for fluid to pass through the crimped sheet material. Therefore there are advantages of using crimped sheet material as the porous medium.

The porous medium may be a thread. The thread may comprise for example cotton, paper or acetate tow. The thread may also be loaded with gel like any other porous medium. An advantage of using a thread as the porous medium is that it may aid ease of manufacturing. The thread may be preloaded with gel before being used in the manufacture of the tubular element or the thread may be loaded with gel in the assembly of the tubular element.

The thread may be loaded with gel by any known means. The thread may be simply coated with gel, or the thread may be impregnated with gel. In the manufacture, the threads may be impregnated with gel and stored ready for use to be included in the assembly of a tubular element. In other processes the thread undergoes the loading process in the manufacture of the tubular element loaded with gel. Like the porous medium loaded with gel, or gel alone, preferably the gel comprises an active agent. The active agent is as herein described.

In the manufacture of tubular elements the gel, or porous medium, or thread, may be dispensed simultaneously as other components are being dispensed or dispensed sequentially. Preferably the components are dispensed but the component can be gathered or rolled, or combined or positioned in any known manner, to be positioned in the desired place.

As used herein the term "active agent" is an agent that is capable of activity, for example it produces a chemical reaction or is able to alter the aerosol generated. An active agent may be more than one agent.

As used herein, the term "aerosol generating article" is used to describe an article able to generate, or release, an aerosol.

As used herein, the term "aerosol generating device" is a device to be used with an aerosol generating article to enable the generation, or release, of an aerosol.

As used herein, the term "aerosol-former" refers to any suitable known compound or mixture of compounds that, in use, facilitates the enhancement of the initial aerosol received, for example, into the tubular element, which may become a denser aerosol, a more stable aerosol, or both a denser aerosol and a more stable aerosol.

As used herein the term "aerosol generating substance" is used to describe a substance capable of generating or releasing an aerosol.

As used herein the term "aperture" is used to describe any aperture, slit, hole or opening.

As used herein, the term "cavity" is used to describe any void or space at least partially enclosed in a structure. For example, in the present invention, the cavity is the partially enclosed space (in some embodiments) between the fluid guide and the tubular element.

As used herein the term "chamber" is used to describe an at least partially enclosed space or cavity.

For purposes of the present disclosure, an inner longitudinal cross-sectional area that is "constricted" from a first location to a second location is used to indicate that the inner longitudinal cross-sectional area reduces in diameter from the first location to the second location. These are often called a "restrictor". Thus, as used herein, the term "restrictor" is used to describe a narrowing in a fluid passageway or a change of cross-sectional area in a fluid passageway.

As used herein, the term "crimped" denotes a material having a plurality of ridges or corrugations. It also includes the process of making a material crimped.

The expression "cross-sectional area" is used to describe the cross-sectional area as measured in a plane transverse to the longitudinal direction.

For purposes of the present disclosure, as used herein the term "diameter" or "width" is a maximum transverse dimension of the tubular element, aerosol generating article or aerosol generating device, a portion or a part of thereof, any of the tubular element, aerosol generating article or aerosol generating device. By way of example, the "diameter" is a diameter of an object having a circular transverse section or is the length of the diagonal width of an objection having a rectangular cross section.

As used herein, the term "essential oil" is used to describe an oil having the characteristic odour and flavour of the plant from which it is obtained.

As used herein the term "external fluid" is used to describe a fluid originating from outside the aerosol generating element, article or device, for example ambient air.

The term "flavourant" as used herein, is used to describe a composition that affects the organoleptic quality of the aerosol.

The term "fluid guide" as used herein, is used to describe an apparatus or component that can alter the fluid flow. Preferably this is guiding or directing the fluid flow path of a generated or released aerosol. The fluid guide is likely to cause mixing of the fluid. It can aid speeding up of the fluid as it travels though the fluid guide, when the passageway narrows in cross-sectional area, or it can aid slowing down of the fluid as it travels along the passageway when the cross-section of the passageway broadens.

As used herein, the term "gathered" is used to describe a sheet that is convoluted, folded, or otherwise compressed or constricted substantially transversely to the longitudinal axis of the aerosol generating article or tubular element.

As used herein, the term "gel" is used to describe a solid jelly-like semi-rigid material with a three dimensional network able to hold other materials and capable of releasing materials into an aerosol.

The term "herbaceous material" is used to denote material from an herbaceous plant. A "herbaceous plant" is an aromatic plant, where the leaves or other parts of the plant are used for medicinal, culinary or aromatic purposes and are capable of releasing flavour into the aerosol produced by an aerosol generating article.

The term "hydrophobic" as used herein, refers to a surface exhibiting water repelling properties. A hydrophobic property can be expressed by the water contact angle. The "water contact angle" is the angle, conventionally measured through the liquid, where a fluid interface meets a solid surface. It quantifies the wettability of a solid surface by a liquid via the Young equation.

As used herein the term "impermeable" is used to describe an item, for example a barrier, that fluid does not substantially or easily pass through.

As used herein, the term "induction heating" is used to describe heating an object by electromagnetic induction, where eddy currents (also know as Foucault currents) are generated within the object to be heated, and resistance leads to resistive heating of the object.

As used herein, the term "longitudinal passageway" is used to describe a passageway or opening that enables fluid, and the like, to flow along it. Typically, air, or generated aerosols carrying materials, for example solid particles, flow along the longitudinal passageway. Typically, the longitudinal passageway will be longer in longitudinal length then in width but not necessarily. The term "longitudinal passageway" also includes the plural of more than one longitudinal passageway.

The term "longitudinal" is used to describe the direction between the proximal and distal ends of the tubular element, aerosol generating article or aerosol generating device.

As used herein "longitudinal sides", for example of a second tubular element, is used to describe the longitudinal side or wall of the second tubular element. In some embodiments this is integral for example cellulose acetate that form the tubular element, or porous medium loaded with gel. In alternative embodiments the longitudinal side is a wrapper.

As used herein, the term "mandrel" is used to describe a shaft on which another material is forged or shaped.

As used herein, the term "mints" is used to refer to plants of the genus *Mentha*.

The term "mouthpiece" is used herein to describe the element, component or portion of the aerosol generating article through which the aerosol exits the aerosol generating article.

As used herein, the term "outer" with reference to the fluid guide, is used to describe a portion that is more towards the longitudinal circumference of the fluid guide than the middle of the cross-section portion of the fluid guide. Similarly the term, "inner" is used to describe (with reference to the fluid guide), a portion of the fluid guide that is more central of the cross-section portion, than near to the circumference of the fluid guide.

As used herein, the term "passageway" is used to describe a passage that can allow access between.

As used herein, the term "plasticizer" is used to describe a substance, typically a solvent, added to produce or promote plasticity or flexibility, and to reduce brittleness.

The term "porous medium" as used herein, is used to describe any medium capable of holding, retaining or supporting, gel. Typically, the porous medium will have passages within its structure that can be filled to retain or hold fluid or semi-solids for example to retain gel. Preferably the gel will also be able to pass, or transfer, along and through the passages within the porous medium. As used herein, the term "porous medium loaded with gel" is used to describe a porous medium that comprises gel. The porous medium loaded with gel, is able to hold, retain, or support some amount of gel.

As used herein the term "plug" is used to describe a component, segment or element, for use in an aerosol generating article. As used herein, the term "end plug" is used to describe the furthest most distal component or plug of the aerosol generating article, at the distal end of the aerosol generating article. Preferably this end plug will have a high Resistance to Draw (RTD).

The term "protogenic" refers to a group that is able to donate a hydrogen or a proton in a chemical reaction.

By the term "receptacle" of the aerosol generating device, this term is used to describe the chamber of the aerosol generating device able to receive a portion of the aerosol generating article. This is usually the distal end of the article but not necessarily.

As used herein, the term "Resistance to Draw" (RTD), is used to describe the resistance for fluid, for example gas, to be drawn through a material. As used herein, resistance to draw is expressed with the units of pressure "mm WG "or millimetres of water gauge" and is measured in accordance with ISO 6565:2002.

As used herein, the term "High Resistance to Draw" (RTD), is used to describe the resistance for fluid, for example gas, to be drawn through a material. As used herein, high resistance means greater than 200 "mm WG "or millimetres of water gauge" and is measured in accordance with ISO 6565:2002.

As used herein the term "sheet material" is used to describe a generally planar, laminar element in which its width and length are substantially greater than its thickness.

As used herein, the term "seal" is a join, or "to join", for example, by joining edges of the wrapper to each other or to the fluid guide. This may be by the use of an adhesive or glue. However, the term seal also includes an interference fit join. The seal need not create a fluid impermeable seal, or barrier.

As used herein, the term "shredded" is used to describe something that is finely cut.

As used herein, the term "stiff" is used to describe that an item is rigid enough, or stiff enough, to resist changing shape, or stiff enough to generally resist deforming shape under normal use. This includes that it may be resilient such that if deformed it can largely return to its original shape. Likewise, the term "rigid" as used herein, describes that the item is resistant to bending or being forced out of shape, generally able to maintain its shape, especially under normal use.

As used herein, the term "susceptor" is used to describe a heating element, any material able to absorb electromagnetic energy and convert it to heat. For example, in the present invention the susceptor or heat element may assist in transferring thermal energy to the gel, heating up the gel, to assist in releasing materials from the gel.

As used herein, the term 'textured sheet' denotes a sheet that has been crimped, embossed, debossed, perforated or otherwise deformed.

As used herein, the term "thread loaded with gel" is used to describe a thread of porous medium which holds, retains or supports gel, including for example coating or impregnated with gel.

Throughout this document the term "tubular element" is used to describe a component suitable for use in an aerosol generating article. Ideally the tubular element may be longer in longitudinal length then in width but not necessarily as it may be one part of a multi-component item that ideally will be longer in its longitudinal length then its width. Typically, the tubular element is cylindrical but not necessarily. For example, the tubular element may have an oval, polygonal like triangular or rectangular or random cross section. The tubular element need not be hollow.

The terms "upstream" and "downstream" are used to describe the relative positions in relation to the direction of mainstream fluid as it is drawn into the tubular element, aerosol generating article or aerosol generating device. In some embodiments, where the fluid enters from the distal end of the aerosol generating article and travels towards the proximal end of the article, the distal end of the aerosol generating article may also be described as the upstream end of the aerosol generating article and the proximal end of the aerosol-generating article may also be described as the downstream end of the aerosol-generating article. In these embodiments, elements of the aerosol-generating article located between the proximal end and the distal end can be described as being upstream of the proximal end, or, alternatively, downstream of the distal end. However, in other embodiments, of the invention, where the fluid enters the aerosol generating article from the side and first travels towards the distal end, turns and then travels towards the proximal end of the aerosol generating article, the distal end of the aerosol generating article may be either upstream or downstream, depending on the respective reference point.

As used herein, the term "water-resistant" is used to describe material, for example a wrapper, or longitudinal side of a second tubular element, that does not allow water to pass through it easily, or, is not easily damaged by water. The water-resistant material is able to resist water penetration.

In specific embodiments the tubular element comprises an active agent. In specific embodiments the gel comprises an active agent. In specific embodiments the active agent comprises nicotine. In specific embodiments the gel or tubular element comprising an active agent comprises between 0.2 percent by weight and 5 percent by weight of the active agent, such as between 1 percent by weight and 2 percent by weight of active agent.

Typically, in specific embodiments the tubular element will comprise at least 150 mg of gel.

In specific embodiments the active agent comprises a plasticizer.

In specific embodiments the gel, comprising an active agent comprises an aerosol former, such as glycerol. In embodiments where an aerosol former is present, typically for example, the gel comprising an active agent comprises between 60 percent and 95 percent by weight of glycerol, such as between 80 percent and 90 percent by weight of glycerol.

In specific embodiments the gel comprising an active agent comprises a gelling agent, such as for example alginate, gellan, guar, or combinations thereof. In embodiments comprising a gelling agent, the gel typically comprises between 0.5 percent and 10 percent by weight of gelling agent, such as between 1 percent and 3 percent by weight of gelling agent.

In specific embodiments the gel comprises water. In such embodiments, the gel typically comprises between 5 percent and 25 percent by weight of water, such as between 10 percent and 15 percent by weight of water.

In specific embodiments the active agent comprises flavour or a pharmaceutical substance, or combination thereof. In specific examples the active agent is nicotine in any form. The active agent is able to be active, for example able to produce a chemical reaction or at least alter the aerosol generated.

The active agent may be a flavour. In specific embodiments the active agent comprises a flavourant. The gel may include a flavourant. Alternatively, or in addition to, flavourants may be present at one or more other locations of the article. The flavourant may impart a flavour to contribute to the taste of the fluid or aerosol generated by the article. A flavourant is any natural or artificial compound that affects the organoleptic quality of the aerosol. Plants that can be used to provide flavourants, include but are not limited to, those belonging to the families, Lamiaceae (for example mints), Apiaceae (for example anise, fennel), Lauraceae (for example laurels, cinnamon, rosewood), Rutaceae (for example citrus fruits), Myrtaceae (for example anise, myrtle), and Fabaceae (for example liquorice). Non-limiting examples of sources of flavourants include mints such as peppermint and spearmint, coffee, tea, cinnamon, clove, ginger, cocoa, vanilla, eucalyptus, geranium, agave, and juniper; and combinations thereof.

Many flavourants are essential oils, or a mixture of one or more essential oils. Suitable essential oils include, but are not limited to, eugenol, peppermint oil and spearmint oil. In many embodiments the flavourant comprises menthol, eugenol, or a combination of menthol and eugenol. In many embodiments, the flavourant further comprises anethole, linalool, or a combination thereof. In specific embodiments flavourants comprise Herbaceous material. Herbaceous material includes herb leaf or other herbaceous material from herbaceous plants including, but not limited to, mints, such as peppermint and spearmint, lemon balm, basil, cinnamon, lemon basil, chive, coriander, lavender, sage, tea, thyme and caraway. Suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens variegata*. In some embodiments, a flavourant can include tobacco material.

In one specific example, in combination with other features, the gel comprises approximately; 2 percent by weight nicotine, 70 percent by weight glycerol, 27 percent by weight water and 1 percent by weight agar. In another example, the gel comprises 65 percent by weight glycerol, 20 percent by weight water, 14.3 percent by weight solid powdered tobacco and 0.7 percent by weight agar.

In the present invention the fluid guide may have two distinct regions, for example an outer region with an outer longitudinal passageway and an inner region with an inner longitudinal passageway. Therefore, the outer longitudinal passageway runs lengthwise near to the circumference of the fluid guide, and the inner fluid passageway runs lengthwise near to the core, or centre, of the cross-sectional along the lengthwise axis.

Preferably in specific embodiments ambient air enters through the apertures, in the wrapper and apertures in the fluid guide, to the outer longitudinal passageway (of the fluid guide) towards the distal end of the aerosol generating article and in the area of the tubular element comprising gel comprising active agent. Preferably the fluid will make contact with the gel comprising an active agent, to generate, or release an aerosol of mixed fluid comprising fluid from external of the aerosol generating article, and material released from the gel comprising an active agent, or agents. Fluid then travels along the inner longitudinal passageway, of the fluid guide, towards the proximal end of the aerosol generating article. It is foreseen that the outer and inner longitudinal passageways are separated by a barrier. The barrier may be impermeable to fluid or resistant to fluids passing through it, and thus is able to bias the fluid to the distal end. Preferably the outer longitudinal passageway of the fluid guide, comprises an aperture that fluidly communicates with an exterior of the fluid guide, and preferably an exterior of the article. It is also foreseen that the outer longitudinal passageway is blocked at its proximal end such that, in use, fluid received from an exterior of the aerosol generating article predominantly flows towards the distal end of the fluid guide. The outer longitudinal passageway, of the fluid guide, has apertures at or near the proximal end but then is only open at its distal end. In contrast the inner longitudinal passageway, of the fluid guide, is open at both its proximal end and its distal end, although it may have various flow restriction elements between its proximal and distal ends. The barrier separating the inner and outer longitudinal passageways, of the fluid guide, forces the fluid that enters the outer longitudinal passageway to travel to the distal end of the outer longitudinal passageway and towards the tubular element preferably comprising gel comprising an active agent. This, brings the fluid in contact with the tubular element preferably comprising gel comprising an active agent.

The outer longitudinal passageway, of the fluid guide, may be one passageway or more than one passageway. The outer longitudinal passageway may be within the fluid guide or may be one or more passageways on the outer surface of the fluid guide with the fluid guide forming a partial wall of the outer longitudinal passageway and the wrapper forming another partial wall to the outer longitudinal passageway. The outer or inner longitudinal passageways of the fluid guide may comprise porous material for example foam, in particular reticulated foam, such that the passageways traverse through the porous material. In specific embodiments the fluid guide comprises a porous material, for example foam. The porous material may allow passage of the fluid while still maintaining its shape. These materials are easy to shape and therefore may assist in manufacture of the aerosol generating article.

In some embodiments, the outer longitudinal passageway may extend substantially around the interior of a wrapper. In some embodiments, the passageway may extend less than fully around the interior of a wrapper.

Various aspects or embodiments of the aerosol generating article for use with an aerosol generating device described herein may provide one or more advantages relative to currently available or previously described aerosol generating articles. For example, the aerosol generating article, including the fluid guide and inner and outer fluid passageways of the fluid guide, allows for efficient transfer of aerosol generated from the tubular element comprising gel preferably comprising an active agent. Furthermore, the gel comprising an active agent is less likely to leak form the aerosol generating article than a liquid element comprising an active agent.

The aerosol generating article may include a mouth end (the proximal end); and a distal end. Preferably the distal end is received by an aerosol generating device having a heating element configured to heat the distal end of the aerosol generating article. The tubular element comprising gel preferably comprising an active agent, is preferably disposed in proximity to the distal end of the aerosol generating article. The aerosol generating device may therefore heat the tubular element comprising gel preferably comprising an active agent in the aerosol generating article to generate an aerosol comprising the active agent.

The aerosol generating article, or portions of the aerosol generating article, containing the tubular element, preferably comprising gel comprising an active agent, may be single-use aerosol generating articles or multi-use aerosol generating articles. In some specific embodiments, portions of the aerosol generating articles are re-usable, and portions are disposable after a single use. For example, the aerosol generating articles may include a mouthpiece that may be re-usable and a single use portion that contains the tubular element comprising the gel and active agent for example further comprising nicotine. In embodiments comprising both reusable portions and single use portions, the reusable portions may be removable from the single use portions.

In combination with specific embodiments the aerosol generating article comprises a wrapper. The aerosol generating article has an open end, the proximal end; and a distal end, which may be open or closed in different specific embodiments. The tubular element preferably comprising gel comprising an active agent, which optionally comprises nicotine, is preferably disposed in proximity to the distal end of the aerosol generating article. Applying a negative pressure on the open, proximal end causes material from the tubular element, preferably comprising gel comprising an active agent, to be released. The aerosol generating article defines at least one aperture between the proximal end and the distal end. The at least one aperture defines at least one fluid inlet, such that upon application of a negative pressure on the open, proximal end of the aerosol generating article, fluid, for example air, enters the aerosol generating article through the aperture. Preferably fluid, for example ambient air, drawn into the aerosol generating article through the aperture, flows along the outer longitudinal passageway of the fluid guide towards the tubular element preferably comprising gel comprising an active agent, in the proximity of the distal end of the aerosol generating article. The fluid then flows through the inner longitudinal passageway of the fluid guide from the distal end to the proximal end and out of the aerosol generating article at the open, proximal end.

By spacing the aperture from the distal end of the aerosol generating article, the aperture is separated from the tubular element comprising gel, reducing the likelihood of leakage of the gel through the aperture. Furthermore, by providing a passageway, for example the outer longitudinal passageway, for airflow from the aperture to the tubular element comprising gel, the fluid from the aperture may be directed towards the gel and the fluid guide may act as a further obstacle between the gel and the aperture. The advantage of this is to further reduce the likelihood of leakage of the tubular element through the aperture. In addition, the inner longitudinal passageway of the fluid guide provides a pathway for fluid, for example air, and material or vapour generated, or released from the tubular element, to be drawn out of the aerosol generating article through the open, proximal end. The pathway provided by the inner longitudinal passageway of the fluid guide may have an inner longitudinal flow cross-sectional area that is varied along the length of the inner longitudinal passageway to alter the flow of aerosol generated, or released, from the tubular element, from the distal end of the aerosol generating article to the open, proximal end of the aerosol generating article.

In combination with specific embodiments the aerosol generating article comprises a fluid guide. The aerosol generating article and the fluid guide, or portions thereof, may be formed as a single part or separate parts. An advantage of the fluid guide and aerosol generating article being integrally formed as one single part, is the ease of manufacturing just one part rather than multiple parts and then subsequently assembling these multiple parts within the aerosol generating article. However, if the aerosol generating article is a multi-component structure requiring multiple components to be assembled together then this has an advantage that different components can be more easily changed without having to change the entire manufacturing process. Likewise, the fluid guide may be formed as a single part or separate parts for the same reasons—ease of manufacturing if integrally manufactured as one piece, but able to adapt more easily if assemble components of the fluid guide. The fluid guide is disposed in the aerosol generating article and has a proximal end, a distal end, and an inner longitudinal passageway between the distal end and the proximal end.

The inner longitudinal passageway of the fluid guide has an inner cross-sectional area.

The provision of openings or passageways that are angled relative to the longitudinal direction of the aerosol generating article has the effect that during use the fluid is directed into the proximal end cavity at an angle to the flow of the mainstream fluid. This advantageously optimises the mixing of the fluid and creates Resistance to Draw (RTD). The mixing may also increase the turbulence of the flow of generated aerosol and air through or proximal end cavity. These effects on the flow dynamics of the mainstream generated aerosol may enhance the benefits described above. By changing the openings or passageway dynamics, for example by making the passageway smaller or larger in cross-sectional area, or by altering the angles of the walls of the passageway, or a combination thereof, the desired Resistance to Draw can be achieved. Such passageways, especially when there is a narrowing of the passageway are known as restrictors, or flow restriction elements. According to the present invention either or both the outer and inner longitudinal passageways may have a restrictor, however preferably only the inner longitudinal passageway comprises a restrictor. To aid description below when describing the different embodiments and therefore consequently the direction of flow of fluid and orientation of the passageway, only the inner longitudinal passageway is described. However, the restrictor could equally be used in the outer longitudinal passageway of the invention, where the fluid flow is generally in the opposite direction to the inner longitudinal fluid flow-path. The general flow path in the outer longitudinal passageway is proximal to distal whereas in the inner longitudinal passageway the general flow direction in use is distal to proximal. Ventilated fluid passing through the apertures enter the aerosol generating article and flows in the distal direction, along the outer longitudinal passageway. The fluid makes contact with the tubular element preferably comprising gel, comprising an active agent, and preferably generates, or releases, an aerosol containing the active agent, or other contents of the tubular element.

Restrictors have been provided in smoking articles, and aerosol generating articles, to compensate for a low RTD (Resistance to Draw). Restrictors may, for example, be embedded in a plug or tube of filtration material. Further, filter segments including a restrictor may be combined with other filter segments, which may optionally include other additives, such as sorbents or flavourants.

Preferably, in the transverse cross-sectional area of the restrictor, each passageway extends either along a radius of the transverse cross-sectional area or along a line that is offset from a radius by an angle beta (β). The 'radius' refers to any line extending from the centre of the transverse cross-sectional area to the edge of the transverse cross-sectional area. The angle beta (β) is measured as the smallest angle between the intersection of the radius and the central axis of the passageway. In cases where the passageway is not straight, the angle can be measured between the longitudinal axis of the filter and of the exit of the passageway.

When viewing the cross-sectional area from a downstream direction (distal to proximal end for the inner longitudinal passageway), the angle beta (β) may be directed in a clockwise direction or a counter-clockwise direction with respect to a radius.

Where the passageway is offset from the radius, the angle beta (β) is preferably less than 60 degrees, more preferably less than 45 degrees, and most preferably less than 15 degrees, either in the clockwise direction or counter-clockwise direction. The mixing of any fluid generated from the article and the ventilated fluid may be enhanced in the case where the angle beta (β) is offset from the radius. In some cases, all of the passageways may be directed in a clockwise direction or in a counter-clockwise direction, or some of the passageways are directed in the clockwise direction and some of them are directed in a counter-clockwise direction.

The size of the openings or passageways in the fluid guide preferably provide a total open area between 1.0 square millimetres and 4.0 square millimetres ($mm^2$), more preferably between 1.5 square millimetres and 3.5 square millimetres ($mm^2$). Preferably, the openings or passageways of the inner longitudinal passageway of the fluid guide are substantially circular, although other shapes of the transverse cross-section are also possible. The advantage of the inner longitudinal passageway of the fluid guide being circular in cross-section is that, a more even flow of fluid is possible over passageways of a non-circular cross-sectioned. Altering the shape of the passageways allows a desired flow to be achieved.

A single opening or passageway may be provided in the fluid guide. Alternatively, two or more spaced apart openings or passageways may be provided in the fluid guide. For example, in some embodiments a pair of substantially opposed passageways is provided. Having more than one passageway is advantageous to allow increased control of the fluid flow through the passageways. Having one passageway is advantageous for ease of manufacturing.

In relation to the inner and outer longitudinal passageways where there are two or more openings or passageways, the openings or passageways may have the same open area as each other or different open areas. Having an equal open area for two or more passageways all the same area is advantageous to enable even flow of fluid through all the passageways. However, having two or more passageways with different open areas is advantageous to create turbulence of the fluid as it passes though the two or more passageways.

Two or more passageways may be provided at the same, or a different angle, to the longitudinal axis. Having two or more passageways with the same angle to the longitudinal axis is advantageous to enable even flow of fluid through all the passageways. Generally, an even flow of fluid is easier to predict and design. Having two or more passageways at different angles to the longitudinal axis is advantageous to create turbulence of the fluid as it passes though the two or more passageways. Generally, a turbulent airflow may improve the agglomeration of particles to form aerosol droplets.

Two or more passageways may be provided at the same, or different, angle to a radius of the transverse cross-section of the fluid guide. Having two or more passageways at the same angle to a radius of the transverse cross-section of the fluid guide areas is advantageous to enable even flow of fluid through all the passageways. Having two or more passageways at different angles to a radius of the transverse cross-section of the fluid guide is advantageous to create turbulence of the fluid as it passes though the two or more passageways.

In relation to the inner and outer longitudinal passageways, where there are two or more passageways, the passageways may be positioned at substantially the same position along the length of the fluid guide, or at different longitudinal positions to each other. Having two or more passageways at the same position along the length of the fluid guide is advantageous to enable even flow of fluid through all the passageways. Having two or more passageways at different longitudinal positions to each other is advantageous to create turbulence of the fluid as it passes though the two or more passageways.

In embodiments in which the apertures are provided upstream of a cavity, an outer longitudinal passageway, between the apertures and the cavity allows fluid to pass from external of the aerosol generating article, to the cavity, and tubular element beyond the cavity, in the distal direction. The cavity may be partially enclosed by the wrapper of the aerosol generating article. In such embodiments, the mixing of the fluid, for example ambient air, with the generated or released aerosol may take place, or partially take place, before the aerosol passes through the restrictor.

Where the fluid guide includes two, or more restrictors, of different size cross-sectional area, preferably the first upstream restrictor has the smallest cross-sectional area. Preferably, the first restrictor has a reduced external diameter compared to the overall diameter of the inner longitudinal passageway in order to form an annular passageway between the distal side and the proximal side.

In specific embodiments, the restrictor is substantially spherical. However, alternative shapes are also possible. The restrictor element may, for example, be substantially cylindrical or be provided as a membrane. For example, the restrictor may be provided as a membrane extending in a plane perpendicular to a longitudinal axis of the article.

In alternative designs, the restrictor may be an aggregate of smaller particles (for example, granules held together by a binder).

In combination with specific embodiments, the cross-sectional area of the inner longitudinal passageway of the fluid guide is substantially constant from the distal end to the proximal end. This enables a smooth flow of fluid. The inner diameter of the inner longitudinal passageway of the fluid guide is typically in the range of 1 millimetre to 5 millimetres, typically approximately 2 millimetres. The inner longitudinal passageway typically has an inner longitudinal cross-sectional area that is smaller than the cross-sectional area of a cavity at the distal end of the fluid guide. As such, the fluid guide presents a constricted inner longitudinal cross-sectional area for accelerating air entering the inner longitudinal passageway at the distal end.

In combination with specific embodiments, the cross-sectional area of the inner longitudinal passageway varies from the distal end to the proximal end. This forces the fluid to mix. For example, the cross-sectional area at the distal end of the inner longitudinal passageway may be greater than the cross-sectional area at the proximal end of the inner longitudinal passageway. Where the cross-sectional area of the inner longitudinal passageway is greater at the distal end than at the proximal end, the diameter of the inner longitudinal passageway at the proximal end is preferably between 0.5 millimetres to 3 millimetres, such as approximately 1 millimetre, and the diameter of the inner longitudinal passageway at the distal end is preferably between 1 millimetre to 5 millimetres, such as approximately 2 millimetres.

In combination with specific embodiments the fluid guide is preferably 3 millimetres to 50 millimetres in length, preferably approximately 25 millimetres in length.

In combination with specific embodiments the inner longitudinal passageway of the fluid guide may have one or more portions arranged between the distal end and the proximal end that are adapted to alter the flow of fluid through the inner longitudinal passageway from the distal end to the proximal end.

The inner longitudinal passageway of the fluid guide may comprise a first portion between the proximal end and the distal end that is configured to accelerate fluid as it flows from the distal end towards the proximal end of the fluid guide. The first portion of the inner longitudinal passageway may be configured in any suitable manner to accelerate fluid as it flows through the inner longitudinal passageway from the distal end towards the proximal end of the inner longitudinal passageway. For example, the first portion of the inner longitudinal passageway may include restrictors defining a constricted inner longitudinal cross-sectional area, which force the fluid to accelerate substantially in the axial direction from the distal end towards the proximal end. Preferably the first portion of the inner longitudinal passageway is the first portion of the inner longitudinal passageway in the distal to proximal direction.

In combination with specific embodiments, the inner longitudinal cross-sectional area of the first portion of the inner longitudinal passageway may constrict from a location closer to the distal end of the fluid guide to a location closer to the proximal end of the fluid guide to cause the fluid to accelerate as it flows from the distal end towards the proximal end. The inner longitudinal cross-sectional area of the first portion may constrict from the distal end of the first portion to the proximal end of the first portion. Thus, the distal end of the first portion of the inner longitudinal passageway (the location closer to the distal end of the fluid guide) may have an inner diameter greater than the proximal end of the first portion (the location closer to the proximal end of the fluid guide).

In combination with specific embodiments, the inner longitudinal cross-section area of the first portion of the inner longitudinal passageway may be constant from the distal end of the first portion to the proximal end of the first portion. In such embodiments, the constant inner longitudinal cross-sectional area of the first portion of the inner longitudinal passageway may be smaller than the inner longitudinal cross-sectional area at the distal end of the inner longitudinal passageway.

Where the inner longitudinal passageway of the fluid guide is constricted from the distal end to the proximal end, the constriction of the inner longitudinal passageway typically comprises a gradual reduction in the cross-sectional area of the inner longitudinal passageway from the distal end to the proximal end of the fluid guide. Preferably, the reduction in the diameter of the inner longitudinal passageway is linear from the distal end to the proximal end of the first portion, for example a frustoconical shape. A linear reduction in the cross-sectional area, for example a frustoconical shape is advantageous in creating a smooth flow of fluid through the fluid guide.

Alternatively, the constriction is non-uniform. For example, in specific embodiments the constriction of the inner longitudinal passageway is stepped, the cross-sectional area of the inner longitudinal passageway constricts in discrete increments, or steps, from the distal end to the proximal end. A non-uniform reduction in the cross-sectional area of the inner longitudinal passageway is advantageous in creating turbulence of the fluid as it passes along the fluid guide.

The inner longitudinal passageway of the fluid guide may comprise a second portion between the proximal end and the distal end that is configured to decelerate fluid as it flows from the distal end towards the proximal end of the fluid guide. The second portion of the inner longitudinal passageway may be configured in any suitable manner to decelerate fluid as it flows through the inner longitudinal passageway from the distal end towards the proximal end of the inner longitudinal passageway. For example, the first portion of the inner longitudinal passageway may include guides defining an expanded inner longitudinal cross-sectional area, which force fluid to decelerate substantially in the axial direction from the distal end towards the proximal end. Preferably the second portion of the inner longitudinal passageway is after the first portion in the distal to proximal direction.

In combination with specific embodiments, the inner longitudinal cross-sectional area of the first portion of the inner longitudinal passageway may expand from a location closer to the distal end of the fluid guide to a location closer to the proximal end of the fluid guide to cause the fluid to decelerate as it flows from the distal end towards the proximal end. The inner longitudinal cross-sectional area of the first portion may expand from the distal end of the second portion to the proximal end of the second portion of the fluid guide. Thus, the distal end of the second portion of the inner longitudinal passageway (the location closer to the distal end of the fluid guide) may have an inner diameter less than the proximal end of the second portion (the location closer to the proximal end of the fluid guide).

In combination with specific embodiments, the cross-sectional area of the second portion of the inner longitudinal passageway may be constant from the distal end of the second portion to the proximal end of the second portion. In such embodiments, the area of the constant cross-sectional area of the second portion of the inner longitudinal passageway may be greater than the area of the cross-sectional area at the distal end of the second portion of the inner longitudinal passageway.

Where the inner longitudinal passageway of the fluid guide is expanded in cross-sectional area from the distal end to the proximal end, the cross-sectional area expansion of the inner longitudinal passageway typically comprises a gradual expansion in the cross-sectional area of the inner longitudinal passageway from the distal end, of the second portion, to the proximal end of the fluid guide. Preferably the expansion in the diameter of the inner longitudinal passageway may be linear from the distal end to the proximal end of the second portion, for example a frustoconical shape. A linear reduction in the cross-sectional area, for example a frustoconical shape is advantageous in creating a smooth flow of fluid through the fluid guide.

Alternatively, the constriction is non-uniform. For example, in specific embodiments the expansion of the inner longitudinal passageway is stepped, the cross-sectional area of the inner longitudinal passageway constricts in discrete increments, or steps, from the distal end to the proximal end. A non-uniform reduction in the cross-sectional area of the inner longitudinal passageway is advantageous in creating turbulence of the fluid as it passes along the fluid guide The diameter of the proximal end of the inner longitudinal passageway is typically between 0.5 millimetres and 3 millimetres, such as 0.8 millimetres, 1 millimetre, or preferably 1.2 millimetres.

The diameter of the distal end of the inner longitudinal passageway is typically between 1 millimetre and 5 millimetres, such as 1.2 millimetres, 2 millimetres, or preferably 2.2 millimetres.

The ratio of the diameter of the proximal end of the inner longitudinal passageway to the diameter of the distal end of the inner longitudinal passageway is typically between 1:4 and 3:4, or between 2:5 and 3:5, or preferably 1:2.

The distance between the proximal end and the distal end of the inner longitudinal passageway may be any suitable distance. For example, the length of the inner longitudinal passageway is typically from 3 millimetres to 15 millimetres, such as from 4 millimetres to 7 millimetres, or preferably 5.2 millimetre to 5.8 millimetres.

In specific embodiments of the present invention the fluid guide may be modular comprising two or more segments that form the fluid guide.

In combination with specific embodiments the aerosol generating article comprises at least one outer longitudinal passageway in communication with an aperture of the wrapper. In combination with specific embodiments the passageway is formed, at least in part, by the wrapper, where a wrapper is present. The passageway directs fluid (for example ambient air) from the aperture towards the tubular element comprising an active agent. In specific embodiments, the outer longitudinal passageway is formed in an outer portion of the fluid guide under an interior surface of the wrapper.

The aerosol generating article may comprise more than one outer longitudinal passageway. In specific embodiments, the aerosol generating article comprises from 2 to 20 outer longitudinal passageways in the outer portion of the fluid guide. For example, the article may comprise 6 to 14 outer longitudinal passageways, typically 10 to 12 passageways. A different number of passageways allows for a different aerosol flow dynamic.

Preferably, each outer longitudinal passageway is in communication with at least one aperture through the wrapper. However, the aerosol generating article may comprise one or more outer longitudinal passageways that are not in direct communication with an aperture. Preferably each outer longitudinal passageway is in communication with at least one aperture through the outer wall of the fluid guide. Where present, preferably the aperture through the wrapper and the aperture through the outer wall of the fluid guide are aligned to each other, and to at least one outer longitudinal passageway, in order to allow efficient flow of fluid into the aerosol generating article and along the outer longitudinal passageway towards the distal end of the aerosol generating article.

Preferably, the outer longitudinal passageway, and wrapper, comprise more than one aperture. For example, in combination with specific embodiments the outer longitudinal passageway, and wrapper, comprise between 2 apertures and 20 apertures. Preferably the number of apertures equals the number of outer longitudinal passageways, and each aperture corresponds to a separate outer longitudinal passageway. Preferably, the apertures are evenly spaced, circumferentially disposed around the article, to aid even distribution of the fluid.

In combination with specific embodiments, the sidewalls of the outer longitudinal passageway extend between an exterior of the fluid guide and the interior-side of the wrapper, along at least part of the longitudinal length of the aerosol generating article. For example, in specific embodiments the fluid guide has longitudinal groves which, with the presence of a wrapper, forms the outer longitudinal passageways.

In combination with specific embodiments, the outer longitudinal passageways extend fully around the interior of the wrapper. Alternatively, the outer longitudinal passageway extends less than fully around the circumference of the fluid guide, such as less than 90 percent around the circumference of the fluid guide, less than 70 percent around the circumference of the fluid guide, or less than 50 percent around the circumference of the fluid guide. In specific embodiments, the outer longitudinal passageway extends at least 5 percent around circumference of the fluid guide.

In combination with specific embodiments, the distal end of the outer longitudinal passageway is spaced from the distal end of the aerosol generating article. Alternatively, in other specific embodiments, the distal end of the outer longitudinal passageway is equal to the distal end of the fluid guide. In combination with specific embodiments, the distal end of the outer longitudinal passageway may be between 2 millimetres and 20 millimetres from the distal end of the aerosol generating article, such as between 10 millimetres and 12 millimetres from the distal end of the aerosol generating article.

In combination with specific embodiments, the width of the outer longitudinal passageways are, for example, between 0.5 millimetres and 2 millimetres, typically between 0.75 millimetres and 1.8 millimetres.

The distal end of the longitudinal passageways may be positioned a distance from the distal end of the aerosol generating article such that fluid that enters the aperture of the outer longitudinal passageways may make contact with the tubular element and enable an aerosol to be generated, or released, from the gel. The aerosol generated, or released, at the tubular element may pass through the inner longitudinal passageway of the fluid guide to the proximal end of the aerosol generating article.

Preferably, at least 5 percent of the fluid that flows through the aerosol generating article contacts the tubular element and gel preferably comprising an active agent. More preferably, at least 25 percent of the air that flows through the article contacts the tubular element comprising an active agent.

In specific embodiments not all fluid will make contact with the tubular element, for example, at least 5 percent of the fluid that flows through the aerosol generating article will not contact the tubular element, although in other specific embodiments this may be at least 10 percent of the fluid that flows through the aerosol generating article.

In combination with specific embodiments, the distal end of the fluid guide is spaced from the distal end of the aerosol generating article. In combination with specific embodiments, the distal end of the fluid guide may be between 2 millimetres and 20 millimetres from the distal end of the aerosol generating article, such as between 7 millimetres and 17 millimetres from the distal end of the aerosol generating article, preferably between 12 millimetres and 16 millimetres.

Preferably, the aerosol generating article is generally cylindrical. This easily enables a smooth flow of the aerosol. The aerosol generating article may have an outer diameter, for example, between 4 millimetres and 15 millimetres, between 5 millimetres and 10 millimetres, or between 6 millimetres and 8 millimetres. The aerosol generating article may have a length, for example, between 10 millimetres and 60 millimetres, between 15 millimetres to 50 millimetres, or between 20 millimetres and 45 millimetres.

The resistance to draw (RTD) of the aerosol generating article will vary depending on, among other things, the length and dimensions of the passageways, the size of the apertures, the dimensions of the most constricted cross-sectional area of the internal passageway, and the materials used. In specific embodiments the RTD of the aerosol generating article is between 50 millimetres per water and 140 millimetres per water (mm $H_2O$), between 60 millimetres per water and 120 millimetres per water (mm $H_2O$), or between 80 millimetres per water and 100 millimetres per water (mm $H_2O$). The RTD of the article refers to the static pressure difference between the one or more apertures and the mouth end of the article when it is traversed by an inner longitudinal passageway under steady conditions in which the volumetric flow is 17.5 millilitres per second at the mouth end. The RTD of a specimen can be measured using the method set out in ISO Standard 6565:2002.

Preferably, aerosol generating articles according to the present invention comprise an aperture at a location along the outer longitudinal passageway. Thus, the aperture is at a location upstream of the restrictor. In specific embodiments the aperture will be provided as a row or rows of apertures through the wrapper, or fluid guide, or both the fluid guide and the wrapper, and allow fluid to be drawn into the aerosol generating article. The fluid is first drawn through the apertures then the outer longitudinal passageway(s), then towards the distal end of the aerosol generating article where the fluid can contact the tubular element, and preferably the gel within the tubular element, preferably the gel comprising an active agent, before passing along the inner longitudinal passageway and through, if present in that embodiment, a restrictor. Preferably, the total internal pathway of the fluid from the aperture to the proximal end of the aerosol generating article is at least 9 millimetres. More preferably, at least 10 millimetres, so as to give an optimal aerosol formation with regard to, among other things, Resistance to Draw and cooling effect.

By adjusting the number and size of the apertures, it is possible to tailor the amount of fluid admitted into the aerosol generating article when drawn. For example, one or two rows of apertures may be formed through the wrapper to enable an easy flow of fluid into the aerosol generating article. In alternative specific embodiments the wrapper comprises fewer apertures, for example 2 or 4. The number of apertures, and size of apertures, will affect the fluid flow into the aerosol generating article. Different combinations of resistance to draw (RTD) and the fluid flow into the aerosol generating article may result in different aerosol formations, and so aerosol generating articles in accordance with the present invention offer a broader spectrum of design options.

In specific embodiments the aerosol generating article comprises plastic material; a metal material; a cellulosic material, such as cellulose acetate; paper; cardboard; cotton; or combinations thereof.

In specific embodiments the fluid guide comprises plastic material, a metal material, a cellulosic material, such as cellulose acetate, paper, cardboard, or combinations thereof.

In combination with specific embodiments the wrapper comprises more than one material. In specific embodiments the wrapper, or a portion thereof, comprises, a metal material, a plastic material, cardboard, paper, cotton, or combinations thereof. When the wrapper comprises cardboard or paper, the apertures may be formed by laser cuts.

A wrapper provides strength and structural rigidity for the aerosol generating article. When paper or cardboard is used for the wrapper and a high degree of stiffness is desired it preferably has a basis weight greater than 60 grams per square metre. One such wrapper may provide high structural rigidity. The wrapper may resist deformation on the outside of the aerosol generating article at the location where, if present, the restrictor is embedded within the aerosol generating article, or in other locations for example, in cavities (if present) where there is less structural support. In some embodiments, the tubular element wrapper comprises a metal layer. The metal layer may be used to concentrate an externally applied energy to heat the tubular member, for example, the metal layer may act as susceptor for an electromagnetic field, or collect radiation energy supplied by an external heat source. If an internal heat source is present, the metal layer may prevent heat from leaving the tubular element through the wrapper, thus increasing the efficiency of the heating. It may also provide for a uniform distribution of heat along the periphery of the tubular member.

In specific embodiments the aerosol generating article comprises a seal between an exterior of the fluid guide and an interior of a wrapper. The wrapper may then be securely attached to the fluid guide. It need not create a fluid impermeable seal.

In specific embodiments, the aerosol generating article comprises a mouthpiece. The mouthpiece may comprise the fluid guide, or a portion thereof, and may form at least a proximal portion of the wrapper of the aerosol generating article. The mouthpiece may connect with the wrapper, or a distal portion of the wrapper, in any suitable manner, such as through interference fit, threaded engagement, or the like. The mouthpiece can be the portion of the aerosol generating article that can include a filter, or in some cases the mouthpiece can be defined by the extent of the tipping paper, if present. In other embodiments, the mouthpiece can be defined as a portion of the article extending 40 millimetres from the mouth end of the aerosol generating article, or, extending 30 millimetres from the mouth end of the aerosol generating article.

The tubular element, preferably comprising gel comprising an active agent, may be placed in the aerosol generating article in proximity to the distal end prior to final assembly of the aerosol generating article.

Once fully assembled, the aerosol generating article defines a fluid path through which fluid can flow. When a negative pressure is provided at the mouth end (proximal end) of the aerosol generating article, fluid enters the aerosol generating article through an aperture in the wrapper (or fluid guide, or both), then flows through the outer longitudinal passageway towards the distal end of the aerosol generating article. There it may entrain aerosol, optionally generated by heating of the tubular element comprising an active agent. The fluid with entrained aerosol may then flow through the inner longitudinal passageway of the fluid guide and through the open mouth end of the aerosol generating article.

Preferably the aerosol generating article is configured to be received by an aerosol generating device such that a heating element of the aerosol generating device may heat the section of the aerosol generating article that comprises the tubular element. For example the tubular element may be the distal end of the aerosol generating article should the tubular element, preferably comprising gel comprising an active agent, be disposed at or near to the distal end of the aerosol generating article.

Preferably the aerosol generating article may be shaped and sized for use with a suitably, correspondingly shaped and sized aerosol generating device comprising a receptacle for receiving the aerosol generating article and a heating element configured and positioned to heat the section of the aerosol generating article that comprises the tubular element preferably comprising a gel comprising an active agent.

The aerosol generating device preferably comprises control electronics operably coupled to the heating element. The control electronics may be configured to control heating of the heating element. The control electronics may be internal to a housing of the device.

The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may comprise a microprocessor, which may be a programmable microprocessor. The electronic circuitry may be configured to regulate a supply of power to the heating element. The power may be supplied to the heating element in the form of pulses of electrical current. The control electronics may be configured to monitor the electrical resistance of the heating element and to control the supply of power to the heating element depending on the electrical resistance of the heating element. In this manner, the control electronics may regulate the temperature of the resistive element.

The aerosol generating device may comprise a temperature sensor, such as a thermocouple, operably coupled to the control electronics to control the temperature of the heating elements. The temperature sensor may be positioned in any suitable location. For example, the temperature sensor may be in contact or in proximity to the heating element. The sensor may transmit signals regarding the sensed temperature to the control electronics, which may adjust heating of the heating element to achieve a suitable temperature at the sensor.

Regardless of whether the aerosol generating device includes a temperature sensor, the device may be configured to heat the tubular element preferably comprising gel comprising an active agent, which is disposed in the aerosol generating article, to an extent sufficient to generate an aerosol.

The control electronics may be operably coupled to a power supply, which may be internal to the housing. The aerosol generating device may comprise any suitable power supply. For example, a power supply of an aerosol generating device may be a battery, or, set of batteries. The batteries or power supply unit can be rechargeable, as well as being removable and replaceable.

In combination with specific embodiments the heating element comprises a resistive heating component, such as one or more resistive wires or other resistive elements. The resistive wires may be in contact with a thermally conductive material to distribute heat produced over a broader area. Examples of suitable conductive materials include gold, aluminium, copper, zinc, nickel, silver, and combinations thereof. Preferably, if resistive wires are in contact with a thermally conductive material, both the resistive wires and the thermally conductive material are part of the heating element.

In combination with specific embodiments the heating element comprises a cavity configured to receive and surround the distal end of the article. The heating element may comprise an elongate element configured to extend along a side of the housing of the article when the distal end of the article is received by the device.

Alternatively, to inserting a heating element into the aerosol generating article, heat may be applied externally to the tubular element with a heat jacket that is thermally coupled around the wrapper of the aerosol generating article. Preferably the jacket is located in the portion of the aerosol generating article that comprises the tubular element.

In other specific embodiments the heating element comprises inductive heating.

In specific embodiments the tubular element preferably comprising gel preferably comprising an active agent, is heated by induction heating.

Preferably the portion of the aerosol generating article comprising the tubular element is positioned in the aerosol generating device such that the heating element or heating elements that generate electromagnetic radiation for the induction heating are in proximity to the portion of the aerosol generating article that comprises the tubular element. Thus, preferably, the heating elements of the aerosol generating device are in proximity to the gel within the aerosol generating article, when positioned in the aerosol generating device.

Preferably in embodiments for use with induction heating, the aerosol generating article comprises a susceptor. Preferably in embodiments for use with induction heating the tubular element comprises a susceptor. Further preferably in specific embodiments the gel comprises a susceptor. Preferably the susceptor is in contact with or in proximity to the gel. In such embodiments of the invention therefore upon heating the susceptor by radiation, heat transfer can easily take place to the gel, aiding the release of material from the gel, for example an active agent.

Additionally or alternatively, in combination with other features of the present invention, the porous medium loaded with gel comprises a susceptor. Thus the susceptor may be in contact with the porous medium loaded with gel, and allows easy heating of the porous medium loaded with gel.

In specific embodiments the gel within the tubular element may initially be separated from the aerosol received into the tubular element, and may be released to become entrained into the aerosol in response to the rupturing of a frangible partition. Optionally in specific embodiments a plurality of portions of the gel may each be sealed behind a respective, frangible partition, and rupturing an appropriate number of frangible partitions is required to achieve a desired level of entrainment of active agent into the aerosol received into the tubular element, in use.

In combination with specific embodiments, the aerosol generating device may be configured to receive more than one aerosol generating articles described herein. For example, the aerosol generating device may comprise a receptacle into which an elongate heating element extends. One aerosol generating article may be received in the receptacle on one side of the heating element, and another aerosol generating article may be received in the receptacle on the other side of the heating element. Or in other specific embodiments the aerosol generating device comprises more than one receptor. Thus is able to receive more than one aerosol generating article at a time.

In combination with specific embodiments of the present invention, the wrapper or a portion of the wrapper is water-resistant or hydrophobic, giving the property of having some degree of waterproofing, or resistant to moisture penetration. This may be the wrapper of the tubular element, or the wrapper to the aerosol generating article, or both the wrapper of the tubular element and the aerosol generating article. It may also be the wrapper to any other portion of the aerosol generating article, or any other component of the aerosol generating article, including the longitudinal sides of a second tubular element within the first tubular element. The wrapper may be naturally impermeable and thus resistant to water or moisture penetration. The wrapper may be multi-layered having a barrier that prevents, or reduces, the passage of water, or, is at least resistant to the penetration of water or moisture. In combination with specific embodiments the hydrophobic barrier, or hydrophobic treatment, of the wrapper may be over the whole area of the wrapper. Alternatively, in other specific embodiments the hydrophobic barrier or treatment to the wrapper is to a portion of the wrapper, for example this may be on one side of the wrapper, either the inner side or the outer side, of the wrapper; or may be treated on both sides of the wrapper.

The hydrophobic region of the wrapper may be produced by a process comprising the steps of: applying a liquid composition comprising a fatty acid halide to at least one surface of a wrapper and maintaining, for approximately 5 minutes, the surface at a temperature of 120 degrees Celsius to 180 degrees Celsius. The fatty acid halide reacts in situ with protogenic groups of material in the wrapper resulting in the formation of fatty acid esters, and thus giving hydrophobic properties and resistance to moisture penetration.

It is contemplated that the hydrophobic treated wrapper can reduce or prevent water, moisture, or liquid adsorption into or transmittal through the wrapper. Advantageously, the hydrophobic treated wrapper does not negatively affect the taste of the article.

In specific embodiments, the wrapper in use generally forms an outer portion of the aerosol generating article. In specific embodiments the wrapper comprises: paper, homogenized paper, homogenized tobacco-impregnated paper, homogenized tobacco, wood pulp, hemp, flax, rice straw, esparto, eucalyptus, cotton and the like. In specific embodiments the substrate or paper forming the wrapper has a basis weight of the substrate or paper forming the wrapper in a range from 10 to 50 grams per square meter, for example from 15 to 45 grams per square meter. In combination with specific embodiments the thickness of the substrate or paper forming the wrapper is in a range from 10 to 100 micrometres or preferably from 30 to 70 micrometres.

In combination with specific embodiments, hydrophobic groups are covalently bonded to the inner surface of the wrapper. In other embodiments, the hydrophobic groups are covalently bonded to the outer surface of the wrapper. It has been found that covalently bonding hydrophobic groups to only one side or surface of the wrapper imparts hydrophobic properties to the opposing side or surface of the wrapper. The hydrophobic wrapper or hydrophobic treated wrapper can reduce or prevent fluid, for example, liquid flavourant or liquid release component from staining or absorbing or transmitting through the wrapper.

In various specific embodiments, the wrapper and particularly the wrapper region adjacent to the tubular element preferably comprising gel comprising an active agent, is hydrophobic or has one or more hydrophobic regions. This hydrophobic wrapper or hydrophobic treated wrapper may have a Cobb water absorption (ISO535:1991) value (at 60 seconds) of less than 40 $g/m^2$, less than 35 $g/m^2$, less than 30 $g/m^2$, or less than 25 $g/m^2$.

In various specific embodiments, the wrapper and particularly the wrapper region adjacent the tubular element, preferably comprising gel comprising an active agent, has a water contact angle of at least 90 degrees, for example at least 95 degrees, at least 100 degrees, at least 110 degrees, at least 120 degrees, at least 130 degrees at least 140 degrees, at least 150 degrees, at least 160 degrees, or at least 170 degrees. Hydrophobicity is determined by utilizing the TAPPI T558 om-97 test and the result is presented as an interfacial contact angle and reported in "degrees" and can range from near zero degrees to near 180 degrees. Where no contact angle is specified along with the term hydrophobic, the water contact angle is at least 90 degrees.

In combination with specific embodiments the hydrophobic surface is uniformly present along the length of the wrapper, alternatively in other specific embodiments the hydrophobic surface is not uniformly present along the length of the wrapper.

Preferably the wrapper is formed of any suitable cellulose material, preferably cellulose material derived from plants. In many embodiments the wrapper is formed of a material with pendent protogenic groups. Preferably, the protogenic groups are reactive hydrophilic groups such as but not limited to a hydroxyl group (—OH), an amine group (—$NH_2$), or a sulfhydryl group (—$SH_2$).

Particularly suitable wrappers adapt to this invention will now be described, by way of example. Wrapper material with pendent hydroxyl groups includes cellulosic material such as paper, wood, textile, natural as well as artificial fibers. The wrapper can also include one or more filler materials, for example calcium carbonate, carboxy methylcellulose, potassium citrate, sodium citrate, sodium acetate or activated carbon.

The hydrophobic surface or region of the cellulosic material forming the wrapper can be formed with any suitable hydrophobic reagent or hydrophobic group. The hydrophobic reagent is preferably chemically bonded to the cellulosic material or pendent protogenic groups of the cellulosic material forming the wrapper. In many embodiments the hydrophobic reagent is covalently bonded to the cellulosic material or pendent protogenic groups of the cellulosic material. For example, the hydrophobic group is covalently bonded to pendent hydroxyl groups of cellulosic material forming the wrapper. A covalent bond between structural components of the cellulosic material and the hydrophobic reagent can form hydrophobic groups that are more securely attached to the paper material than simply disposing a coating of hydrophobic material on the cellulosic material forming the wrapper. By chemically bonding the hydrophobic reagent at the molecular level in situ rather than applying a layer of hydrophobic material in bulk to cover the surface allows the permeability of the cellulosic material, for example, paper, to be better maintained, since a coating tends to cover or block pores in the cellulosic material forming the continuous sheet and reduce the permeability. Chemically bonding hydrophobic groups to the paper in situ can also reduce the amount of material required to render the surface of the wrapper hydrophobic. The term "in situ" as used herein refers to the location of the chemical reaction which takes place on or near the surface of the solid material that forms the wrapper, which is distinguishable from a reaction with cellulose dissolved in a solution. For example, the reaction takes place on or near the surface of cellulosic material forming the wrapper which comprises cellulosic material in a heterogenous structure. However, the term "in situ" does not require that the chemical reaction takes place directly on cellulosic material forming the hydrophobic tube region.

The hydrophobic reagent may comprise an acyl group or fatty acid group. The acyl group or fatty acid group or mixture thereof can be saturated or unsaturated. A fatty acid group (such as a fatty acid halide) in the reagent can react with pendent protogenic groups such as hydroxyl groups of the cellulosic material to form an ester bond covalently bonding the fatty acid to the cellulosic material. In essence, these reactions with the pendant hydroxyl groups can esterify the cellulosic material.

In some embodiments of the wrapper, the acyl group or fatty acid group includes a $C_{12}$-$C_{30}$ alkyl (an alkyl group having from 12 to 30 carbon atoms), a $C_{14}$-$C_{24}$ alkyl (an alkyl group having from 14 to 24 carbon atoms) or preferably a $C_{16}$-$C_{20}$ alkyl (an alkyl group having from 16 to 20 carbon atoms). Those skill in the art would understand that the term "fatty acid" as used herein refers to long chain aliphatic, saturated or unsaturated fatty acid that comprises 12 to 30 carbon atoms, 14 to 24 carbon atoms, 16 to 20 carbon atoms or that has greater than 15, 16, 17, 18, 19, or 20 carbon atoms. In various embodiments, the hydrophobic reagent includes an acyl halide, a fatty acid halide, such as, a fatty acid chloride including palmitoyl chloride, stearoyl chloride or behenoyl chloride, a mixture thereof, for example. The in situ reaction between fatty acid chloride and cellulosic material forming the continuous sheet results in fatty acid esters of cellulose and hydrochloric acid.

Any suitable method can be utilized to chemically bond the hydrophobic reagent or group to the cellulosic material forming the hydrophobic tube region. The hydrophobic group is covalently bonded to the cellulosic material by diffusion of a fatty acid halide on its surface without using a solvent.

As one example, an amount of hydrophobic reagent, such as an acyl halide, a fatty acid halide, a fatty acid chloride, palmitoyl chloride, stearoyl chloride or behenoyl chloride, a mixture thereof, is deposited without solvent (solvent-free process) at the surface of the wrapper paper at a controlled temperature, for example, droplets of the reagents forming 20-micrometer regularly-spaced circles on the surface. The control of the vapour tension of the reagent can promote the propagation of the reaction by diffusion with the formation of ester bonds between fatty acid and cellulose while continuously withdrawing unreacted acid chloride. The esterification of cellulose is in some cases based on the reaction of alcohol groups or pendent hydroxyl groups of cellulose with an acyl halide, such as an acyl chloride including a fatty acid chloride. The temperature that can be used to heat the hydrophobic reagent depends on the chemical nature of the reagent and for fatty acid halides, it ranges, for example from 120 degrees Celsius to 180 degrees Celsius.

The hydrophobic reagent can be applied to the cellulosic material of the wrapper paper in any useful amount or basis weight. In many embodiments the basis weight of the hydrophobic reagent is less than 3 grams per square meter, less than 2 grams per square meter, or less than 1 gram per square meter or in a range from 0.1 to 3 grams per square meter, from 0.1 to 2 grams per square meter, or from 0.1 to 1 gram per square meter. The hydrophobic reagent can be applied or printed on the wrapper paper surface and define a uniform or non-uniform pattern.

Preferably the hydrophobic tube region is formed by reacting a fatty acid ester group or a fatty acid group with pendent hydroxyl groups on the cellulosic material of the wrapper paper to form a hydrophobic surface. The reacting step can be accomplished by applying a fatty acid halide (such as chloride, for example) which provides the fatty acid ester group or a fatty acid group to chemically bond with pendent hydroxyl groups on the cellulosic material of the wrapper paper to form a hydrophobic surface. The applying step can be carried out by loading the fatty acid halide in liquid form onto a solid support, such as a brush, a roller, or an absorbent or non-absorbent pad, and then contacting the solid support with a surface of the paper. The fatty acid halide can also be applied by printing techniques, such as gravure, flexography, ink jet, heliography, by spraying, by wetting, or by immersion in a liquid comprising the fatty acid halide. The applying step can deposit discrete islands of reagent forming a uniform or non-uniform pattern of hydrophobic areas on the surface of the wrapper paper. The uniform or non-uniform pattern of hydrophobic areas on the wrapper paper can be formed of at least 100 discrete hydrophobic islands, at least 500 discrete hydrophobic islands, at least 1000 discrete hydrophobic islands, or at least 5000 discrete hydrophobic islands. The discrete hydrophobic islands can have any useful shape such as for example a circle, rectangle or polygon. The discrete hydrophobic islands can have any useful average lateral dimension. In many embodiments the discrete hydrophobic islands have an average lateral dimension in a range from 5 to 100 micrometres, or in a range from 5 to 50 micrometres. To aid diffusion of the applied reagent on the surface, a gas stream can also be applied to the surface of the wrapper.

In combination with specific embodiments, a hydrophobic wrapper can be produced by a process comprising applying a liquid composition comprising an aliphatic acid halide (preferably a fatty acid halide) to at least one surface of wrapper paper, optionally applying a gas stream to the surface of the wrapper, to aid diffusion of the applied fatty acid halide, and maintaining, for at least 5 minutes, the surface of the wrapper at a temperature 120 degrees Celsius to 180 degrees Celsius, wherein the fatty acid halide reacts in situ with the hydroxyl groups of the cellulosic material in the wrapper paper resulting in the formation of fatty acid esters. Preferably, the wrapper paper is made of paper, and the fatty acid halide is stearoyl chloride, palmitoyl chloride, or a mixture of fatty acid chlorides with 16 to 20 carbon atoms in the acyl group. The hydrophobic wrapper paper produced by a process described hereinabove is thus distinguishable from material made by coating the surface with a layer of pre-made fatty acid ester of cellulose.

The hydrophobic wrapper may be produced by a process of applying the liquid reagent composition to the at least one surface of a wrapper paper at a rate of in a range from 0.1 to 3 grams per square meter, or from 0.1 to 2 grams per square meter, or from 0.1 to 1 gram per square meter. The liquid reagent applied at these rates renders the surface of the wrapper paper hydrophobic.

In many specific embodiments, the thickness of the wrapper paper allows the hydrophobic groups or reagent applied to one surface to spread onto the opposing surface effectively providing similar hydrophobic properties to both opposing surfaces. In one example, the thickness of the wrapper paper was 43 micrometres and both surfaces were rendered hydrophobic by the gravure (printing) process using stearoyl chloride as the hydrophobic reagent to one surface.

In some specific embodiments, the material or method to create the hydrophobic nature of the hydrophobic tube region does not substantially affect the permeability of the wrapper at other regions. Preferably, the reagent or method to create the hydrophobic tube region changes the permeability of the wrapper at this treated region (as compared to the untreated wrapper region) by less than 10 percent or less than 5 percent or less than 1 percent.

In many specific embodiments the hydrophobic surface can be formed by printing reagent along the length of the cellulosic material. Any useful printing methods can be utilized such as gravure, ink jet and the like. Gravure printing is preferred. The reagent can include any useful hydrophobic groups that can be chemically, for example, covalently, bonded to the wrapper, in particular to cellulosic material or pendent groups of the cellulosic material, of the wrapper.

In combination with specific embodiments of the present invention the aerosol generating article comprises a susceptor. In combination with specific embodiments the tubular element comprises a susceptor. Preferably the susceptor is elongated and is arranged longitudinally within the tubular element Preferably the susceptor is in thermal contact with the gel or porous material loaded with gel. This may aid heat transfer from the heating element in the aerosol generating device to, and through, the aerosol generating article, preferably through the tubular element to the susceptor, and therefore the gel or porous medium loaded with gel, if in the proximity of the susceptor. When heating is by induction heating, a fluctuating electromagnetic field is transmitted through the aerosol generating article, preferably through the tubular element to the susceptor such that the susceptor changes the fluctuating field into thermal energy thus heating the gel, or porous material loaded with gel, in the proximity. Typically, the susceptor has a thickness of between 10 and 500 micrometres. In preferred embodiments the susceptor has a thickness of between 10 and 100 micrometres. Alternatively, the susceptor may be in form of a powder that is dispersed within the gel. Typically, the susceptor is configured for dissipating energy of between 1 Watt and 8 Watt when used in conjunction with a particular inductor, for example between 1.5 Watt and 6 Watt. By configured, it is meant that the elongate susceptor may be made of a specific material and may have specific dimensions that allow energy dissipation of between 1 Watt and 8 Watt when used in conjunction with a particular conductor that generates a fluctuating magnetic field of known frequency and known field strength.

According to a further aspect of the invention an aerosol-generating system is provided comprising an electrically-operated aerosol-generating device having an inductor for producing an alternating or fluctuating electromagnetic field, and an aerosol-generating article comprising a susceptor as described and defined herein. The aerosol-generating article engages with the aerosol-generating device such that the fluctuating electromagnetic field produced by the inductor induces a current in the susceptor, causing the susceptor to heat up. The electrically-operated aerosol-generating device is preferably capable of generating a fluctuating electromagnetic field having a magnetic field strength (H-field strength) of between 1 kilo amperes per metre and 5 kilo amperes per metre (kA/m), preferably between 2 kilo amperes per metre and 3 kilo amperes per metre (kA/m), for example 2.5 kilo amperes per metre (kA/m). The electrically-operated aerosol-generating device is preferably capable of generating a fluctuating electromagnetic field having a frequency of between 1 Mega Hertz (MHz) and 30 Mega Hertz (MHz), for example between 1 Mega Hertz (MHz) and 10 Mega Hertz (MHz), for example between 5 Mega Hertz (MHz) and 7 Mega Hertz (MHz).

Preferably, the elongate susceptor, of the present invention, is part of a consumable item, and thus is only used once. The flavour of a sequence of aerosol-generating articles may be more consistent due to the fact that a fresh susceptor acts to heat each aerosol generating article. The requirement for cleaning of the aerosol-generating device is significantly easier for devices with reusable heating elements and may be achieved without damage to a heat source. Furthermore, the lack of a heating element that needs to penetrate an aerosol-forming substrate means that insertion and removal of an aerosol-generating article into an aerosol-generating device is less likely to cause inadvertent damage to either the aerosol generating article or the aerosol generating device. The overall aerosol-generating system is, therefore, robust.

When a susceptor is located within a fluctuating electromagnetic field, eddy currents induced in the susceptor cause heating of the susceptor. Ideally the susceptor is located in thermal contact with the gel, or porous material loaded with gel, of the tubular element, thus the gel, or porous material loaded with gel, or both gel and porous material loaded with gel, is heated by the susceptor.

In combination with specific embodiments the aerosol-generating article is designed to engage with an electrically-operated aerosol-generating device comprising an induction heating source. The induction heating source, or inductor, generates the fluctuating electromagnetic field for heating a susceptor located within the fluctuating electromagnetic field. In use, the aerosol-generating article engages with the aerosol generating device such that the susceptor is located within the fluctuating electromagnetic field generated by the inductor.

Preferably, the susceptor has a length dimension that is greater than its width dimension or its thickness dimension, for example greater than twice its width dimension or its thickness dimension. Thus, the susceptor may be described as an elongate susceptor. Such a susceptor is arranged substantially longitudinally within the rod. This means that the length dimension of the elongate susceptor is arranged to be approximately parallel to the longitudinal direction of the aerosol generating article, for example within plus or minus 10 degrees to the longitudinal axis to the longitudinal direction of the rod. In preferred embodiments, the elongate susceptor element may be positioned in a radially central position within the aerosol generating article, and, extends along the longitudinal axis of the aerosol generating article.

The susceptor is preferably in the form of a pin, rod, strip, sheet or blade. The susceptor preferably has a length of between 5 millimetres and 15 millimetres, for example between 6 millimetres and 12 millimetres, or between 8 millimetres and 10 millimetres. Typically the length of the susceptor is at least as long as the tubular element, thus typically between 20 percent and 120 percent of the longitudinal length of the tubular element, for example between 50 and 120 percent of the length of the tubular element, preferably between 80 percent and 120 percent of the longitudinal length of the tubular element. The susceptor preferably has a width of between 1 millimetre and 5 millimetres and may have a thickness of between 0.01 millimetres and 2 millimetres. for example, between 0.5 millimetres and 2 millimetres. A preferred embodiment may have a thickness of between 10 micrometres and 500 micrometres, or even more preferably between 10 micrometres and 100 micrometres. If the susceptor has a constant cross-section, for example a circular cross-section, it has a preferable width or diameter of between 1 millimetres and 5 millimetres.

The susceptor may be formed from any material that can be inductively heated to a temperature sufficient to generate an aerosol from the aerosol-forming substrate. In preferred embodiments the susceptor comprises a metal or carbon. A preferred susceptor may comprise a ferromagnetic material, for example ferritic iron, or a ferromagnetic steel or stainless steel. In other specific embodiments the susceptor comprises aluminium. Preferred susceptors may be formed from 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor such as material type, length, width, and thickness may all be altered to provide a desired power dissipation within a known electromagnetic field.

Preferably, the susceptors are heated to a temperature in excess of 250 degrees Celsius. However, preferably the susceptors are heated less than 350 degrees Celsius to prevent burning of material in contact with the susceptor. Suitable susceptors may comprise a non-metallic core with a metal layer disposed on the non-metallic core, for example metallic tracks formed on a surface of a ceramic core.

A susceptor may have a protective external layer, for example a protective ceramic layer or protective glass layer encapsulating the elongate susceptor. The susceptor may comprise a protective coating formed by a glass, a ceramic, or an inert metal, formed over a core of susceptor material.

Preferably, the susceptor is arranged in thermal contact with an aerosol forming substrate, for example within the tubular element. Thus, when the susceptor heats up, the aerosol-forming substrate is heated up and material is released from the gel to form an aerosol. Preferably the susceptor is arranged in direct physical contact with the gel comprising active agent, for example within the tubular element, the susceptor is preferably surrounded by the gel, or porous medium loaded with gel.

In specific embodiments, the aerosol-generating article, or the tubular element, comprises a single susceptor. Alternatively, in other specific embodiments, the tubular element, or the aerosol-generating article, comprises more than one susceptor.

Any of the features described herein in relation to a specific embodiment, aspect or example, of the tubular element, aerosol generating article or aerosol generating device, may be equally applicable to any embodiment of the tubular element, aerosol generating article or aerosol generating device.

Reference will now be made to the drawings, which depict one or more aspects described in this disclosure. However, it will be understood that other aspects not depicted in the drawings fall within the scope and of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

FIGS. 1 and 2 show an example of an aerosol generating article in use with an aerosol generating device. Suitable for use with the tubular elements of the present invention.

Figure 1:
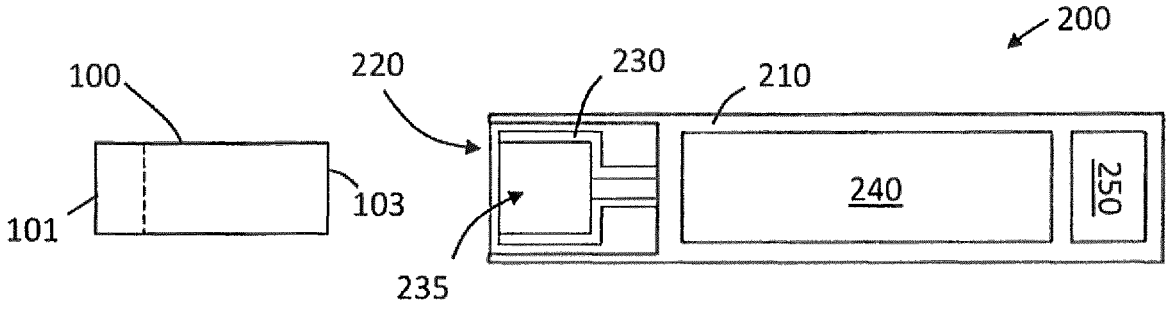
FIG. 1 is a schematic sectional view of an aerosol generating device and a schematic side view of an aerosol generating article that may be inserted into the aerosol generating device.

FIGS. 1 to 6 show a longitudinal cross-sectional cut away view of an aerosol generating articles 100. In other words the FIGS. 1 to 6 show a view of an aerosol generating article 100 cut in half longitudinally. In the FIGS. 1 to 6 embodiments the aerosol generating article is tubular. If one viewed a whole end face of the aerosol generating article 100 of FIGS. 1 to 6, either the proximal end 101 or distal end 103 it would be circular. The tubular element 500, if used or shown in the embodiments of FIGS. 1 to 6 is also tubular. The tubular element 500 is a, possible, tubular component of the tubular aerosol generating article 100 of the FIGS. 1 to 6 embodiments. If one viewed a whole end face of the tubular element 500, used in or shown in the FIGS. 1 to 6 embodiment, whether the proximal end or distal end, the face of the tubular element would be circular. As FIGS. 1 to 6 are a two dimensional longitudinal cross-sectional cut away view, the side curvature of the aerosol generating article and of the tubular element 600, among other components, cannot be seen. The drawings are for illustrative purposes to explain the invention and may not be to scale. The tubular element 500 if shown in FIGS. 1 to 6 is to illustrate the tubular element 500 in an aerosol generating article 100 but the features of the aerosol generating article 100 are optional to the embodiment shown of the tubular element 500 and should not be seen as essential features of the tubular element 500.

Figure 2:
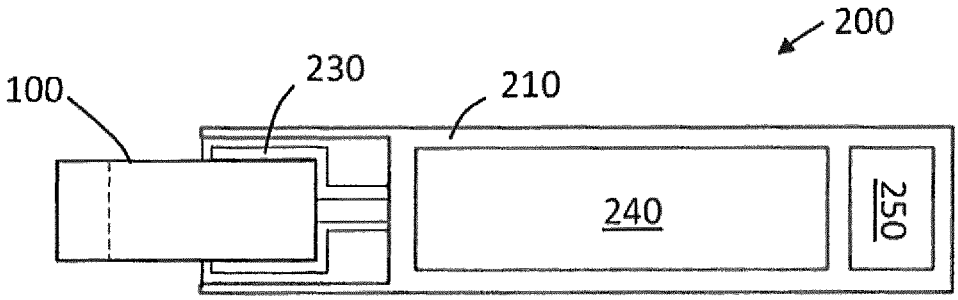
FIG. 2 is a schematic sectional view of the aerosol generating device depicted in FIG. 1 and a schematic side view of the article depicted in FIG. 1 inserted into the aerosol generating device.

FIGS. 1-2 illustrate an example of an aerosol generating article 100 and aerosol generating device 200. The aerosol generating article 100 has a proximal or mouth end 101 and a distal end 103. In FIG. 2, the distal end 103 of the aerosol generating article 100 is received in a receptacle 220 of the aerosol generating device 200. The aerosol generating device 200 includes a wrapper 110 defining the receptacle 220, which is configured to receive the aerosol generating article 100. The aerosol generating device 200 also includes a heating element 230 that forms a cavity 235 configured to receive the aerosol generating article 100, preferably by interference fit. The heating element 230 may comprise an electrically resistive heating component. In addition, the device 200 includes a power supply 240 and control electronics 250 that cooperate to control heating of heating element 230.

The heating element 230 may heat the distal end 103 of the aerosol generating article 100, which contains a tubular element 500 (not shown). In this example the tubular element 500 comprises a gel 124 comprising an active agent, and the active agent comprises nicotine. Heating of the aerosol generating article 100 causes the tubular element 500 comprising a gel 124 comprising an active agent to generate an aerosol containing the active agent, which can transfer out of the aerosol generating article 100 at the proximal end 101. The aerosol generating device 200 comprises a housing 210.

FIGS. 1-2 do not show the exact heating mechanism.

In some examples the heating mechanism could be by conduction heating where the heat is transferred from the heating element 230 of the aerosol generating device 200 to the aerosol generating article 100. This can take place easily when the aerosol generating article 100 is positioned in the receptacle 220 of the aerosol generating device 200 and the distal end 103 (which is preferably the end where the tubular element 500 comprising gel is located) and thus the aerosol generating article 100 is in contact with the heating element 230 of the aerosol generating device 200. In specific examples the heating element comprises a heating blade that protrudes from the aerosol generating device 200 and is suitable for penetrating into the aerosol generating article 100 to make direct contact with the gel 124 of the tubular element 500.

In this example the heating mechanism is by induction where the heating element emits radio-magnetic radiation which is absorbed by the tubular element when the aerosol generating article 100 is position in the receptacle 220 of the aerosol generating device 200.

Figure 3A:
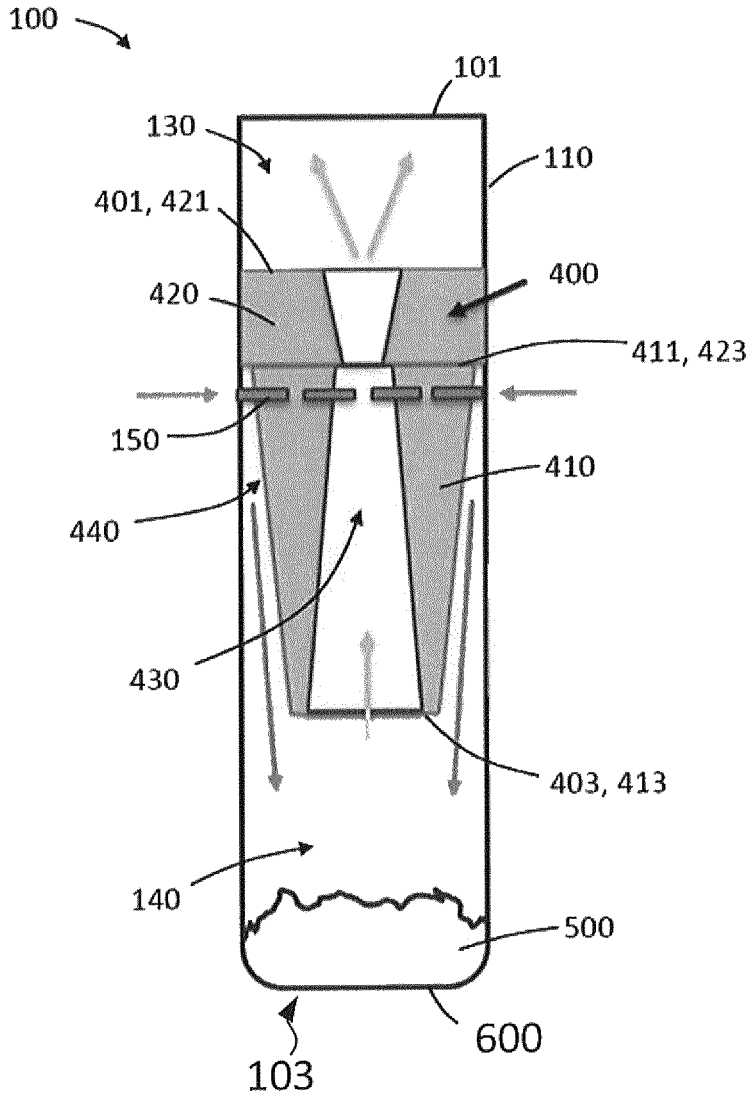
FIGS. 3-6 are schematic sectional views of various embodiments of aerosol generating articles.
Figure 3B:
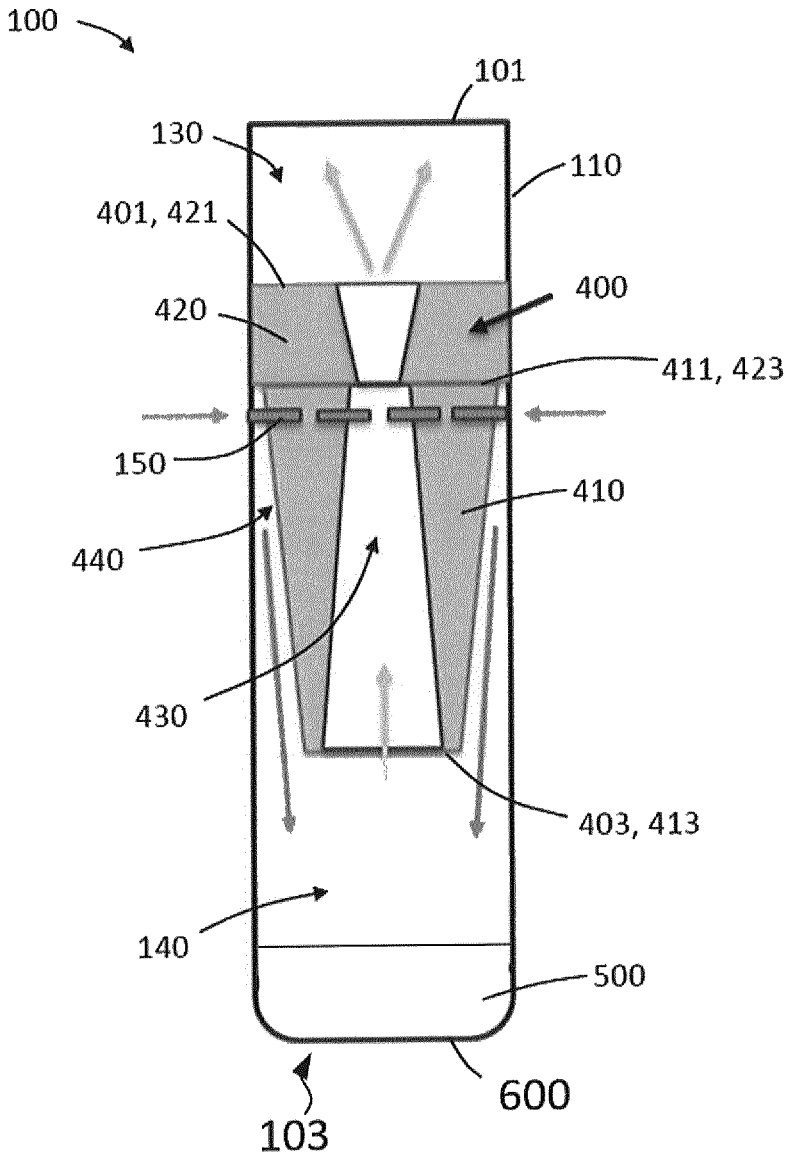

FIGS. 3*a* and 3*b* depicts an embodiment of an aerosol generating article 100 including a wrapper 110 and a fluid guide 400. FIGS. 3*a* and 3*b* are a longitudinal cross-sectional cut away view of an aerosol generating article 100. In other words the FIG. 3*a* and FIG. 3*b* view is of an aerosol generating article 100 cut in half longitudinally. In the FIG. 3*a* and FIG. 3*b* embodiment the aerosol generating article is tubular. If one viewed a whole end face of the aerosol generating article 100 of FIG. 3*a* or 3*b*, either the proximal end 101 or distal end 103 it would be circular. The tubular element 500 in FIG. 3*a* or FIG. 3*b* is also tubular. The tubular element 500 is a tubular component of the tubular aerosol generating article 100 of the FIG. 3*a* and FIG. 3*b* embodiments. If one viewed a whole end face of the tubular element 500 of the FIG. 3*a* or FIG. 3*b* embodiment, whether the proximal end or distal end, the face of the tubular element would be circular. As FIG. 3*a* and FIG. 3*b* are a two dimensional longitudinal cross-sectional cut away view, the side curvature of aerosol generating article and of the tubular element 600, among other components, cannot be seen. In FIG. 3*a* the proximal end of the tubular element 500 is not shown as a straight edge. FIG. 3*b* shows the proximal end of the tubular element 500 as a straight line across the width of the aerosol generating article. The drawings are for illustrative purposes to explain the invention and may not be to scale. The tubular element 500 is shown in FIG. 3*a* and FIG. 3*b* to illustrate the tubular element in an aerosol generating article but the features of the aerosol generating article 100 as optional to the embodiment shown of the tubular element and should not be seen as essential features of the tubular element 500.

The fluid guide 400 has a proximal end 401, a distal end 403 and an inner longitudinal passageway 430 from the distal end 403 to the proximal end 401. The inner longitudinal passageway 430 has a first portion 410 and a second portion 420. The first portion 410 defines a first portion of the passageway 430, which extends from the distal end 413 of the first portion 410 to the proximal end 411 of the first portion 410. The second portion 420 defines a second portion of the passageway 430, which extends from the distal end 423 of the second portion 420 to the proximal end 421 of the second portion 420. The first portion 410 of the passageway 430 has a constricted cross-sectional area moving from the distal end 413 to the proximal end 411 of the first portion 410 to cause fluid, for example air, to accelerate through this first portion 410 of the inner longitudinal passageway 430 when negative pressure is applied at the proximal end 101 of the aerosol generating article 100. The cross-sectional area of the first portion 410 of the inner longitudinal passageway 430 narrows from the distal end 413 to the proximal end 411 of the first portion 410. The second portion 420 of the inner longitudinal passageway 430 has an expanding cross-sectional area from the distal end 423 to the proximal end 421 of the second portion 420 of the fluid guide 400. In the second portion 420 of the inner longitudinal passageway 430, fluid may decelerate.

The wrapper 110 defines an open, proximal end 101 of the aerosol generating article 100 and a distal end 103. A tubular element 500 comprising gel comprising an active agent (not shown), is disposed in the distal end 103 of the aerosol generating article 100. The aerosol generating article 100 comprises an end plug 600 at its extreme distal end 103. The end plug 600 is positioned to the distal side of the tubular element 500. The end plug 600 comprises material of a high resistance to draw hence biasing fluid to enter the aerosol generating article 100 though the apertures 150 when a negative pressure is applied to the proximal end 101 of the aerosol generating article 100. Aerosol generated or released from the tubular element 500 comprising an active agent, when heated may enter the cavity 140 in the aerosol generating article downstream from the tubular element 500, to be carried through the inner longitudinal passageway 430.

Apertures 150 extend through the wrapper 110. At least one aperture 150 is in communication with an outer longitudinal passageway 440 formed between an outer surface of the fluid guide 400 and an inner surface of the wrapper 110. A seal is formed between the fluid guide 400 and the wrapper 110 at a location between the apertures 150 and the proximal end 101.

When a negative pressure is applied to the proximal end 101 of the aerosol generating article 100, fluid enters the apertures 150, flows through the outer longitudinal passageways 440 into the cavity 140 and to the tubular element 500 comprising a gel comprising an active agent, where the fluid may entrain aerosol when the tubular element 500 comprising a gel comprising an active agent, is heated. The fluid then flows through the inner longitudinal passageway 430, and through the proximal end 101 of the aerosol generating article 100. As fluid flows through the first portion 410 of the inner longitudinal passageway 430, the fluid accelerates. As fluid flows through the second portion of the inner longitudinal passageway 430, the fluid decelerates. In the depicted embodiment, the wrapper 110 defines a proximal cavity 130 between proximal end 401 of the fluid guide 400 and the proximal end 101 of the article 100, which could serve to decelerate the fluid prior to exiting the mouth end 101.

Figure 4:
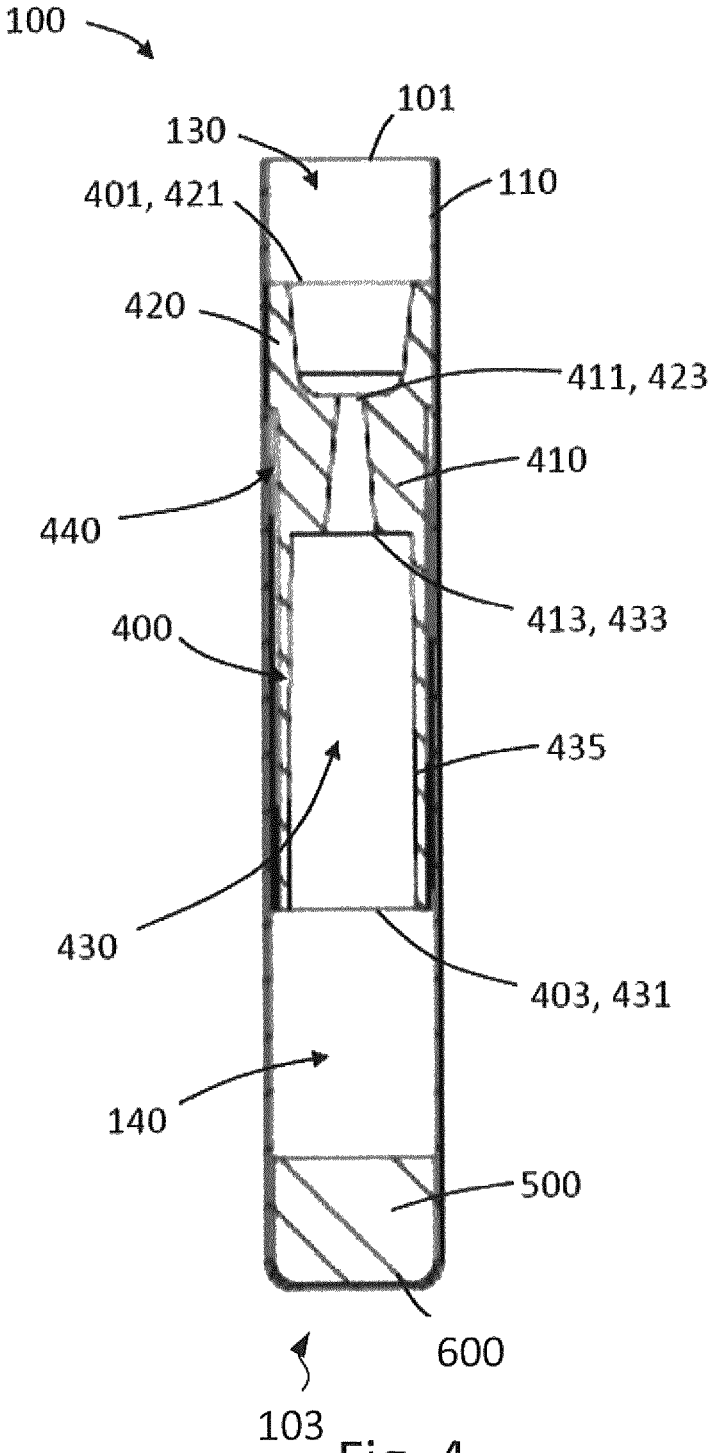

FIG. 4 depicts another embodiment of an aerosol generating article 100 including a wrapper 110 and a fluid guide 400.

The fluid guide 400 has a proximal end 401, a distal end 403 and an inner longitudinal passageway 430 from the distal end 403 to the proximal end 401. The inner longitudinal passageway 430 has a first portion 410, a second portion 420, and a third portion 435. The first portion 410 is between the second 420 and third 435 portions. The first portion 410 defines a first portion of the inner longitudinal passageway 430, which extends from the distal end 413 of the first portion 410 to the proximal end 411 of the first portion 410. The second portion 420 defines a second portion of the inner longitudinal passageway 430, which extends from the distal end 423 of the second portion 420 to the proximal end 421 of the second portion 420. The third portion 435 defines a third portion of the inner longitudinal passageway 430, which extends from the distal end 433 of the third portion to the proximal end 431 of the third portion. The third portion 435 has a substantially constant inner diameter from the proximal end 431 to the distal end 433. The first portion 410 of the inner longitudinal passageway 430 has a constricted cross-sectional area moving from the distal end 413 to the proximal end 411, of the first portion 410, to cause fluid to accelerate through this first portion 410 of the inner longitudinal passageway 430 when a negative pressure is applied at the proximal end 101 of the aerosol generating article 100. The cross-sectional area of the first portion 410 of the inner longitudinal passageway 430 narrows from the distal end 413 to the proximal end 411, of the first portion 410. The second portion 420 of the inner longitudinal passageway 430 has an expanding cross-sectional area from the distal end 423 to the proximal end 421 of the second portion 420 of the inner fluid passageway 430.

In the second portion 420 of the inner longitudinal passageway 430, fluid may decelerate as it travels distal to proximal in direction.

Like the article 100 depicted in FIG. 3, the article depicted in FIG. 4 includes a wrapper 110 that defines an open, proximal end 101 and a distal end 103, with an end plug 600 of a high resistance to draw. A tubular element 500 comprising a gel comprising an active agent, is disposed in the distal end 103 of the aerosol generating article. Aerosol released from the gel comprising an active agent, when heated may enter the cavity 140 in the aerosol generating article 110, to be carried through the inner longitudinal passageway 430.

While not shown in FIG. 4, the aerosol generating article 100 includes at least one aperture (such as apertures 150 shown in FIG. 3) that extends through the wrapper 110 and is in communication with an outer longitudinal passageway 440 formed between an outer surface of the fluid guide 400 and an inner surface of the wrapper 110. A seal is formed between the fluid guide 400 and the wrapper 110 at a location between the apertures and the proximal end 101. Although the seal need not be fluid impermeable, it is advantageous that the seal here does have a high resistance to draw or some degree of impermeability, to bias the fluid entering the apertures 150 along the outer longitudinal passageways in the distal direction towards the tubular element 500. The third portion 435 of the fluid guide 400 extends the length of the fluid guide 400 and outer longitudinal passageway 440 to provide additional distance between the apertures (not shown in FIG. 4, which may be located in proximity to a proximal end 401 of the inner longitudinal passageway) and the tubular element 500 comprising a gel comprising an active agent, so that leakage of the gel comprising an active agent, through the apertures 150 is not likely.

When a negative pressure is applied at the proximal end 101 of the aerosol generating article 100 depicted in FIG. 4, fluid enters the apertures 150, flows through the outer longitudinal passageway 440 into the cavity 140 and to the tubular element 500 comprising gel comprising an active agent, where the fluid may entrain material from the gel comprising an active agent is heated. The fluid may then flow through the inner longitudinal passageway 430, and through the proximal end 101 of the aerosol generating article. As fluid flows through the inner longitudinal passageway 430, the fluid flows through the third portion 435, the first portion 410, and then the second portion 420 of the aerosol generating article 100. As fluid flows through the first portion 410 of the inner longitudinal passageway 430, the fluid accelerates. As fluid flows through the second portion 420 of the inner longitudinal passageway 430, the fluid decelerates. In alternative specific embodiments the second portion 420 and third portion 435 of the inner longitudinal passageway 430 are optional. In the depicted embodiment, the wrapper defines a proximal cavity 130 between proximal end 401 of the fluid guide 400 and the proximal end 101 of the article 100, which could serve to decelerate the fluid prior to exiting the proximal end 101.

Figure 5:
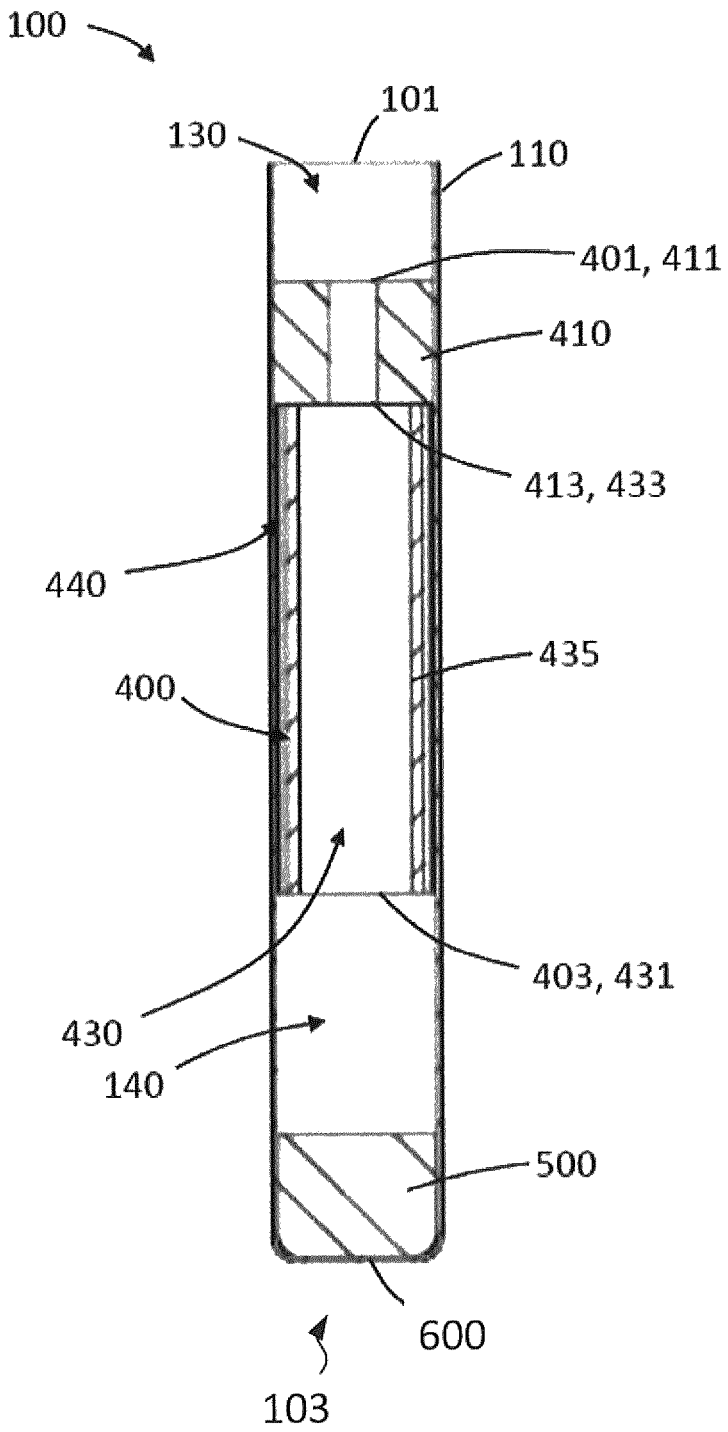
Figure 6:
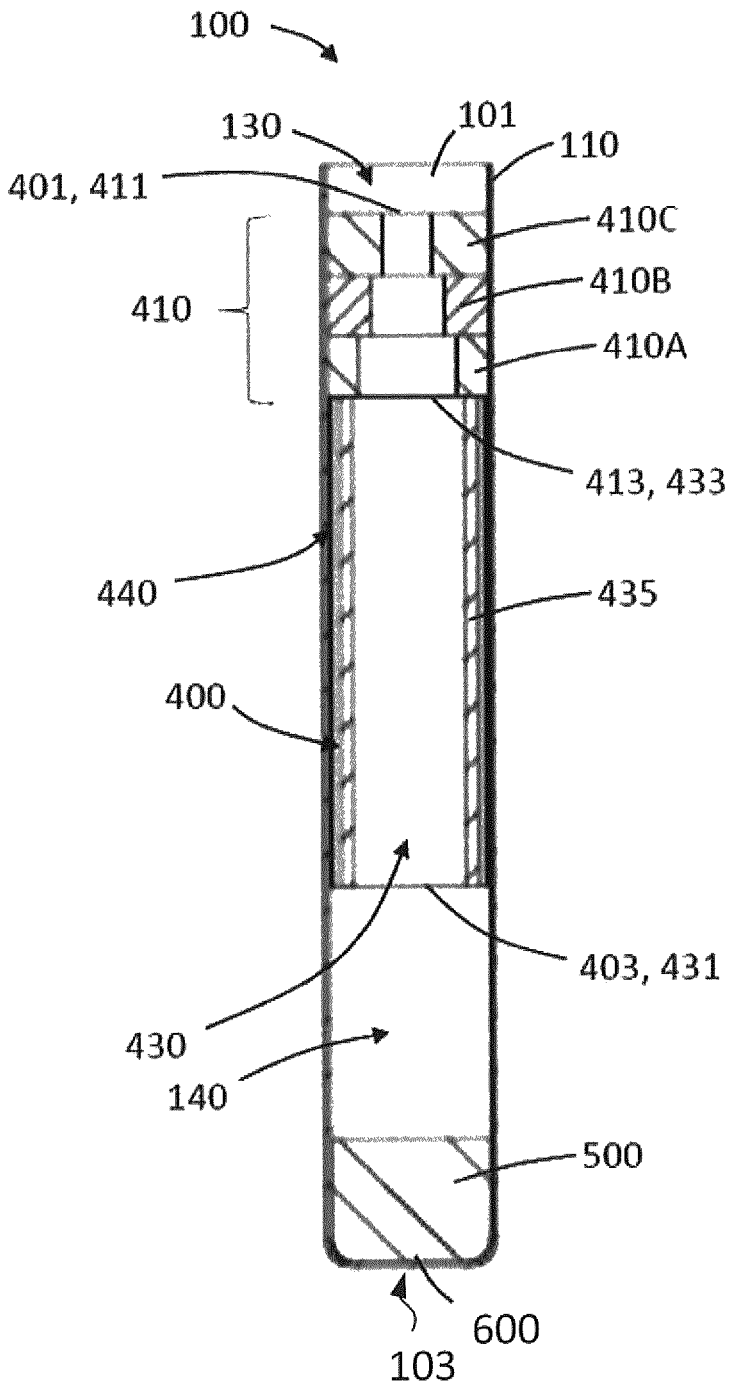

FIG. 5 and FIG. 6 depict additional embodiments of aerosol generating articles 100 that include a wrapper 110, an end plug 600, a tubular element 500 that comprises a gel comprising an active agent, a proximal cavity 130, a cavity 140, and a fluid guide 400. The fluid guide 400 has a proximal end 401, a distal end 403 and an inner longitudinal passageway 430 from the distal end 403 to the proximal end 401. The inner longitudinal passageway 430 has a first portion 410 and a third portion 435. The first portion 410 defines a first portion 410 of the inner longitudinal passageway 430, which extends from the distal end 413 of the first portion 410 to the proximal end 411 of the first portion 410. The third portion 435 defines a third portion of the inner longitudinal passageway 430, which extends from the proximal end 433 of the third portion 435 to the distal end 431 of the third portion 435. The third portion 435 has a substantially constant inner diameter from the proximal end 433 to the distal end 431.

In FIG. 5, the first portion 410 of the inner longitudinal passageway 430 has a substantially constant inner diameter from the distal end 413 to the proximal end 411 of the first portion 410. The inner diameter of the inner longitudinal passageway 430 at the first portion 410 is smaller than the inner diameter of the inner longitudinal passageway 430 at the third portion 435. The restricted inner diameter of the inner longitudinal passageway 430 at the first portion 410, relative to at the third portion 435, may cause fluid to accelerate as it flows from the third portion 435 to the first portion 410.

In FIG. 6, the first portion 410 of the fluid guide 400 includes multiple segments 410A, 410B, 410C, with stepped internal diameters. The most distal segment 410A has the largest inner diameter, and the most proximal segment 410C has the smallest inner diameter. As fluid flows through the inner longitudinal passageway 430 from the first segment 410A to the second segment 401B and from the second segment 410B to the third segment 410C, the fluid may accelerate as the inner longitudinal passageway 430 cross-sectional area constricts in a stepped manner.

The first portions 410 in FIG. 5 and FIG. 6 provide examples of a construction that may be beneficial when the material employed to form the first portion 410 is not readily moldable. For example, the first portion 410 or the segments 410A, 410B, 410C of the first portion 410 may be formed from cellulose acetate tow. In contrast, the first portions 410 of the fluid guide 400 depicted in FIG. 3 and FIG. 4 provide examples of construction that may be beneficial when the material employed to form the first portion 410 is moldable, such as when the first portion is formed from, for example, polyether ether ketone (PEEK).

Like the aerosol generating article 100 depicted in FIG. 3 and FIG. 4, the aerosol generating articles depicted in FIG. 5 and FIG. 6 include a wrapper 110 that defines an open, proximal end 101 and a distal end 103 with an end plug 600, the end plug 600 having a high resistance to draw. A tubular element 500, in these examples, comprising gel 124 comprising an active agent, is disposed in the distal end 103 of the aerosol generating article 100. Aerosol released from the tubular element 500 comprising gel 124 comprising an active agent when heated may enter the cavity 140 in the aerosol generating article 100 to be carried through the inner longitudinal passageway 430.

While not shown in FIG. 5 and FIG. 6, the aerosol generating article 100 includes at least one aperture (such as apertures 150 shown in FIG. 3) that extends through the wrapper 110 and is in communication with an outer longitudinal passageway 440 formed between an outer surface of the fluid guide 400 and an inner surface of the wrapper 110. A seal is formed between the fluid guide 400 and the wrapper 110 at a location between the aperture or apertures 150 and the proximal end 101. This helps to bias the fluid entering through the apertures 150 along the outer longitudinal passageways 440 in the tubular element 500 or distal direction. The third portion 435 of the inner longitudinal passageway 430, among other things, serves to extend the length of the fluid guide 400 and outer longitudinal passageway 440 to provide additional distance between the apertures 150 (not shown in FIG. 5 and FIG. 6, which may be located in proximity to a proximal end of the outer longitudinal passageway 440) and the tubular element 500 comprising gel 124 comprising an active agent so that leakage of the gel 124 comprising an active agent through the apertures 150 is not likely.

When a negative pressure is applied at the proximal end 101 of the aerosol generating article 100 depicted in FIG. 5 and FIG. 6, fluid enters the apertures 150, flows through the outer longitudinal passageway 440 into the cavity 140 to the tubular element 500 comprising gel 124 comprising an active agent, where the fluid may entrain material from the gel when the tubular element 500 is heated. The fluid may then flow through the inner longitudinal passageway 430, and through the proximal end 101. As fluid flows through the inner longitudinal passageway 430, the fluid flows through the third portion 435 and then the first portion 410 of the aerosol generating article 100. As fluid flows into the first portion 410 of the inner longitudinal passageway 430, the inner longitudinal passageway 430 may accelerate because the inner diameter of the inner longitudinal passageway 430 at the first portion 410 is less than at the third portion 435. In the aerosol generating article 100 depicted in FIG. 6, the fluid may accelerate as it passes each segment 410A, 410B, 410C of the first portion 410.

In the embodiments depicted in FIG. 4 and FIG. 5, the wrapper defines a cavity 130 between the proximal end 401 of the fluid guide 400 and the proximal end 101 of the aerosol generating article 100, which could serve to decelerate the fluid that exits the inner longitudinal passageway 430 at the proximal end 401 of the fluid guide 400 prior to exiting the proximal end 101.

Figure 7:
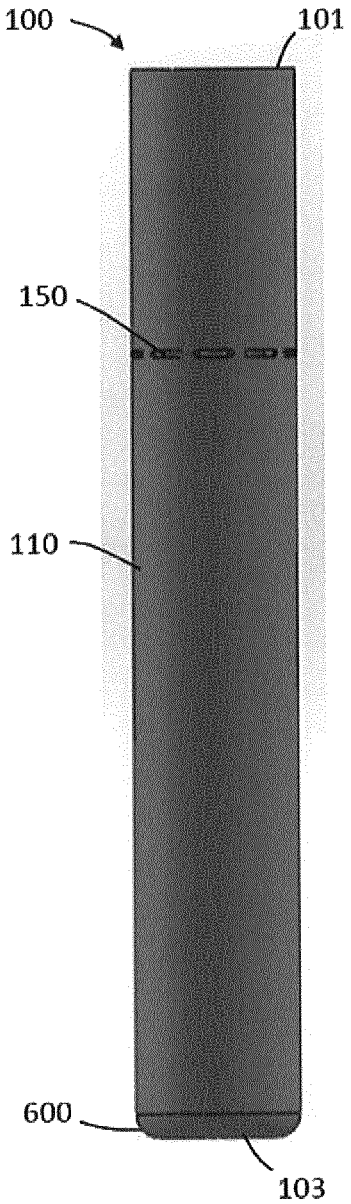
FIG. 7 is a schematic side view of an aerosol generating article.
Figure 8:
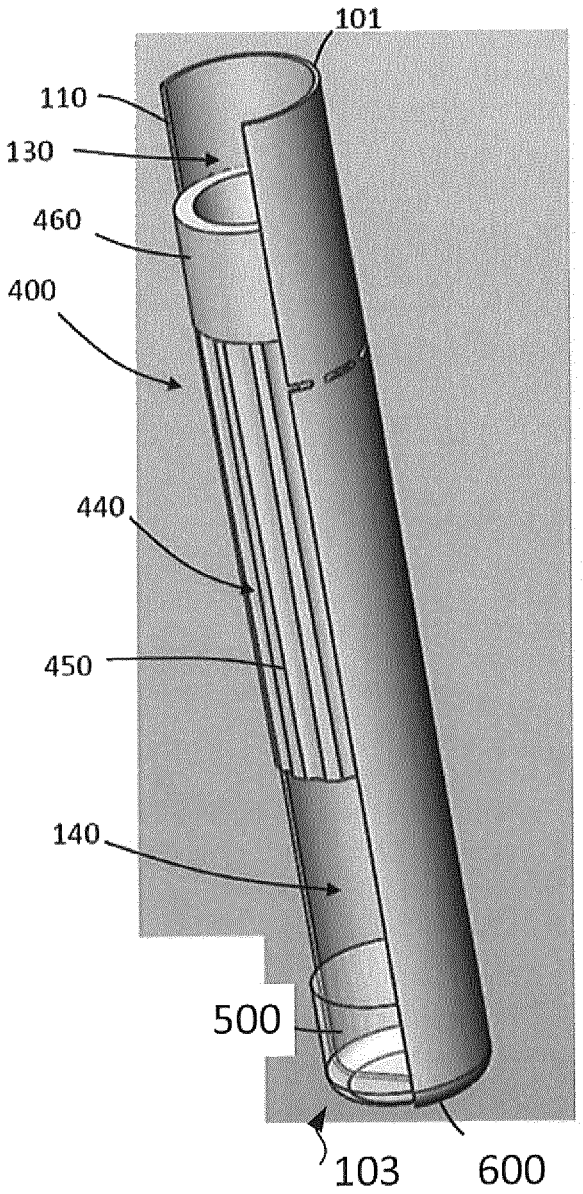
FIG. 8 is a schematic perspective view of an embodiment of the aerosol generating article depicted in FIG. 7 in which a section of the wrapper is removed for illustrative purposes.

FIGS. 7-8 illustrate an embodiment of an aerosol generating article 100. The aerosol generating article 100 includes a wrapper 110 and apertures 150 through the wrapper 110. The aerosol generating article includes an end plug 600 that forms the distal end 103 of the aerosol generating article 100. The end plug has a high resistance to draw. A tubular element 500 comprising gel comprising an active agent, is disposed on the proximal side of the end plug 600, in the aerosol generating article 100. When heated, the tubular element 500 may form an aerosol that enters a cavity 140 to the proximal side of the tubular element 500.

FIG. 7 shows a side view of a tubular aerosol generating article 100. If one were to view a face of either the proximal end 101 or the distal end 103, the end face would be circular. FIG. 7 is a two dimensional drawing and thus the curvature of the tubular aerosol generating article cannot be seen. FIG. 8 is a partially cut away perspective view of the same embodiment as shown and described by FIG. 7. It can be seen that the face of the distal end, although partly blocked is circular. It can be seen that the face of the proximal end 101, although partly cut away will also be circular. Also from FIG. 8 it can be seen that the tubular element 500 is tubular in shape. Also from FIG. 8 it can be seen that the end cap 600 is also tubular in shape, for this embodiment.

At least one of the apertures 150 is in communication with at least one outer longitudinal passageway 440 formed between the fluid guide 400 and the wrapper 110 and between sidewalls 450. The fluid guide 400 has a rim 460 that presses against an inner surface of the wrapper 110 to form a seal. The seal is formed between the proximal end 101 and the apertures 150.

When a negative pressure is applied at the proximal end 101, fluid, for example air, may enter the apertures 150, and flow through the outer longitudinal passageways 440 to the cavity 140, and then through the tubular element 500 where material from the gel 124 is released into the fluid. The fluid then travels through the inner longitudinal passageway 430 through the fluid guide 400, into cavity 130 defined by the wrapper 110, and through (and exit) the proximal end 101 of the aerosol generating article 100. The inner longitudinal passageway 430 of the fluid guide 400 may be configured in any suitable manner, such as examples shown in FIGS. 3-6.

Figure 9:
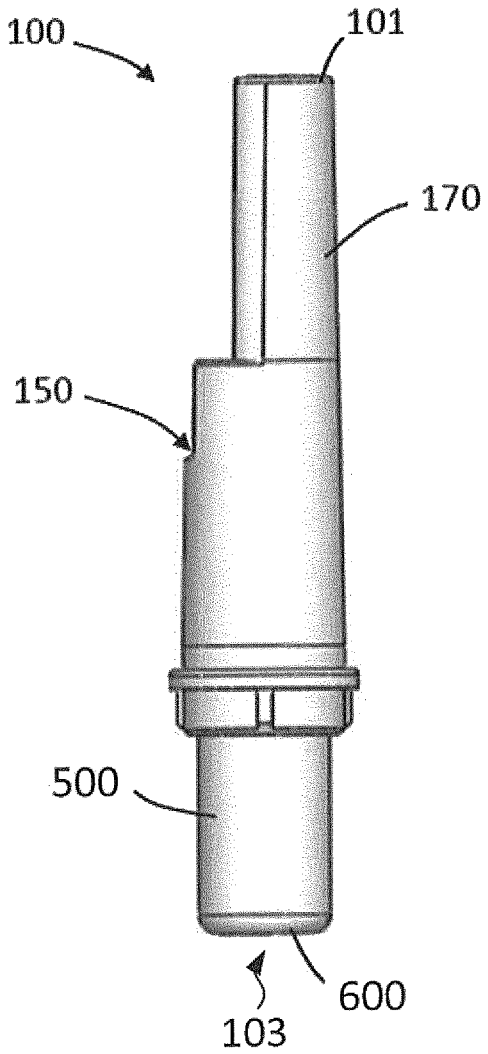
FIG. 9 is a schematic side view of an aerosol generating article.
Figure 10:
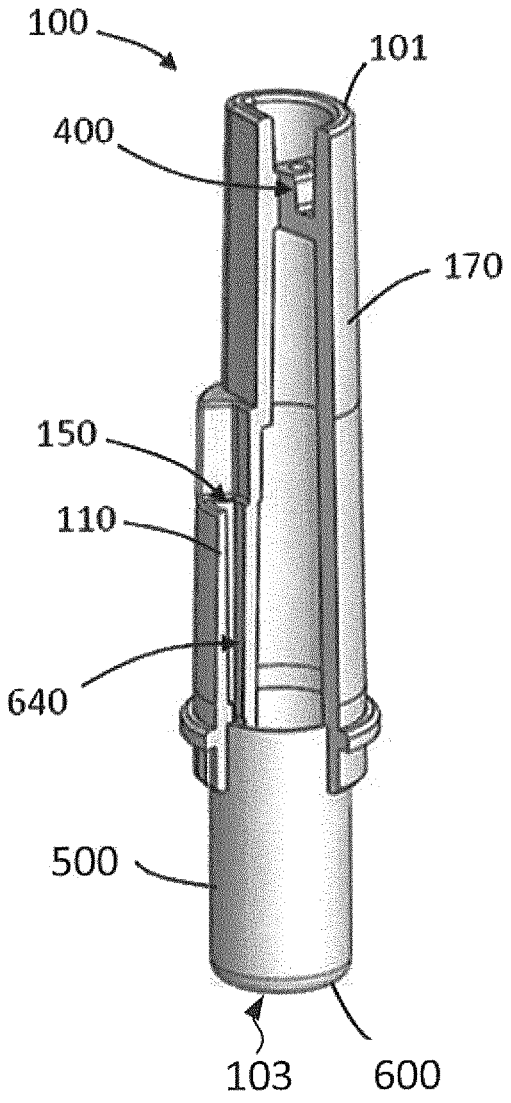
FIG. 10 is a schematic side view of an embodiment of the aerosol generating article depicted in FIG. 9 with a portion of wrapper removed.

FIGS. 9-10 illustrate an embodiment of an aerosol generating article 100 that includes a mouthpiece 170 that forms a portion of the wrapper 110 and the fluid guide 400 of the aerosol generating article 100. The aerosol generating article 100 include a tubular element 500 that forms the distal end 103 of the aerosol generating article 100 and is also formed by a portion of the wrapper 110. The tubular element 500 is configured to be received by a distal portion of the mouthpiece 170, such as by interference fit. The tubular element comprising gel 124 comprising an active agent (not shown) may be disposed in the distal end 103. The aerosol generating article 100 comprises an end plug 600 at the extreme distal end 103. The end plug 600 has a high resistance to draw.

FIG. 9 shows part of a cut away side view of a tubular aerosol generating article 100. If one were to view a whole face of either the proximal end 101 or the distal end 103, the end face would be circular. FIG. 9 is a two dimensional drawing and thus the curvature of the tubular aerosol generating article cannot be seen. FIG. 10 is a partially cut away perspective view of the same partly cut away, part of an aerosol generating article 100 as shown and described by FIG. 9. It can be seen that the face of the distal end, although partly blocked is circular. It can be seen that the face of the proximal end 101, although partly cut away will also be circular. Also from FIG. 10 it can be seen that the tubular element 500 is tubular in shape. Also from FIG. 10 it can be seen that the end cap 600 is also tubular in shape, for this embodiment.

The fluid guide 400 includes an inner longitudinal passageway 430 (not shown) that includes a portion that accelerates fluid, and, may include a portion that decelerates fluid. A seal is formed between the wrapper 110 and the fluid guide 400 because the wrapper 110 and the fluid guide 400 are formed from a single part. An aperture 150 is formed in the wrapper 110 and is in communication with an outer longitudinal passageway 640 that is formed at least in part by an inner surface of the wrapper 110. Part of the outer longitudinal passageway 640 is generally formed between the inner surface of the wrapper 110 and an exterior of the fluid guide 400. The outer longitudinal passageway 640 extends less than the full distance around the article 100. In this embodiment, the outer longitudinal passageway 640 extends around 50 percent of the distance around the circumference of the aerosol generating article 100. The outer longitudinal passageway 640 directs fluid, for example air, from the aperture 150 towards the tubular element 500 (not shown) in proximity of the distal end 103.

When a negative pressure is applied at the proximal end 101, fluid, for example ambient air, enters the aerosol generating article 100 through the aperture 150. The fluid flows through the outer longitudinal passageway 640 towards a tubular element 500, comprising gel 124 comprising an active agent, disposed at the distal end 103. The fluid then flows through an inner longitudinal passageway 430 of the fluid guide 400, where the fluid is accelerated and optionally decelerated. The fluid, for example air, may then exit the proximal end 101 of the aerosol generating article 100.

Figure 11:
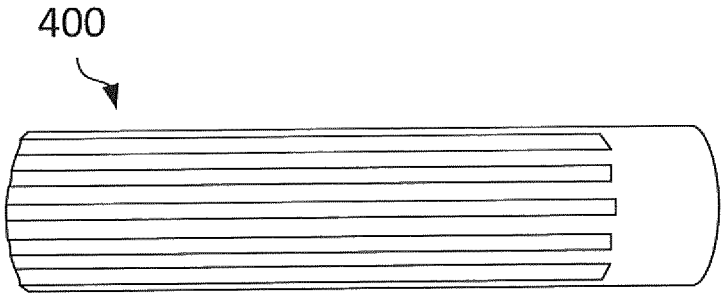
FIG. 11 is a schematic view of a fluid guide of a sample aerosol generating article.

FIG. 11 is an illustration of a fluid guide 400 formed from polyetheretherketone (PEEK) material by computer numeric control (CNC) machining. The fluid guide 400 depicted in FIG. 11 has a length of 25 millimetres, an outer diameter at the proximal end of 6.64 millimetres, and an outer diameter at the distal end of 6.29 millimetres. The outer diameter at the distal end is the diameter of the distal end from the base of the sidewalls. The fluid guide 400 has 12 outer longitudinal passageways 640 formed around its exterior surface, each sidewall having a substantially semi-circular transverse cross-sectional area. The outer longitudinal passageways 640 have a radius of 0.75 millimetres and a length of 20 millimetres. The fluid guide 400 has an inner longitudinal passageway 430 (not shown) comprising three portions, a first portion (a fluid accelerating portion) a second portion (fluid decelerating portion) downstream or proximal to the first portion and a third portion upstream or distal to the first portion. The third portion of the inner longitudinal passageway 430 of the fluid guide 400 extends from the distal end 103 of the aerosol generating article 100 and has an inner diameter at the distal end of 5.09 millimetres, which tapers down to a diameter of 4.83 millimetres at a proximal end of the first portion of the inner longitudinal passageway 430. The length of the first portion of the inner longitudinal passageway is 15 millimetres. The first portion of the inner longitudinal passageway 430 extends from a distal end at the proximal end of the third portion to a proximal end. The first portion of the inner longitudinal passageway 430 has an inner diameter of 2 millimetres at its distal end, which constricts to 1 millimetre at the proximal end. The length of the first portion of the inner longitudinal passageway is 5.5 millimetres. The second portion of the inner longitudinal passageway 430 extends from a distal end at the proximal end of the first portion to a proximal end at the proximal end of the article. The second portion of the inner longitudinal passageway 430 has an inner diameter of 1 millimetre at its distal end, which is the same as the inner diameter at the proximal end of the first portion. The inner diameter of the second portion increases at a decreasing rate (in a curve) to the proximal end, which has an inner diameter of 5 millimetres. The length of the second portion is 4.5 millimetres. Accordingly, fluid drawn through the interior passageway of the fluid guide, from the distal end to the proximal end, encounters a chamber with a substantially constant inner diameter (the third portion), a constricted section configured to accelerate the fluid (the first portion), and an expanded section configured to decelerate the fluid (the second portion). It has been found that providing such an inner longitudinal passageway 430 for the aerosol released from the heated tubular element 500 (not shown) may enable aerosol volume and droplet size to be controlled such that a satisfactory aerosol is released. FIG. 11 is a side view of a tubular shaped fluid guide 400. The FIG. 11 is a two dimensional drawing and therefore the curvature of the tubular shape, of the fluid guide 400, in this embodiment, cannot be seen. If one were to view an end face of the fluid guide 400, of this embodiment, the face would be circular.

Figure 12:
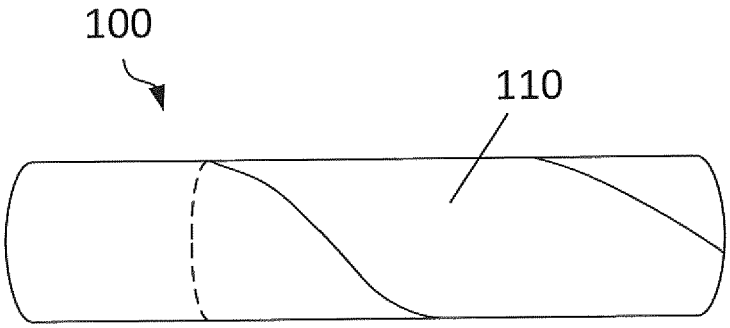
FIG. 12 is a schematic view of sample aerosol generating article in which the fluid guide depicted in FIG. 11 is inserted.

FIG. 12 is an illustration of an assembled aerosol generating article 100. The aerosol generating article 100 includes a wrapper 110 into which the fluid guide 400 of FIG. 11 is inserted. The wrapper depicted in FIG. 12 is generally a cylindrical paper tube having a length of 45 millimetres. One end of the wrapper 110 is distal to provide the distal end of the wrapper for holding the tubular element 500 (not shown). The proximal portion of the exterior of the fluid guide 400, above the outer longitudinal passageways, has a diameter of 6.64 millimetres. This diameter is substantially identical to the inner diameter of the wrapper, such that an interference fit seal may be formed between the proximal portion of the exterior of the fluid guide 400 and the interior of the wrapper 110. The distal portion of the exterior of the fluid guide 400, extending the length of the outer longitudinal passageways, may have a diameter that is slightly less than the diameter of the proximal portion of the exterior of the fluid guide 400, such that the fluid guide may be easily inserted into the wrapper 110 up to the proximal portion of the exterior, where the interference fit is made. FIG. 12 is a side view of an aerosol generating article 100. The FIG. 12 is a two dimensional drawing and therefore the curvature of the tubular shape, of the aerosol generating article 100, in this embodiment, cannot be seen. If one were to view an end face of the aerosol generating article 100, of this embodiment, the face would be circular.

Figure 13:
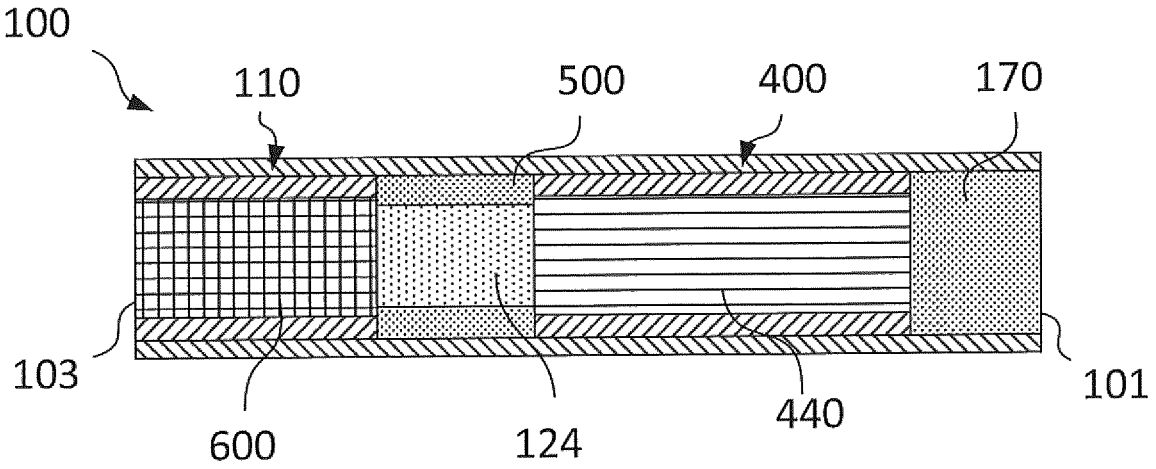
FIG. 13 shows a cross-sectional view, sectioned along the length of an aerosol generating article.
Figure 14:
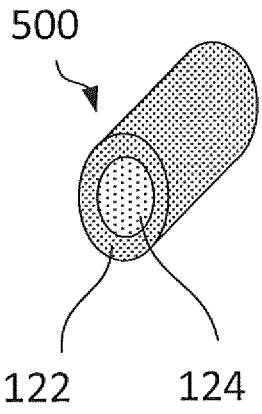
FIGS. 14, 15 and 16 show a perspective view and two cross-sectional views of a tubular element for an aerosol generating article.
Figure 15:
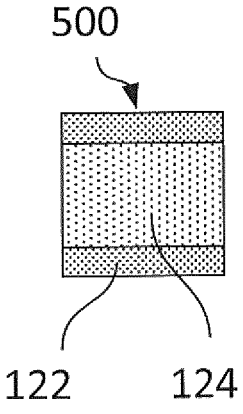
Figure 16:
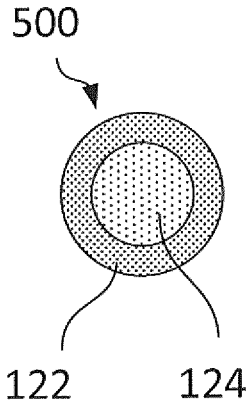

FIG. 13 illustrates an aerosol generating article 100 manufactured with a tubular element 500 comprising gel 124 which is illustrated further in FIGS. 14, 15 and 16. FIG. 13 is a longitudinal cross-section, cut away, view of an aerosol generating article 100. The FIG. 13 is a two dimensional drawing and therefore the curvature of the tubular shape, of the fluid guide 100, and its components, for example, the tubular element 500, in this embodiment, cannot be seen. If one were to view a whole end face of the aerosol generating article 100, of this embodiment, the face would be circular. Likewise, if one were to view a whole end face of the tubular element 500, of this embodiment, the face would be circular.

The aerosol generating article 100, of FIG. 13, comprises four elements arranged in coaxial alignment: at the distal end 103 an end plug 600 of high Resistance to Draw (RTD), a tubular element 500 which comprises gel 124, a fluid guide 400 and a mouthpiece 170 at the proximal end 101. These four elements are arranged sequentially and are circumscribed by a wrapper 110 to form the aerosol generating article 100. (In a similar but alternative embodiment there is a cavity 140 between the fluid guide 400 and the tubular element 500.) The aerosol-generating article 100 has a proximal or mouth end 101, and a distal end 103 located at the opposite end of the aerosol-generating article 100 from the proximal end 101. Not all components of the tubular element 500 are necessarily shown or labelled in FIG. 13.

In use, fluid, for example air, is drawn through the aerosol generating article 100, via the apertures 150 (not shown but similar to those described for the examples of FIGS. 1 to 10) when a negative pressure is applied at proximal end 101.

The end plug 600 is located at the extreme distal 103 end of the aerosol generating article 100.

In this example the tubular element 500 is located immediately downstream of the end plug 600 and abuts the end plug 600.

In FIG. 9, a distal end portion of the outer wrapper 110 of the aerosol generating article 100 is circumscribed by a band of tipping paper (not shown).

As is illustrated further in FIGS. 14, 15 and 16, the tubular element 500 is a cellulose acetate tube 122 containing gel 124 in the core, for example the core is filled with gel 124. In this example gel 124 comprises an active, the active agent is nicotine and an aerosol former. Other examples similar to this example comprise different active agents, or none. Not all components of the tubular element 500 of FIGS. 14, 15 and 16 are necessarily shown or labelled.

FIG. 14 shows a perspective view of the tubular element 500, FIG. 15 shows a cross-sectional view coplanar with the central axis of the tubular element 500, and FIG. 16 shows a cross-sectional view perpendicular to the central axis.

The tubular element 500 is located in the aerosol generating article 100 (FIG. 13) at the distal end 103 of the aerosol generating article 100 so that tubular element 500 can be penetrated by a heating element of an aerosol generating device 200, the heating element in this example penetrates through the end plug 600 (at the extreme distal end 103 of the aerosol generating article 100) to contact the tubular element 500, which comprises gel 124. Thus, the heating element contacts the gel 124 or is in close proximity to the gel 124. FIG. 16 shows an end face of a tubular element 500.

The gel 124 comprises an active agent that is released into the fluid, for example air, flowing from apertures 150 along outer longitudinal passageways (not shown) in the fluid guide 400 to the tubular element 500 near the distal end 103, then to the proximal end 101 via the inner longitudinal passageway 430 (not shown). In this illustrated example the active agent is nicotine. Optionally the gel 124 further comprises a flavour, for example, menthol.

The tubular element 500 may additionally comprise a plasticizer.

The fluid guide 400 is located immediately downstream of the tubular element 500 and abuts the tubular element 500. (In a similar but alternative specific example, for example FIG. 24, there is cavity between the fluid guide 400 and the tubular element 500, thus the fluid guide does not contact the tubular element). In use, material released from the tubular element 500 comprising gel 124, passes along the fluid guide 400 towards the proximal end 101 of the aerosol generating article 100.

In the example of FIG. 13 the mouthpiece 170 is located immediately downstream of the fluid guide 400 and abuts the fluid guide 400. In the example of FIG. 13, the mouthpiece 170 comprises a conventional cellulose acetate tow filter of low filtration efficiency.

To assemble the aerosol-generating article 100, the four elements described above are aligned and wrapped within the outer wrapper 110. In FIG. 13, the outer wrapper is a conventional cigarette paper.

Figure 17:
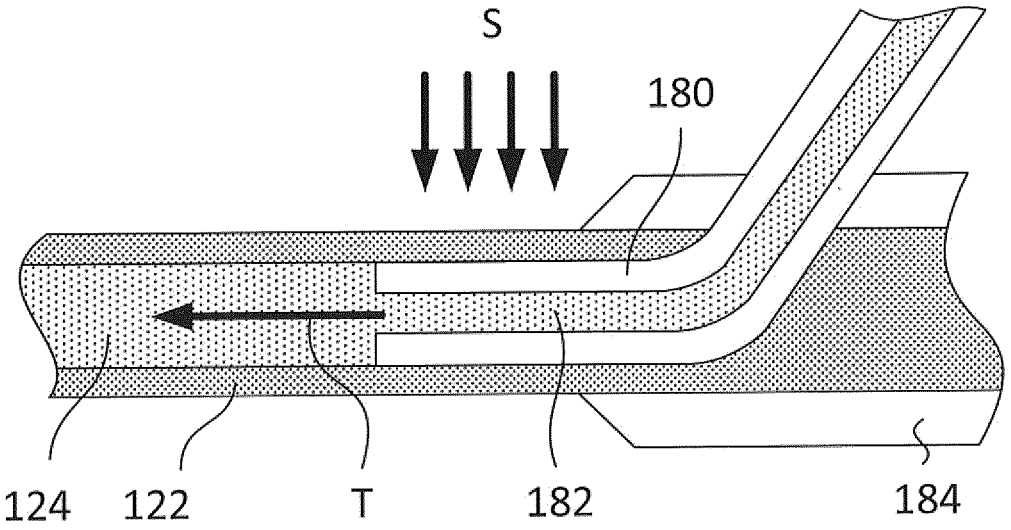
FIG. 17 shows part of a manufacturing process for the tubular element for an aerosol generating article.

The tubular element 500 may be formed by an extrusion process, for example as illustrated in FIG. 17. The cellulose acetate 122 longitudinal sides of the tubular element 500 may be formed by extruding a cellulose acetate material along a die 184 and around a mandrel 180 that projects rearwardly with respect to the direction of travel T of the extruded cellulose acetate material. The rearward projection of the mandrel 180 is shaped like a pin and is a cylindrical member having an external diameter of 3 millimetres to 7 millimetres, with a length of 55 millimetres to 100 millimetres. (To assist explanation, it is not illustrated to scale in the figures).

The cellulose acetate material 122, in this example, is thermoset, by exposure to steam S, which be at a pressure of greater than 1 bar.

The mandrel 180 is provided with a conduit 182, along which the gel 124 is extruded into the core of the set cellulose acetate material 122 that forms the longitudinal sides of the tubular element 500 in this example. In other examples the cellulose acetate material 122 is thermoset prior to extruding the gel 124 into the core of the of cellulose acetate material 122.

The composite cylindrical rod is cut into lengths, to form the individual tubular elements 500.

The composite cylindrical rod is formed by a hot extrusion process in this example. The composite cylindrical rod is allowed to cool, or subject to a cooling process, prior to processing into lengths. Alternatively, in other examples the composite cylindrical rod may be formed by a cold extrusion process.

In the illustrated tubular elements 500 of this example, the cellulose acetate 122 is shown as the longitudinal sides of the tubular element 500 with a core, the core to be filled with gel 124. However, alternatively in other examples, the cellulose acetate 122 longitudinal sides may have any shape, with a core (or more than one core) for receiving the gel 124 that extends generally along the tubular rod. In alternative specific examples the core is filled with porous medium loaded with gel 125.

In the present example the celluloses acetate 122 longitudinal sides, of the tubular element have a minimum thickness of 0.6 millimetres.

In the manufacturing process illustrated in FIG. 17, the gel 124 is extruded continuously.

Figure 18:
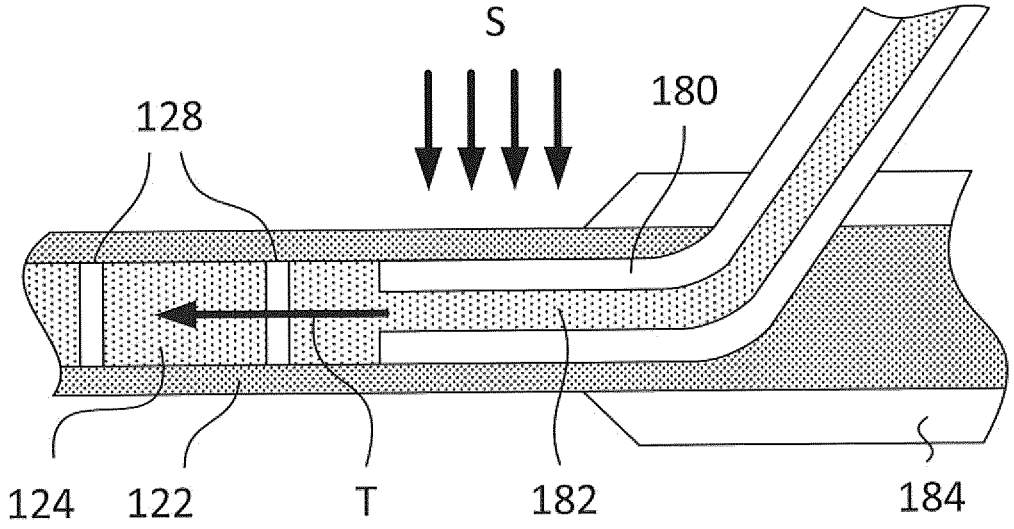
FIG. 18 shows part of a further manufacturing process for the tubular element for an aerosol generating article.

In the alternative example as illustrated in FIG. 18, the gel 124 may be extruded in bursts, separated by gaps 128, as shown in FIG. 18. In alternative specific examples the porous medium loaded with gel 125 is extruded in bursts, to have separating gaps in the core of the tubular rod.

The gel 124 may be heated above room temperature before injection into the mandrel 180. The mandrel 180 may be thermally conductive (for example, a metal mandrel), and some externally applied heat (for example, from the steam S) applied to thermoset the cellulose acetate. This may transfer heat energy to the gel, heating the gel may reduce its viscosity and facilitate its extrusion.

Figure 19:
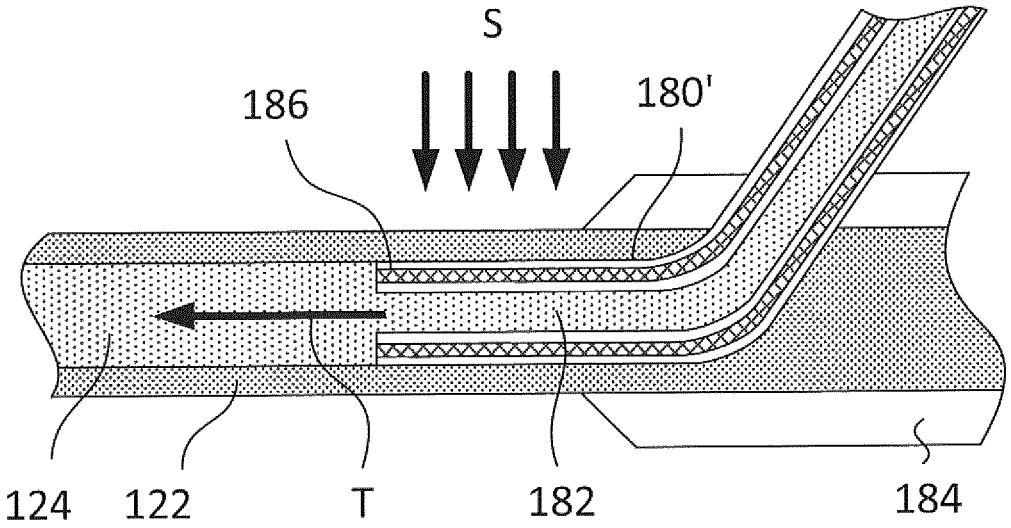
FIG. 19 shows part of an alternative manufacturing process for the tubular element for an aerosol generating article.

In an alternative specific example as illustrated in FIG. 19, the mandrel 180 is configured to reduce heating of the gel 124 prior to extrusion. In some of these specific examples the mandrel 180 is formed from a substantially thermally insulating material. Alternatively, or additionally, the mandrel 180 is cooled, for example by having a liquid-cooled jacket 186 (for example a water-cooled jacket), having a circulating layer of cooled liquid forming a thermal barrier between externally applied heat (for example steam S) and the gel 124. Maintaining the gel 124 at a cool temperature may facilitate shaping the gel 124 within the cellulose acetate 122 longitudinal sides of the tubular element 500.

In this example the tubular elements 500 are formed by cutting through the gaps 128, of the composite rod, which aids prevention of contamination of the cutting machinery with the gel 124, thus improving cutting performance. The composite rod, in this example, is cooled prior to cutting, by a period of resting until it reaches a suitable temperature for cutting. After cutting, the cut lengths have hollow ends if cut in the gaps 128, which in some examples are trimmed off to form the tubular element, and before assembly into an aerosol generating article 100. The bursts of gel 124, in this example is 60 millimetres long, and separated by 10 millimetres gaps. In other examples the hollow ends are not trimmed at both ends in order to create a cavity 140 between the gel 124 and the fluid guide 400.

Alternatively, to the illustrated examples here, in specific examples, the gel 124 may be extruded at room temperature. Also, in alternatively specific examples the cellulose acetate is replaced with other materials, for example, polylactic acid.

In the FIG. 19 embodiment the mandrel has a cylindrical shape to aid in the manufacturing of a tubular shaped, tubular element.

Figure 20:
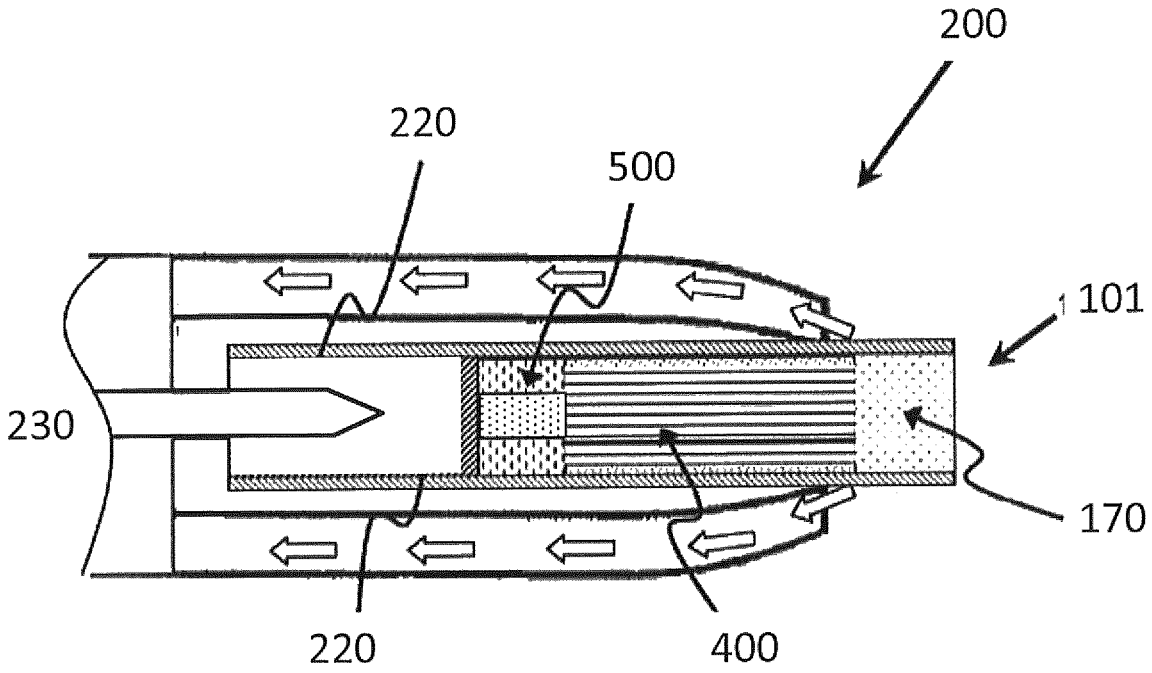
FIG. 20 shows an aerosol generating system comprising an electrically heated aerosol generating device and an aerosol generating article.

FIG. 20 illustrates a portion of an aerosol-generating device 200 with partially inserted aerosol generating article 100, as described above and illustrated in FIG. 13.

The aerosol generating device 200 comprises a heating element 230. As shown in FIG. 20, the heating element 230 is mounted within an aerosol generating article 100 receiving chamber of the aerosol generating device 200. In use, the aerosol generating article 100 is inserted into the aerosol generating article receiving chamber of the aerosol generating device 200 such that the heating element 230 is inserted, via the end plug 600 into the tubular element 500 of the aerosol generating article 100 as shown in FIG. 20. In FIG. 20, the heating element 230 of the aerosol-generating device 200 is a heater blade.

The aerosol-generating device 200 comprises a power supply and electronics that allow the heating element 230 to be actuated. Such actuation may be manually operated or may occur automatically in response to negative pressure being applied at the proximal end of the aerosol generating article 100 inserted into the aerosol generating article receiving chamber of the aerosol-generating device 200. A plurality of openings is provided in the aerosol-generating device to allow air to flow to the aerosol-generating article 100; the direction of fluid, for example air, flow in the aerosol generating device 200 is illustrated by arrows in FIG. 20. The fluid can then enter the aerosol generating article 100 via the apertures 150 not shown.

Once the internal heating element 230 is inserted into the tubular element 500 of the aerosol-generating article 100, and actuated, the tubular element 500 comprising gel 124 comprising an active agent is heated to a temperature of 375 degrees Celsius by the heating element 230 of the aerosol-generating device 200. At this temperature, material from the tubular element 500 of the aerosol generating article 100 leaves the gel. When negative pressure is applied to the proximal end 101 of the aerosol generating article 100, this material from the tubular element 500 is drawn downstream through the aerosol-generating article 100, in particular drawn through the fluid guide 400 towards the proximal end and out of the proximal end 101 of the aerosol generating article 100.

As the aerosol passes downstream thorough the aerosol generating article 100, the temperature of the aerosol is reduced due to transfer of thermal energy from the aerosol to the fluid guide 400. In this example, when the aerosol enters the fluid guide 400, the temperature of the aerosol is about 150 degrees Celsius. Due to cooling within the fluid guide 400, the temperature of the aerosol as it exits the fluid guide 400 is 40 degrees Celsius. This leads to the formation of aerosol droplets.

In the illustrated example of FIG. 20 the tubular element 500 comprises cellulose acetate forming the longitudinal sides 122 of the cylindrical rod, with gel 124 in the core or central portion of the tubular element 500. Alternatively in other specific examples, the longitudinal sides of the tubular element 500 may be cardboard; crimped paper, such as crimped heat resistant paper or crimped parchment paper; or a polymeric material, for example low density polyethylene (LDPE).

In FIGS. 14, 15, 16, the tubular element 500 has a single core provided with a single gel 124, with the gel 124 filling the core, surrounded by cellulose acetate along the longitudinal sides of the tubular element 500. However, in alternative specific examples, the tubular element 500 comprises more than one core. In specific embodiments the tubular element comprises more than one gel 124. Not all components of the tubular element 500 of FIGS. 14, 15 and 16 are necessarily shown or labelled.

Figure 21:
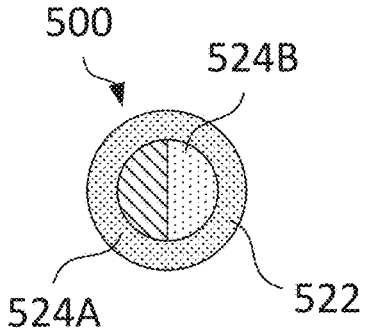
FIGS. 21, 22 and 23 show cross-sectional views of further tubular elements for an aerosol generating article.

As illustrated in the example of FIG. 21 the tubular element 500 comprises a plurality of gels 524A, 524B extending along the axial length of the core of tubular element 500, as shown in cross-section in FIG. 21. The tubular element 500, in this FIG. 21 embodiment, comprises cellulose acetate longitudinal sides 522, 622, 722. Not all components of the tubular element 500 are necessarily shown or labelled in the FIG. 21 embodiment.

The plurality of gels 524A, 524B may be extruded into the cellulose acetate 522 through separate conduits in the mandrel (not shown) forming the core of the tubular element 500. The use of gels 124 with different volatilities may facilitate optimisation of delivery of the active agent.

Figure 22:
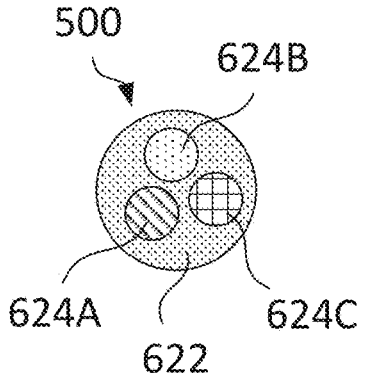

In the example illustrated in FIG. 22 the tubular element 500 comprises cellulose acetate longitudinal sides 622, the tubular element 500 additionally comprises a plurality of cores 624A, 624B, 624C, as shown in cross-section in FIG. 22.

Not all components of the tubular element 500 are necessarily shown or labelled in this FIG. 22 embodiment.

In this specific example, the plurality of cores is provided with different gels 624A, 624B, 624C, the gels having different active agents, for example different nicotine and flavouring, as shown in FIG. 22. The use of gels with different volatilities may facilitate optimisation of delivery of the active ingredient, in particular delivery over time of a heating cycle of an aerosol generating device.

In other specific examples (not shown) each of the plurality of cores 624A, 624B, 624C is provided with the same gel 124 (not shown). The use of a plurality of cores facilitates optimising air flow performance through the tubular element 500.

The plurality of cores may be formed by use of a mandrel (not shown) with a corresponding plurality of projections extending rearwardly with respect to the direction of travel T of the extruded cellulose acetate material. The gel may be extruded through respective conduits in the plurality of rearwardly extending mandrel projections.

Figure 23:
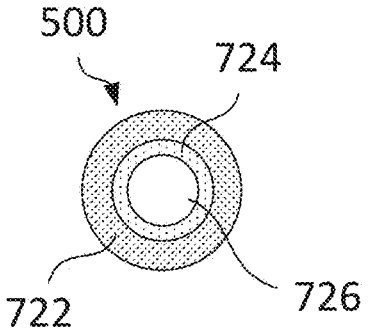

In FIGS. 14, 15, 16, the tubular element 500 comprises cellulose acetate 122 longitudinal sides filled with gel 124 in the core. However, alternatively, in specific examples in combination with other features, the core of the tubular element 500 is only partially filled with gel 124 across the cross-section perpendicular to the axial length. Advantageously this facilitates axial air flow through the length of the tubular element 500. For example, as shown in FIG. 23, the gel 724 may be provided as a coating on the internal face of the longitudinal sides of the tubular element 500. Not all components of the tubular element 500 are necessarily shown or labelled in the FIG. 23 embodiment.

In this illustrated example, FIG. 23 embodiment, the tubular element 500 has a hollow conduit 726 extending axially along its length, by use of a mandrel (not shown) with a central rod extending further downstream from where the gel 724 is extruded into the tube during manufacturing, to form the hollow conduit within the extruded gel 724.

Although FIG. 20 illustrates an aerosol generating article 100 that is used with a blade-like heating element 230 of the aerosol generating device 200, the tubular element 500 may, alternatively, be used in other aerosol generating articles 100 that are heated differently.

Figure 24:
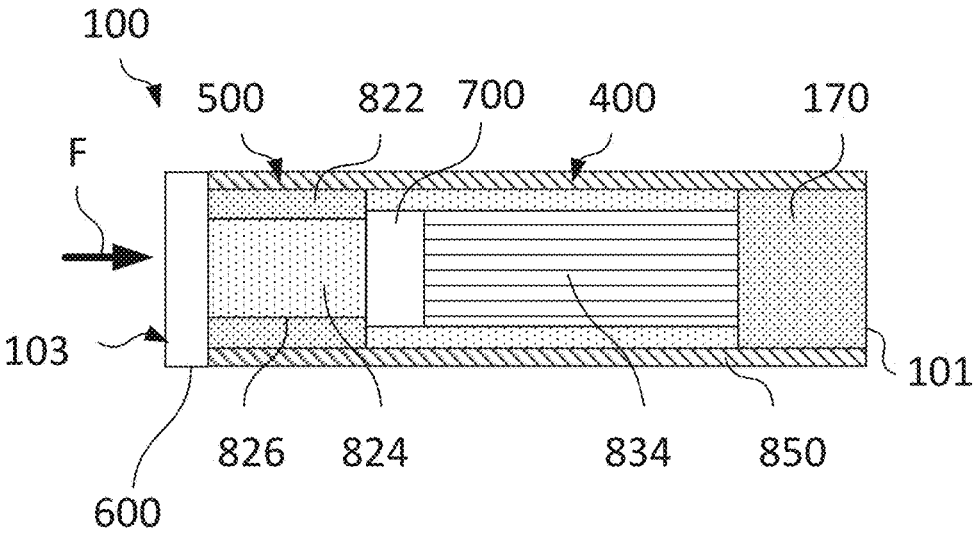
FIG. 24 shows a cross-sectional view along the length of an aerosol generating article.

For example, FIG. 24 illustrates, a cut away view, of an example of an aerosol generating article 100 that is suitable for induction heating as well as for heating with a blade like heating element. FIG. 24 illustrates an example of an aerosol generating article 100 suitable for use with a tubular element of the present invention. FIG. 24 is a cross-sectional, cut away, view of a tubular aerosol generating article and its components, for example a tubular element 500, and thus does not show the curvature of the tubular shapes. Not all components of the tubular element 500 are necessarily shown or labelled in this FIG. 24.

In the FIG. 24 example the aerosol generating article 100 comprises a mouthpiece 170 at the proximal end 101, a fluid guide 400, a cavity 700, a tubular element 500, and an end plug 600 in the order proximal to distal. In this example, the tubular element 500 comprises a gel 824 comprising an active agent and further comprises a susceptor 826. The susceptor 826 in this example is a single aluminium strip centrally located along the longitudinal axis of the tubular element 500. On insertion of the distal end 103 of the aerosol generating article 100 into an aerosol generating device 200 (not shown), the portion of the aerosol generating article 100 comprising the tubular element 500 is positioned to be in proximity to the induction heating elements 230 (not shown) of the aerosol generating device 200 (not shown). Electromagnetic radiation produced by the induction heating elements 230 is absorbed by the susceptor 826 and aid heating of the gel 824 in the tubular element 500, in turn aiding the release of material from the gel 824, for example the active agent entrained into the passing aerosol when a negative pressure is applied at the proximal end 101 of the aerosol generating article 100. Fluid, for example air, enters the outer longitudinal passageways 834 via apertures 150 (not shown) to transfer to the cavity 700 and then to the tubular element 500 where the fluid mixes with the gel 824 and is entrained with active agents before returning to the cavity and then via the inner longitudinal passageway (not shown) of the fluid guide 400 before exiting at the proximal end 101. In this example, the longitudinal sides 822 of the tubular element 500 comprise paper. The aerosol generating article comprises an outer wrapper 850. This aerosol generating article 100 illustrated in FIG. 24 and as described can be used with the aerosol generating device 200 as illustrated in FIGS. 1-2 and as described. Preferably the aerosol generating article 100 of FIG. 16 is heated by induction from the aerosol generating device 200.

The tubular element 500 may have numerous different combinations of, among other things; gel 124, porous medium loaded with gel 125, active agent, inner longitudinal elements, void space, filling material (preferably porous) and wrapper. A desired aerosol may be created by the particular combination and arrangement of its ingredients.

Figure 25:
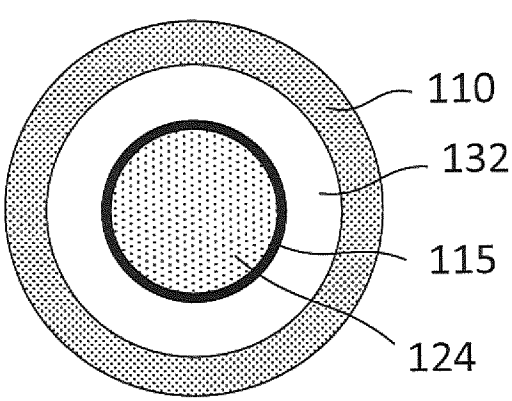
FIGS. 25-29 show schematic cross-sectional views of various tubular elements.

For example:

FIG. 25 illustrates an example wherein the tubular element 500 comprises: a wrapper 110; a second tubular element 115, the second tubular element 115 comprising gel 124, the second tubular element 115 comprises a paper wrapper, the second tubular element is located centrally along the longitudinal axis of the tubular element 500; porous filler material 132 located between the second tubular element 115 and the wrapper 110. The porous filler material 132 helps to hold the second tubular element centrally within the tubular element 500. The gel 124 in this example is located within the central portion of the second tubular element 115.

Figure 26:
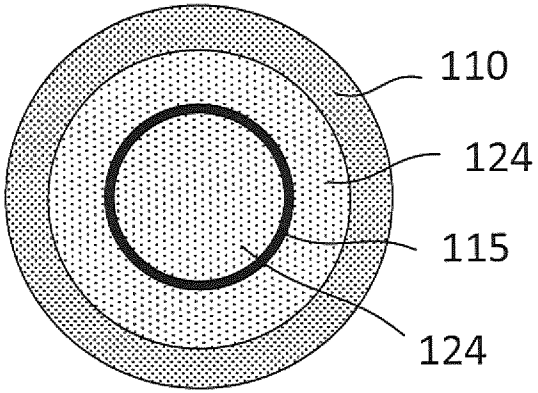

FIG. 26 illustrates an example where the tubular element 500 comprises: a wrapper 110; a second tubular element 115 comprising gel 124, the second tubular element comprises a paper wrapper, the second tubular element is located centrally along the longitudinal axis of tubular element 500; gel 124 located between the second tubular element 115 and the wrapper 110. The gel located between the second tubular element 115 and the wrapper 110 helps to hold the second tubular element 115 centrally within the tubular element 500. The gel 124 in this example is located within the central portion of the second tubular element 115 as well as between the second tubular element 115 and the wrapper 110.

Figure 27:
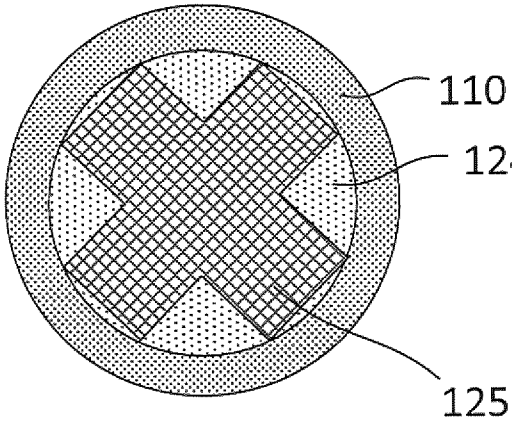

FIG. 27 illustrates an example where the tubular element 500 comprises: a wrapper 110; an inner longitudinal element comprising porous medium loaded with gel 125, the inner longitudinal element comprising porous medium loaded with gel 125, is centrally located along the longitudinal axis of the tubular element 500; gel 124 located between the inner longitudinal element comprising porous medium loaded with gel 125 and the wrapper 110. The gel 124 may assist in holding the inner longitudinal element comprising porous medium loaded with gel 124 centrally within the tubular element 500. In this example the inner longitudinal element is a cross shape, in its longitudinal cross-section, and parts of the inner longitudinal element contact the inner surface of the wrapper 110. Other examples may use inner longitudinal elements of other shapes and sizes, and thus may not necessarily contact the inner surface off the wrapper 110. Other specific examples may also use inner longitudinal elements of different materials.

Figure 28:
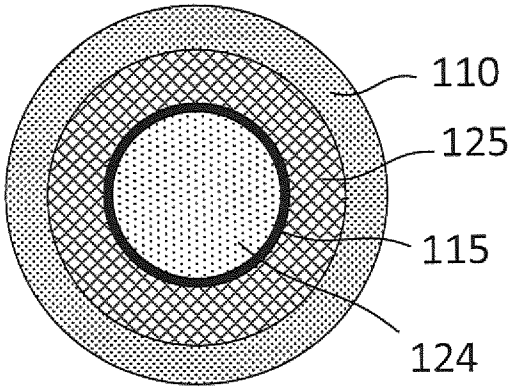

FIG. 28 illustrates an example where the tubular element 500 comprises: a wrapper 110; a second tubular element 115 comprising gel 124, the second tubular element 115 comprises a paper wrapper, the second tubular element is located centrally along the longitudinal axis of the tubular element 500; porous medium loaded with gel 124 located between the second tubular element 115 and the wrapper 110. In this example the porous medium loaded with gel 124 helps to hold the second tubular element 115 centrally within the tubular element 500.

Figure 29:
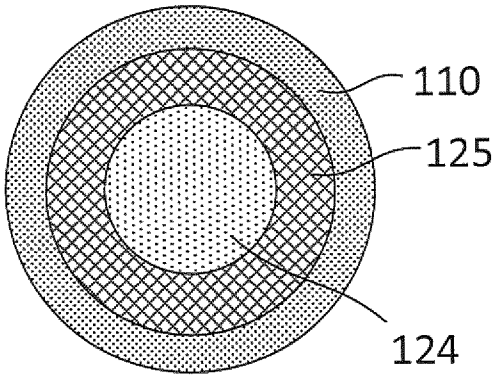

FIG. 29 illustrates an example where the tubular element 500 comprises: a wrapper 110;

porous medium loaded with gel 125; and gel 124; wherein the porous medium loaded with gel 125 is located adjacent the inner surface of the wrapper 110, and, surrounding the gel 124. In this example there is both gel 124 and porous medium loaded with gel 125. The porous medium loaded with gel 125 coating the inside surface of the wrapper, although the shape of the porous medium loaded with gel 125 may have been formed first and then wrapped by the wrapper 110. In this example the porous medium loaded with gel 125 is surrounding the gel 124, that is held centrally along the longitudinal axis of the tubular element 500. The porous medium loaded with gel may assist in holding the gel 125 along the central position.

Figure 30:
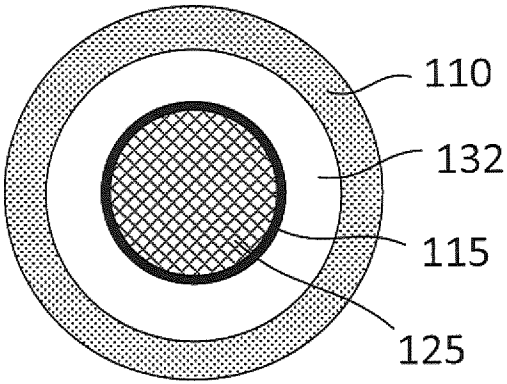
FIG. 30-34 show schematic cross-sectional views of various tubular elements.

FIG. 30 illustrates an example where the tubular element 500 comprises: a wrapper 110; a second tubular element 115 comprising porous medium loaded with gel 125, the second tubular element 115 comprises a paper wrapper; the second tubular element 115 is located centrally along the longitudinal axis of the tubular element 500; porous filler material 132 located between the second tubular element 115 and the wrapper 110. The porous filler material 132 helps to hold the second tubular element centrally within the tubular element 500. The porous medium loaded with gel 125 in this example is located within the central portion of the second tubular element 115. In this example the paper wrapper of the second tubular element 115 surrounds the porous medium loaded with gel.

Figure 31:
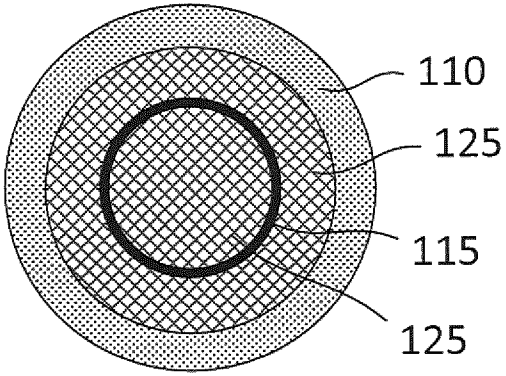

FIG. 31 illustrates an example where the tubular element 500 comprises: a wrapper 110; a second tubular element 115 comprising porous medium loaded with gel 125, the second tubular element 115, is centrally located along the longitudinal axis of the tubular element 500, the second tubular element further comprises a paper wrapper; porous medium loaded with gel 125, located between the second tubular element 115 and the wrapper 110. In this example the porous medium loaded with gel 125 is in two locations, within the second tubular element 115 and between the second tubular element and the wrapper 110. These may have the same or different, porous medium, gel, or active agent.

Figure 32:
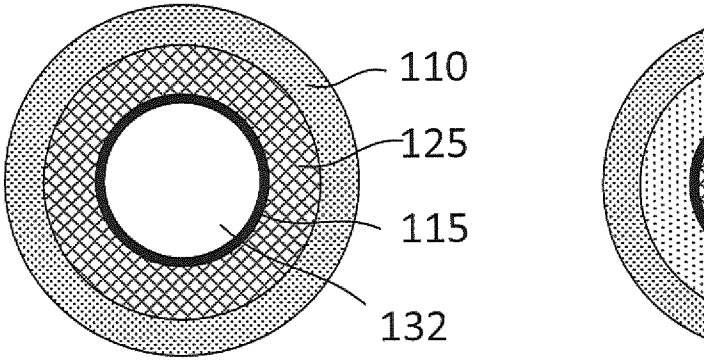

FIG. 32 illustrates an example where the tubular element 500 comprises: a wrapper 110; a second tubular element 115 comprising porous filler material 132, the second tubular element 115 is centrally located along the longitudinal axis of the tubular element 500, the second tubular element 115 further comprises a paper wrapper; porous medium loaded with gel 125 located between the second tubular element 115 and the wrapper 110. The porous medium loaded with gel may assist in holding the second tubular element 115 centrally along the longitudinal axis of the tubular element 500. In this example the porous medium loaded with gel 125 is adjacent the inner surface of the wrapper 110. The porous medium loaded with gel 125 coats the inner surface of the wrapper 110.

Figure 33:
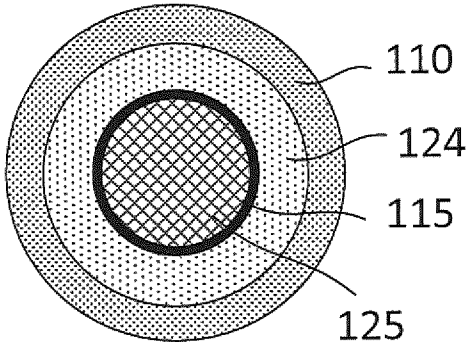

FIG. 33 illustrates an example where the tubular element 500 comprises: a wrapper 110; a second tubular element 115 comprising porous medium loaded with gel 125, the second tubular element 115 is centrally located along the longitudinal axis of the tubular element 500, the second tubular element 115 further comprises a paper wrapper; gel 124, located between the second tubular element 115 and the wrapper 110. In this example the gel 124 may assist in holding the second tubular element 115 centrally along the longitudinal axis of the tubular element 500. In this example the gel 124 is adjacent the inner surface of the wrapper 110. In this example the porous medium loaded with gel 124 is centrally located within the second tubular element 115, surrounded by the paper wrapper of the second tubular elements 115.

Figure 34:
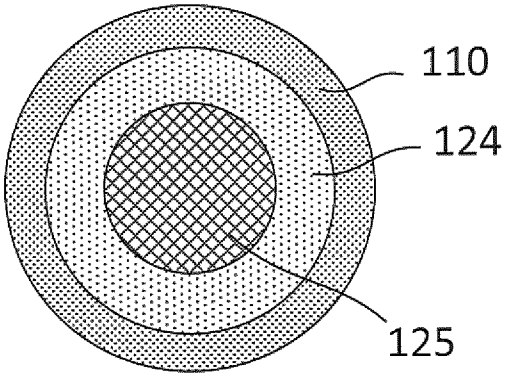

FIG. 34 illustrates an example where the tubular element 500 comprises: a wrapper 110; an inner longitudinal element comprising porous medium loaded with gel 125, the inner longitudinal element comprising porous medium loaded with gel 125, is cylindrical and centrally located along the longitudinal axis of the tubular element 500; gel 124 located between the inner longitudinal element comprising porous medium loaded with gel 125 and the wrapper 110. The gel 124 may assist in holding the inner longitudinal element comprising porous medium loaded with gel 124 centrally within the tubular element 500. In this example the inner longitudinal element is a cylindrical in shape, in its longitudinal cross-section, and is held apart from the inner surface of the wrapper 110 by gel 124. Other examples may use inner longitudinal elements of other shapes and sizes, and materials.

Figure 35:
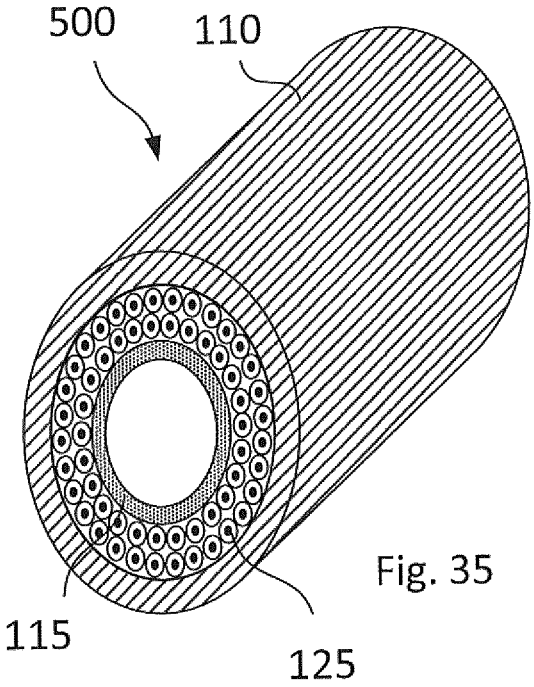
FIG. 35 shows a perspective view of a schematic drawing of tubular element comprising thread the loaded with gel.
Figure 36:
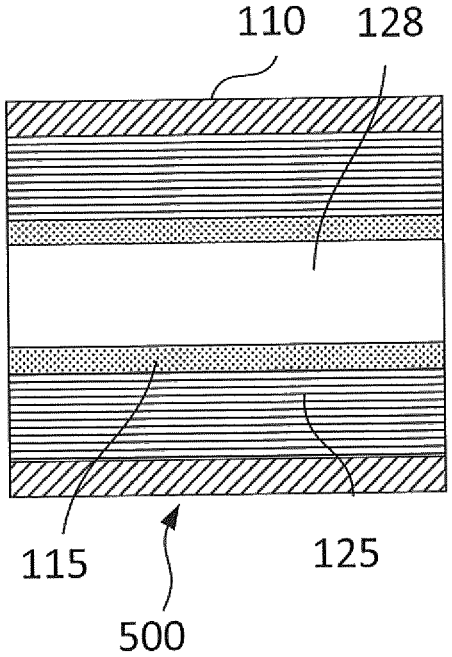
FIG. 36 shows a cross-sectional view (cut proximal to distal) of the schematic drawing of the tubular element illustrated in FIG. 35.
Figure 37:
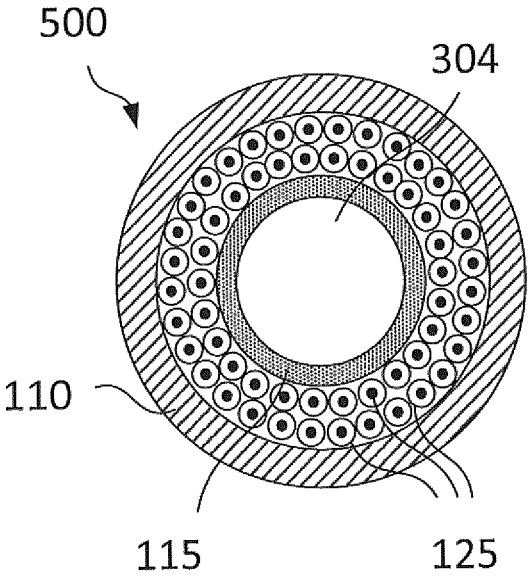
FIG. 37 shows a cross-sectional view of the tubular element illustrated in FIG. 35.

FIGS. 35, 36 and 37 illustrates a tubular element 500 comprising thread loaded with gel 125. In this example the threads loaded with gel 125 run longitudinally, substantially parallel to the longitudinal axis of the tubular element 500. In this example there is a second tubular element 304, with inner wrapper 115, that is positioned centrally within the tubular element 500. The second tubular element 304 is also positioned longitudinally within the tubular element 500. The threads loaded with gel 125 are positioned between the second tubular element 304 and the inner surface of the wrapper 110. In the example illustrated in FIGS. 35, 36 and 37 the threads loaded with gel run substantially the full longitudinal length of the tubular element.

Figure 38:
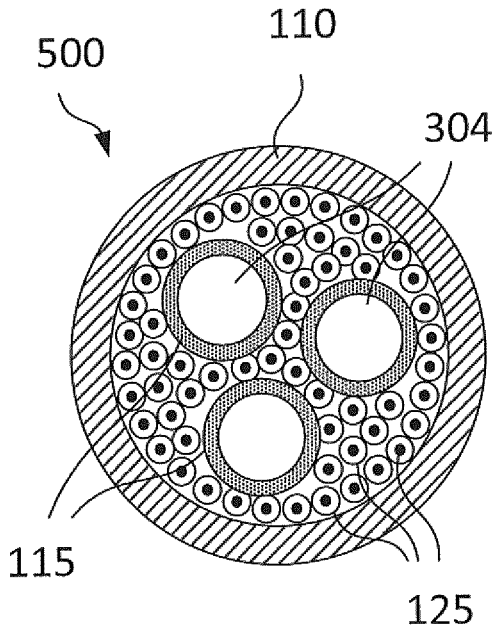
FIG. 38 shows a cross-sectional view of a tubular element.

FIG. 38 also illustrates a tubular element 500 comprising thread loaded with gel 125. In this example there are three second tubular elements 304 and the thread loaded with gel 125 is positioned between the three second tubular elements and is positioned between the second tubular elements and the inner surface of the wrapper 110.

Figure 39:
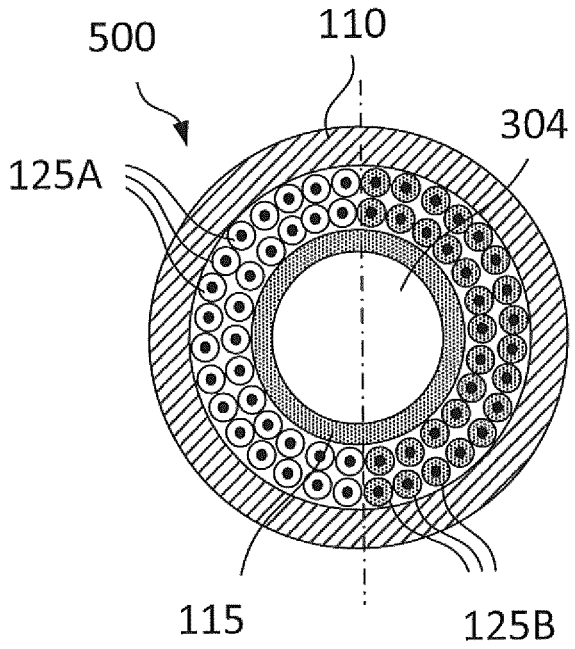
FIG. 39 shows a cross sectional view of a tubular element.

FIG. 39 illustrates a tubular element comprising threads loaded with gel 125 in which the tubular element 500 comprises more than one gel 124. Threads loaded with gel 125, are evenly divided in this example between threads loaded with gel 125A, of one kind of gel 124, and threads loaded with gel 125B of another kind of gel 124.

Figure 40:
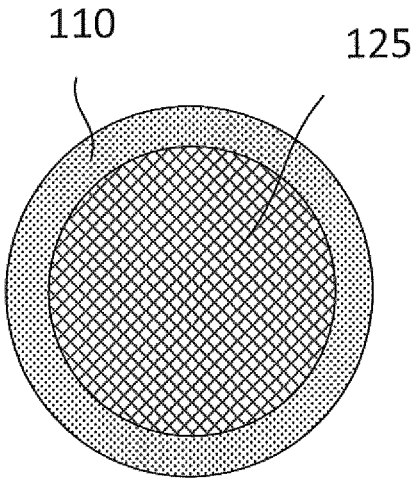
FIG. 40 shows a cross sectional view of a tubular element according to the invention.

FIG. 40 illustrates a preferred embodiment of the tubular element 500 that comprises a wrapper 110 defining a first longitudinal passageway comprising a porous medium loaded with gel 125. In this example the porous medium loaded with gel 125 comprises sheet material that has been crimped. The crimped sheet material gives many pathways when gathered together allowing ease of passage to any aerosol. This particular example is efficient for the passage or transfer of any aerosol while having ease to manufacture. FIG. 40 illustrate an embodiment of a cross sectional view, as if cut across the longitudinal axis, of a tubular element 500.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and, is not intended to exclude other embodiments from the scope of the disclosure, including the claims.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

The embodiments exemplified above are not limiting. Other embodiments consistent with the embodiments described above will be apparent to those skilled in the art.

EXAMPLES

1. A tubular element, the tubular element comprising a wrapper that forms a first longitudinal passageway and further comprising a porous medium loaded with gel; the gel comprising an active agent.

2. A tubular element according to example 1, wherein the porous medium is a crimped sheet material.

3. A tubular element according to example 1 or 2, wherein the tubular element comprises a second tubular element, the second tubular element is positioned longitudinally within the first longitudinal passageway.

4. A tubular element according to example 3, wherein the second tubular element comprises porous medium loaded with gel.

5. A tubular element according to anyone of examples 3, or 4, wherein the porous medium loaded with gel is positioned between the second tubular element and the wrapper that forms the first longitudinal passageway.

6. A tubular element according to anyone of examples 3, 4 or 5, wherein gel is positioned between the second tubular element and the wrapper that forms the first longitudinal passageway.

7. A tubular element according to claim 1, wherein comprises a longitudinal element positioned longitudinally within the first longitudinal passageway.

8. A tubular element according to any preceding examples, wherein the wrapper is stiff.

9. A tubular element as claimed in any preceding examples, wherein the wrapper is water-resistant.

10. A tubular element according to anyone of examples 3 to 9, wherein a longitudinal side of the second tubular element is stiff.

11. A tubular element according to any preceding example, wherein further comprises a susceptor to aid heat transfer.

12. A tubular element according to any preceding example, wherein the porous medium loaded with gel comprises cotton.

13. A tubular element according to any preceding example, wherein the porous medium loaded with gel is shredded.

14. An article comprising a tubular element according to any one of examples 1 to 13.

15. A method of manufacturing a tubular element according to any preceding example, the method comprises the steps of:

dispensing a porous medium loaded with gel onto a web of wrapping material; and, wrapping the web of wrapping material around the porous medium loaded with gel to form a wrapped, rod shaped, structure of porous medium loaded with gel.

The invention claimed is:

1. A tubular element for an aerosol-generating article, the tubular element comprising:

a wrapper that forms a first longitudinal passageway;

a porous medium loaded with gel; and a susceptor disposed longitudinally within the tubular element, wherein the gel comprises an active agent, wherein the wrapper comprises paper, and wherein the susceptor is in direct contact with the porous medium loaded with the gel.

2. The tubular element according to claim 1, wherein the wrapper further comprises a further susceptor.

3. The tubular element according to claim 1, wherein the susceptor comprises metal.

4. The tubular element according to claim 1, wherein the susceptor comprises aluminium.

5. The tubular element according to claim 3, wherein the susceptor is metal powder.

6. The tubular element according to claim 1, wherein the porous medium is a crimped sheet material.

7. The tubular element according to claim 1, further comprising a longitudinal element disposed longitudinally within the first longitudinal passageway.

8. The tubular element according to claim 1, wherein the susceptor is a metal thread.

9. The tubular element according to claim 1, wherein the wrapper is water-resistant.

10. The tubular element according to claim 1, wherein the wrapper is hydrophobic.

11. The tubular element according to claim 1, further comprising a second tubular element disposed longitudinally within the first longitudinal passageway.

12. The tubular element according to claim 1, wherein the porous medium loaded with the gel comprises cotton.

13. The tubular element according to claim 1, wherein the porous medium loaded with the gel is shredded.

14. The tubular element according to claim 12, wherein the porous medium loaded with the gel is crimped.

15. The tubular element according to claim 1, further comprising an end plug disposed at one end of the tubular element.

* * * * *